US009162690B2

(12) United States Patent
Kumar et al.

(10) Patent No.: US 9,162,690 B2
(45) **Date of Patent: *Oct. 20, 2015**

(54) SYSTEM AND METHOD FOR CONTROLLING MOVEMENT OF VEHICLES

(71) Applicant: GENERAL ELECTRIC COMPANY, Schenectady, NY (US)

(72) Inventors: Ajith Kuttannair Kumar, Erie, PA (US); Paul Houpt, Niskayuna, NY (US); Stephen Mathe, Melbourne, FL (US); Paul Julich, Indialantic, FL (US); Jeffrey Kisak, Erie, PA (US); Glenn Shaffer, Erie, PA (US); Scott Nelson, Melbourne, FL (US); Wolfgang Daum, Milwaukee, WI (US)

(73) Assignee: General Electronic Company, Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/489,126

(22) Filed: Sep. 17, 2014

(65) Prior Publication Data

US 2015/0005994 A1 Jan. 1, 2015

Related U.S. Application Data

(63) Continuation of application No. 13/545,271, filed on Jul. 10, 2012, now Pat. No. 8,924,049, which is a (Continued)

(51) Int. Cl.

| | |
|---|---|
| ***G05D 1/00*** | (2006.01) |
| ***G06F 19/00*** | (2011.01) |
| ***B61L 27/00*** | (2006.01) |

(52) U.S. Cl.
CPC ..... *B61L 27/0027* (2013.01); *B61L 2205/04* (2013.01)

(58) Field of Classification Search
USPC ..... 701/20, 408, 2, 19, 410, 413, 416, 417, 701/420, 424, 442, 527, 117; 726/6; 455/411
See application file for complete search history.

(56) References Cited

U.S. PATENT DOCUMENTS

| | | | | |
|---|---|---|---|---|
| 2,104,652 | A * | 1/1938 | Inman | 313/25 |
| 2,601,634 | A * | 6/1952 | Rivette | 62/443 |
| 5,828,979 | A * | 10/1998 | Polivka et al. | 701/117 |
| 6,317,686 | B1 * | 11/2001 | Ran | 701/533 |
| 2003/0139909 | A1 * | 7/2003 | Ozawa | 702/183 |

(Continued)

*Primary Examiner* — Ronnie Mancho
(74) *Attorney, Agent, or Firm* — GE Global Patent Operation

(57) ABSTRACT

A method includes determining an operational parameter of a first vehicle traveling with a plurality of vehicles in a transportation network and/or a route in the transportation network, identifying a failure condition of the first vehicle and/or the route based on the operational parameter, obtaining plural different sets of remedial actions that dictate operations to be taken based on the operational parameter, simulating travel of the plurality of vehicles in the transportation network based on implementation of the different sets of remedial actions, determining potential consequences on travel of the plurality of vehicles in the transportation network when the different sets of remedial actions are implemented in the travel that is simulated, and based on the potential consequences, receiving a selection of at least one of the different sets of remedial actions to be implemented in actual travel of the plurality of vehicles in the transportation network.

17 Claims, 30 Drawing Sheets

Related U.S. Application Data continuation-in-part of application No. 10/736,089, filed on Dec. 15, 2003, now Pat. No. 8,538,611, said application No. 13/545,271 is a continuation-in-part of application No. 11/750,716, filed on May 18, 2007, which is a continuation-in-part of application No. 11/385,354, filed on Mar. 20, 2006.

(60) Provisional application No. 60/438,234, filed on Jan. 6, 2003, provisional application No. 60/894,006, filed on Mar. 9, 2007.

(56) References Cited

U.S. PATENT DOCUMENTS

| | | | | |
|---|---|---|---|---|
| 2004/0049339 | A1* | 3/2004 | Kober et al. | 701/209 |
| 2009/0205028 | A1* | 8/2009 | Smeets et al. | 726/6 |
| 2012/0108204 | A1* | 5/2012 | Schell et al. | 455/411 |
| 2012/0108205 | A1* | 5/2012 | Schell et al. | 455/411 |
| 2012/0108207 | A1* | 5/2012 | Schell et al. | 455/411 |
| 2012/0135710 | A1* | 5/2012 | Schell et al. | 455/411 |

* cited by examiner

INTERFACE VEHICLE LEVEL TO MOVEMENT PLANNER

NETWORK FUEL MANAGER MODULE

SYSTEM AND METHOD FOR CONTROLLING MOVEMENT OF VEHICLES

CROSS-REFERENCE TO RELATED APPLICATIONS

This application is a continuation of U.S. patent application Ser. No. 13/545,271, filed on 10 Jul. 2012, and titled "System And Method For Controlling Movement Of Vehicles" (the "'271 Application"). The '271 Application is a continuation-in-part of U.S. patent application Ser. No. 10/736,089, filed on 15 Dec. 2003, and titled "Multi-level Railway Operations Optimization System And Method" (the "'089 Application"), now U.S. Pat. No. 8,538,611 issued 17 Sep. 2013, which claims priority to U.S. Provisional Application No. 60/438,234, filed on 6 Jan. 2003, and titled "Multi-level Railway Operations Optimization" (the "'234 Application"). The '271 Application also is a continuation-in-part of U.S. patent application Ser. No. 11/750,716, filed on 18 May 2007, and titled "Control System And Method For A Vehicle Or Other Power Generating Unit" (the "'716 Application"). The '716 Application claims priority to U.S. Provisional Application No. 60/894,006, filed 9 Mar. 2007, titled "Trip Optimization System And Method For A Train" (the "'006 Application"), and is a continuation-in-part of U.S. patent application Ser. No. 11/385,354, filed on 20 Mar. 2006, titled "Train Optimization System And Method For A Train" (the "'354 Application"). The entire disclosures of each of the above applications are incorporated herein by reference.

TECHNICAL FIELD

One or more embodiments of the subject matter described herein relate to vehicle operations, such as a system and method of controlling or coordinating railway operations using a multi-level, system-wide approach. One or more embodiments of the subject matter described herein relate to vehicle operations, such as monitoring and controlling operations of a rail vehicle to improve efficiency while satisfying schedule constraints.

BACKGROUND

Transportation systems such as railways can be complex systems, with several components being interdependent on other components within the system. Attempts have been made in the past to optimize the operation of a particular component or groups of components of the railway system, such as for the locomotive, for a particular operating characteristic such as fuel consumption, which can be a significant component of the cost of operating a railway system. Some estimates indicate that fuel consumption is the second largest railway system operating cost, second only to labor costs.

For example, U.S. Pat. No. 6,144,901 proposes optimizing the operation of a train for a number of operating parameters, including fuel consumption. Optimizing the performance of a particular train (which may be only one component of a much larger system that includes the railway network of track, other trains, crews, rail yards, departure points, and destination points), however, may not yield an overall system-wide optimization or improvement of one or more of the operating parameters.

One system and method of planning at the railway track network system is disclosed in U.S. Pat. No. 5,794,172. Movement planners such as this are primarily focused on movement of the trains through the network based on business objective functions (BOF) defined by the railroad company, and not necessarily on the basis of improving performance or a particular performance parameter such as fuel consumption. Further, the movement planner may not extend the improvement down to the train (much less the consist or locomotive), nor to the railroad service and maintenance operations that plan for the servicing of the trains or locomotives.

Thus, there does not appear to be recognition that improvement of operations for a transportation system may require a multi-level approach, with the gathering of key data at several levels and communicating data with other levels in the system.

Powered systems that operate within transportation systems or other systems can include off-highway vehicles, marine diesel powered propulsion plants, stationary diesel powered systems, and rail vehicle systems, e.g., trains. Some of these powered systems may be powered by a power unit, such as a diesel or other fuel-powered unit. With respect to rail vehicle systems, a power unit may be part of at least one locomotive and the rail vehicle system may further include a plurality of rail cars, such as freight cars. More than one locomotive can be provided with the locomotives coupled as a locomotive consist. The locomotives may be complex systems with numerous subsystems, with one or more subsystems being interdependent on other subsystems.

An operator may be onboard the powered system (such as a rail vehicle) to ensure proper operation of the powered system. In addition to ensuring proper operation of the rail vehicle, the operator also may be responsible for determining operating speeds of the rail vehicle and in-vehicle forces within the rail vehicle (e.g., forces between coupled powered units such as locomotives and/or non-powered units such as cargo cars or other railcars). To perform this function, the operator may have extensive experience with operating the rail vehicle over a specified terrain. The experience and knowledge of the operator may be needed to comply with prescribed operating speeds that may vary based on the location of the rail vehicle along a route, such as along a track. Moreover, the operator also may be responsible for ensuring in-vehicle forces remain within acceptable limits.

Even with knowledge to ensure safe operation, the operator may not operate the vehicle so that the fuel consumption, emissions, and/or travel time is reduced or minimized for each trip. For example, other factors such as emission output, environmental conditions like noise or vibration, a weighted combination of fuel consumption and emissions output, and the like may prove difficult for the operator to both safely operate the vehicle while reducing the amount of fuel consumed by the vehicle, reducing the amount of emissions generated by the vehicle, and/or reducing the travel time of the vehicle. The varying sizes, loading, fuel characteristics, emission characteristic, and the like can be different for various vehicles, and external factors such as weather and traffic conditions can frequently vary.

Owners and/or operators of off-highway vehicles, marine diesel powered propulsion plants, and/or stationary diesel powered systems may realize financial benefits when the powered systems produce increased fuel efficiency, decreased emission output, and/or decreased transit time so as to save on operating costs while reducing emission output and meeting operating constraints, such as but not limited to mission time constraints.

BRIEF DESCRIPTION

One aspect of the presently described subject matter is the provision of a multi-level system for management of a railway system and operational components of the railway system. The railway system comprises a first level configured to optimize (e.g., improve) an operation within the first level that includes first level operational parameters which define operational characteristics and data of the first level, and a second level configured to improve an operation within the second level that includes second level operational parameters which define the operational characteristic and data of the second level. The term "optimize" (and forms thereof) are not intended to require maximizing or minimizing a characteristic, parameter, or other object in all embodiments described herein. Instead, "optimize" and its forms are intended to mean that a characteristic, parameter, or other object is increased or decreased toward a designated or desired amount. For example, "optimizing" fuel efficiency is not intended to mean that no fuel is consumed or that the absolute minimum amount of fuel is consumed. Rather, optimizing the fuel efficiency may mean that the fuel efficiency is increased, but not necessarily maximized. As another example, optimizing emission generation may not mean completely eliminating the generation of all emissions. Instead, optimizing emission generation may mean that the amount of emissions generated is reduced but not necessarily eliminated.

The first level provides the second level with the first level operational parameters, and the second level provides the first level with the second level operational parameters, such that improving the operation within the first level and improving the operation within the second level are each a function of improving a system operational parameter.

Another aspect of the presently described subject matter includes provision of a method for improving operation of a transportation system (e.g., a railway system) having first and second levels. The method includes communicating a first level operational parameter that defines an operational characteristic of the first level from the first level to the second level, communicating a second level operational parameter that defines an operational characteristic of the second level from the second level to the first level, improving a system operation across a combination of the first level and the second level based on a system operational parameter, improving an operation within the first level based on a first level operational parameter and based in part on the system operational parameter, and improving an operation within the second level based on a second level operational parameter and based in part on the system operational parameter.

Another aspect of the presently described subject matter is the provision of a method and system for multi-level railway operations improvement for a railroad system that identifies operating constraints and data at one or more levels, communicates these constraints and data to other levels (e.g., adjacent levels) and improves performance at one or more of the levels based on the data and constraints of the other levels relative to performance of the one or more levels without communication of the constraints and data.

Aspects of the presently described subject matter may further include establishing and communicating updated plans and monitoring and communicating compliance with the plans at multiple levels of the system.

Aspects of the presently described subject matter may further include improving performance at a railroad infrastructure level, railway track network level, individual rail vehicle level within the network, consist level within the rail vehicle, and the individual powered unit (e.g., locomotive) level within the consist.

Aspects of the presently described subject matter may further include improving performance at the railroad infrastructure level to enable condition-based, rather than scheduled-based, servicing of powered units (e.g., locomotives), including both temporary (or short-term) servicing requirements such as fueling and replenishment of other consumable materials on-board the powered units, and long-term servicing requirements such as replacement and repair of critical operating components, such as fraction motors and engines.

Aspects of the presently described subject matter may include optimizing (e.g., improving) performance of the various levels in light of business objective functions of an operating company, such as on-time deliveries, asset utilization, minimum or reduced fuel usage, reduced emissions, optimized or reduced crew costs, reduced dwell time, reduced maintenance time and costs, and/or reduced overall system costs.

These aspects of the presently described subject matter may provide benefits such as reduced journey-to-journey fuel usage variability, fuel savings for powered units (e.g., locomotives) operating within the system, graceful recovery of the system from upsets (e.g., mechanical failures), elimination or reduction of out-of-fuel mission failures, improved fuel inventory handling logistics, and/or decreased autonomy of crews in driving decisions.

One or more other embodiments of the presently described subject matter include a control system for operating a powered system (e.g., a diesel powered system) having at least one power generating unit, such as a diesel-powered generating unit, although other power generating units may be used. The system includes a mission optimizer that determines at least one setting be used by the power generating unit. A converter is also disclosed that receives at least one of information that is to be used by the power generating unit and converts the information to an output signal. A sensor collects at least one operational data from the powered system. This operational data is communicated to the mission optimizer. A communication system establishes a closed control loop between the mission optimizer, converter, and sensor.

Another example embodiment of the presently described subject matter includes a method for controlling operations of a powered system that has at least one power generating unit, such as a diesel-power generating unit. The method includes determining an optimized setting for the power generating unit. As described above, the term "optimized setting" may mean a setting that is increased or decreased, but not necessarily to a maximum or minimum value. Moreover, the term "optimized setting" can mean a setting that results in one or more operational parameter or characteristics of the power generating unit (e.g., fuel efficiency, emissions generated, mission or trip time, and the like) being increased or decreased relative to using another setting that differs from the "optimized" setting. The method may also include converting at least one optimized setting to a recognizable input or control signal for the power generating unit. The method also may include determining at least one operational condition of the powered system when at least one optimized setting is applied. The method also can include communicating the at least one operational condition within a closed control loop to an optimizer so that the at least operational condition is used to further optimize at least one setting of the powered system. For example, the at least one operational condition may be monitored in order to determine if the setting can or should be changed to further increase or decrease the at least one operational condition.

Another example embodiment includes a tangible and non-transitory computer readable storage medium (e.g., a computer software code) for operating a powered system having a computer (e.g., a processor) and at least one power generating unit. The computer software code includes one or more set of instructions (e.g., one or more computer software modules) that direct the processor to determine at least one of a setting for the power generating unit and to convert at least one setting to a recognizable input or control signal for the power generating unit. The one or more sets of instructions also may direct the processor to determine at least one operational condition of the powered system when the at least one setting is applied or used to control the power generating unit. The one or more sets of instructions also may direct the processor to communicate the at least one operational condition in a closed control loop to an optimizer so that the at least operational condition is used to further optimize at least one setting. For example, the operational condition may be monitored so that the setting can be changed to cause the operational condition to further increase or decrease.

In another embodiment, a control system for operating a vehicle is provided and includes a trip planner device and a sensor. The trip planner device is configured to determine two or more speed, power, or throttle settings as a function of at least one of time or distance of the vehicle along a route. The two or more speed, power, or throttle settings are based on information of the vehicle and information of the route. The trip planner device also is configured to output signals relating to the two or more speed, power, or throttle settings for control of the vehicle along the route. The sensor is configured to collect operational data of the vehicle that includes data of a vehicle speed as the vehicle travels along the route. The sensor also is configured to provide the operational data to the trip planner device. The trip planner device also is configured to adjust at least one of the speed, power, or throttle settings based at least in part on the operational data.

In another embodiment, a method for controlling a vehicle is provided. The method includes detecting data related to an operational condition of the vehicle that is representative of a vehicle speed as the vehicle travels along a route and determining information related to the route of the vehicle. The method also includes determining plural speed, power, or throttle settings based on the operational condition of the vehicle and the information related to the route of the vehicle. The method further includes adjusting at least one of the plural speed, power, or throttle settings based at least in part on the operational condition of the vehicle.

In another embodiment, another control system for operating a vehicle is provided that includes a trip planner device and a sensor. The trip planner device is configured to determine first plural speed, power, or throttle settings as a function of at least one of time or distance along a route based on information of the vehicle and information of the route. The trip planner device also is configured to output first signals based on the first plural speed, power, or throttle settings. The first signals relate to control of a propulsion subsystem of the vehicle along the route. The trip planner device also is configured to determine the first plural speed, power, or throttle settings at an initial point of the route prior to the vehicle traveling along the route. The sensor is configured to collect operational data of the vehicle that is representative of vehicle speeds as the vehicle travels along the route and to provide the operational data to the trip planner device. The trip planner device is configured to adjust the first signals based on the operational data.

In another embodiment, a system includes a trip planner device and a converter device. The trip planner device is configured to obtain a trip plan that designates operational settings for a vehicle during a trip along one or more routes. The trip plan designates the operational settings to reduce at least one of fuel consumed or emissions generated by the vehicle during the trip relative to the vehicle traveling over the trip according to at least one other plan. The converter device is configured to generate one or more first control signals for directing operations of the vehicle according to the operational settings designated by the trip plan and to obtain actual operational parameters of the vehicle for comparison to the operational settings designated by the trip plan. The converter device also is configured to generate one or more corrective signals for directing operations of the vehicle in order to reduce one or more differences between the actual operational parameters and the operational settings designated by the trip plan.

BRIEF DESCRIPTION OF THE DRAWINGS

A more particular description of examples of the subject matter briefly described above will be rendered by reference to specific embodiments thereof that are illustrated in the appended drawings. Understanding that these drawings depict only typical embodiments of the presently described subject matter and are not therefore to be considered to be limiting of all embodiments of the scope of the disclosed subject matter. The inventive subject matter will be described and explained with additional specificity and detail through the use of the accompanying drawings in which.

DETAILED DESCRIPTION

Figure 1:
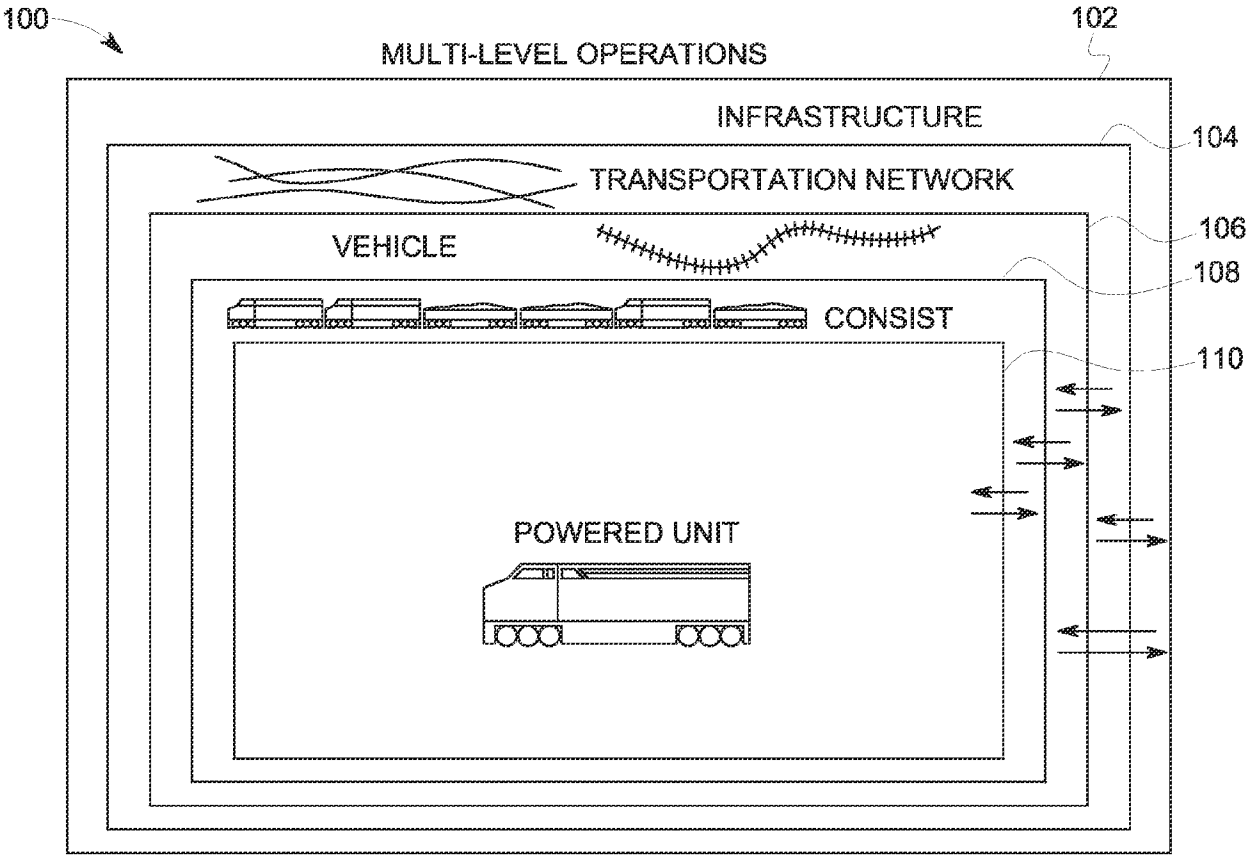
FIG. 1 is a graphical depiction of one example of a multi-level nature of transportation network operations (e.g., operations of a railway), with infrastructure, route (e.g., railway track) network, vehicle (e.g., rail vehicle or train), vehicle consist (e.g., locomotive consist), and individual vehicle (e.g., locomotive) levels being depicted in respective relationships to each other.

Reference will now be made in detail to the embodiments consistent with the invention, examples of which are illustrated in the accompanying drawings. Wherever possible, the same reference numerals used throughout the drawings refer to the same or like parts.

Though example embodiments of the presently described inventive subject matter are set forth with respect to rail vehicles, specifically trains and locomotives having diesel engines, one or more embodiments of the inventive subject matter may be applicable for other uses, such as but not limited to off-highway vehicles (OHV), automobiles, marine vessels, and/or stationary units, each which may use an engine, such as a diesel engine. Toward this end, when discussing a specified mission, this includes a task or requirement to be performed by a powered system. Therefore, with respect to railway, marine, or off-highway vehicle applications, this may refer to the movement of the system from a present location to a destination. In the case of stationary applications, such as but not limited to a stationary power generating station or network of power generating stations, a specified mission may refer to an amount of wattage (e.g., MW/hr) or other parameter or requirement to be satisfied by the powered system. Likewise, operating conditions of the power generating unit may include one or more of speed, load, fueling value, timing, and the like.

In one example involving marine vessels, a plurality of tugs may be operating together where all are moving the same larger vessel, where each tug is linked in time to accomplish the mission of moving the larger vessel. In another example, a single marine vessel may have a plurality of engines. Off-highway vehicles may include a fleet of vehicles that have a same mission to move earth or other material, from location A to location B, where each OHV is linked in time to accomplish the mission. With respect to a stationary power generating station, a plurality of stations may be grouped together collectively generating power for a specific location and/or purpose. In another embodiment, a single station is provided, but with a plurality of generators making up the single station.

One or more example embodiments of the inventive subject matter provide systems, methods, and computer implemented methods, such as computer software codes, for determining and implementing a driving and/or operating strategy. With respect to powered units capable of self-propulsion (such as locomotives), example embodiments of the inventive subject matter also may be operable when the powered unit consist is in distributed power operations.

An apparatus, such as a data processing system, including a CPU, memory, I/O, program storage, a connecting bus, and/or other appropriate components, can be programmed or otherwise designed to facilitate the practice of the one or more embodiments described herein. Such a system could include appropriate program structure for executing the method of the inventive subject matter.

Also, an article of manufacture, such as a pre-recorded disk or other similar computer program product, for use with a data processing system, could include a storage medium and program structure recorded thereon for directing the data processing system to facilitate the practice of the method of the inventive subject matter. Such apparatus and articles of manufacture also fall within the spirit and scope of the inventive subject matter described herein.

Referring to FIG. 1, the multi-level nature of a vehicle system 100, such as a railway system, is depicted. While the discussion herein focuses on railway systems, trains, locomotives, and locomotive consists, not all embodiments are so limited. One or more embodiments described herein may apply to other systems or vehicles, such as other off-highway vehicles, automobiles, marine vessels, and the like. As shown, the system 100 comprises from an upper level to a lower level:

an infrastructure level 102, a transportation network level 104, a vehicle level 106, a consist level 108 and a powered unit level 110. As described hereinafter, one or more of the levels may have its own unique operating characteristics, constraints, key operating parameters, and/or optimization logic. One or more of the levels can interact in a unique manner with other related levels, with different data being interchanged at interfaces between the levels so that the levels can cooperate to control the overall system 100. The method for operation of the system 100 may be the same whether considered from the powered unit level 110 up, or the infrastructure level 102 down. To facilitate understanding, the latter approach, a top down perspective, will be presented.

Infrastructure Level

Control of the system 100 at the infrastructure level 102 is depicted in FIGS. 1-4. As indicated in FIG. 1, the levels of the multi-level railway operations system 100 and method include from the top down, the railroad infrastructure level 102, the track network level 104, the train level 106, the consist level 108 and the locomotive level 110. The railroad infrastructure level 102 includes the lower levels of transportation network level 104, the vehicle level 106, the consist level 108, and the powered unit level 110. the infrastructure level 102 may include other internal features and functions that are not shown, such as servicing facilities, service sidings, fueling depots, wayside equipment, vehicle yards (e.g., rail yards), vehicle crew operations, destinations, loading equipment (often referred to as pickups), unloading equipment (often referred to as set-outs), and/or access to data that impacts the infrastructure, such as: operating rules, weather conditions, route conditions (e.g., rail conditions), business objective functions (including costs, such as penalties for delays and damages enroute, awards for timely delivery, and the like), natural disasters, and/or governmental regulatory requirements. These are features and functions that may be included at the infrastructure level 102. Much of the railroad infrastructure level 102 is of a permanent basis (or at least of a longer term basis). Infrastructure components such as the location of wayside equipment, fueling depots and service facilities are not subject to change during the course of any given train trip. However, real-time availability of these components may vary depending on availability, time of day, and use by other systems. These features of the railroad infrastructure level 102 act as opportunities or resources and constraints on the operation of the railway system 100 at the other levels. However, other aspects of the railroad infrastructure level 102 are operable to serve other levels of the railway system 100 such as track networks, trains, consists or locomotives, each of which may be optimized as a function of a multilevel optimization criteria such as total fuel, refueling, emissions output, resource management, etc.

Figure 2:
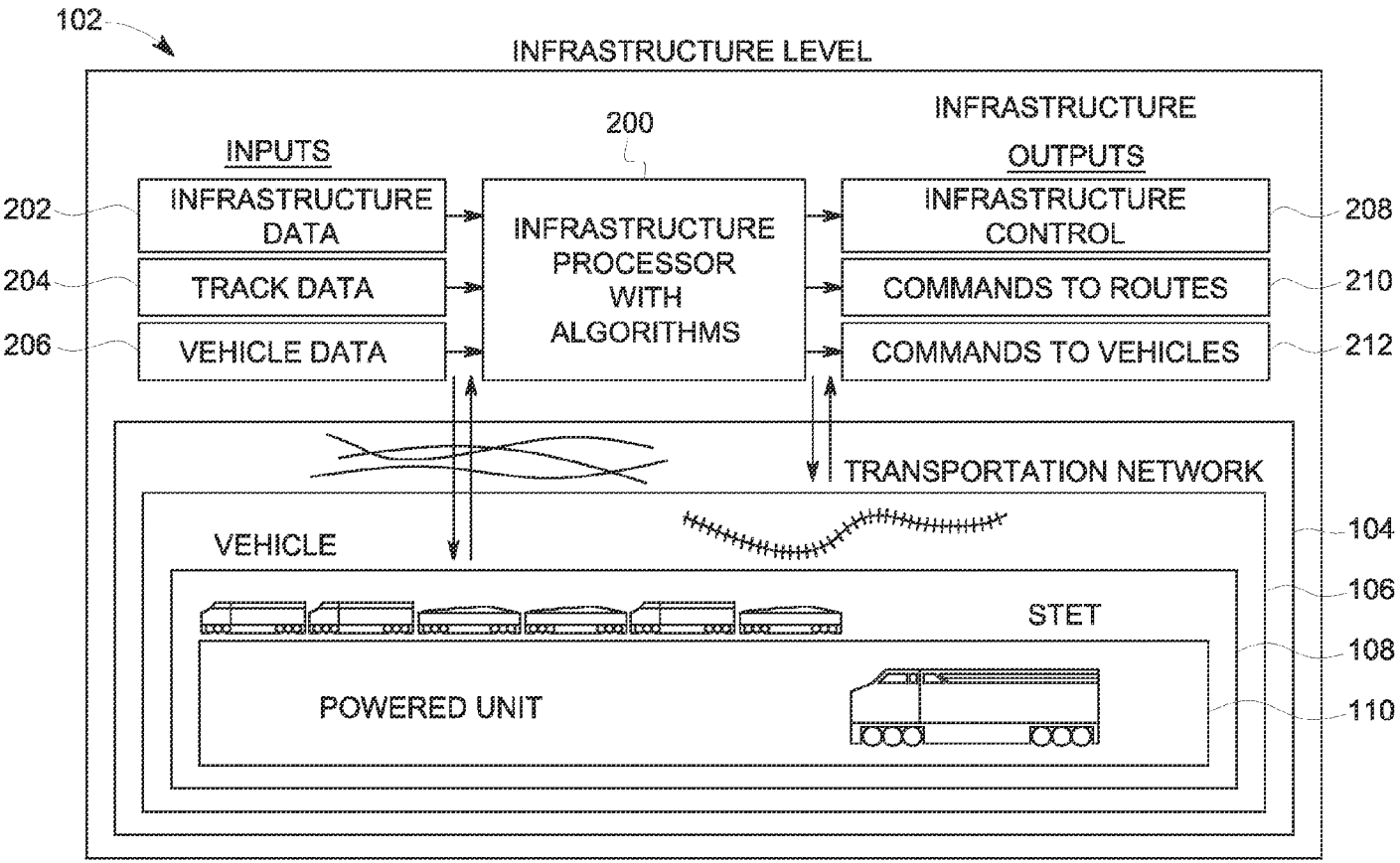
FIG. 2 is a graphical depiction of one embodiment of an infrastructure level illustrating inputs and outputs to an infrastructure processor.

FIG. 2 provides a schematic diagram of operation of the infrastructure level 102. FIG. 2 illustrates the infrastructure level 102 and an infrastructure level processor 200 interacting with the transportation network level 104 and the vehicle level 106 to receive input data from these levels, as well as from within the infrastructure level 102 itself, to generate commands to and/or provide data to the transportation network level 104 and the vehicle level 106, and to improve operation within the infrastructure level 102.

Figure 3:
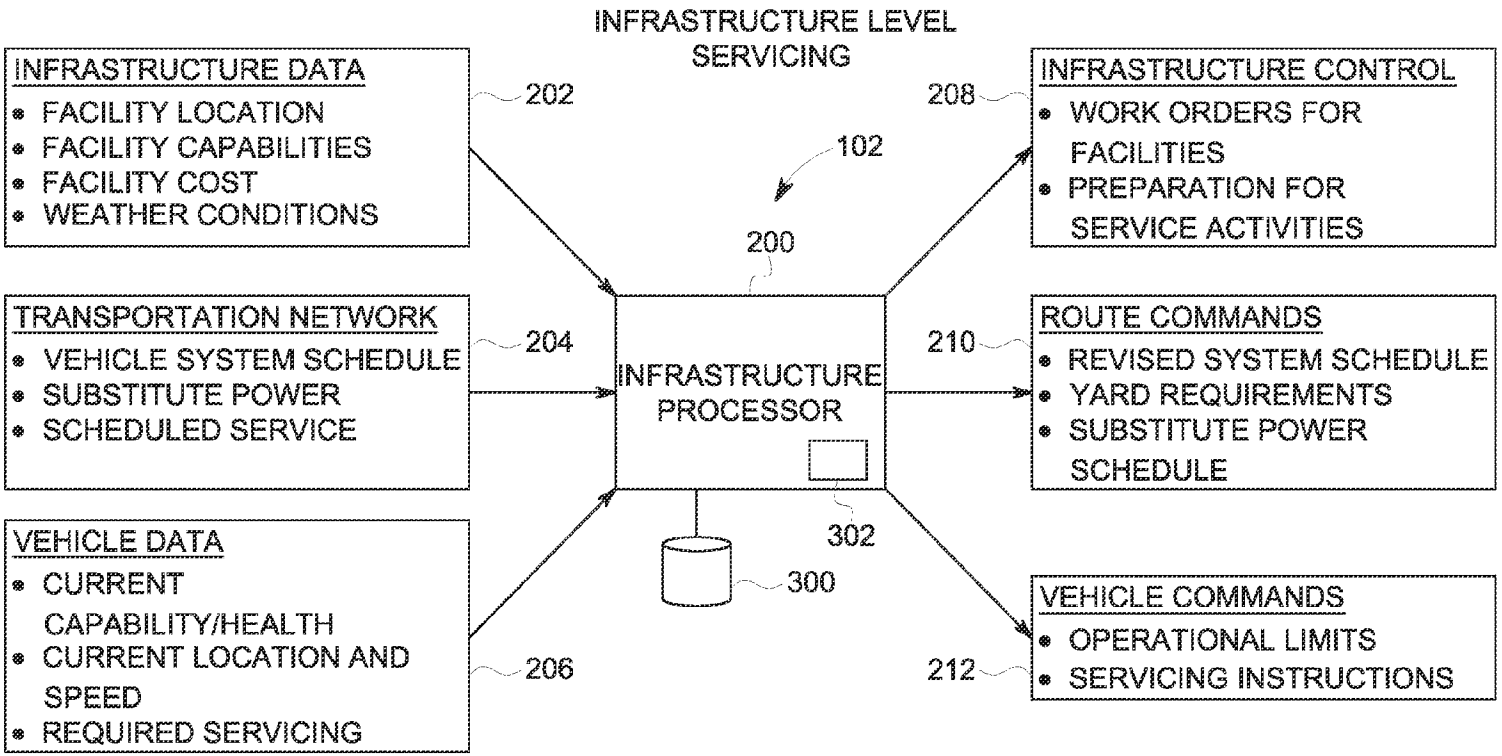
FIG. 3 is a schematic diagram illustrating details of servicing operations at the infrastructure level.

As illustrated in FIG. 3, the infrastructure processor 200 may be or include a computer, including a memory 300, computer instructions 302 (e.g., one or more sets of instructions such as computer software modules or applications) including one or more optimization algorithms, and the like. The infrastructure level 102 may for the servicing of vehicles (e.g., vehicle 2402 shown in FIG. 24, such as one or more trains) and powered units (e.g., powered unit 2400 shown in FIG. 24, such as one or more locomotives), such as at maintenance facilities and service sidings to optimize or improve these servicing operations, such as by improving the efficiency of providing the maintenance services, for example. The infrastructure level 102 can receive infrastructure data 202, such as facility location, facility capabilities (both static characteristics such as the number of service bays, and/or dynamic characteristics, such as the availability of bays, service crews, and spare parts inventory), facility costs (such as hourly rates, downtime requirements), and/or the earlier noted data such as weather conditions, natural disaster, and business objective functions. The infrastructure level 102 also may receive transportation network level data 204, such as the current vehicle system schedule for the planned arrival and departure of equipment (e.g., railroad equipment) at the service facility, the availability of substitute power (e.g., replacement locomotives) at the facility and/or scheduled service. Additionally, the infrastructure level 102 can receive vehicle level data 206, such as the current capability of vehicles on the systems, particularly those with health issues that may require additional condition-based (as opposed to scheduled-based) servicing, the current location, speed, and/or heading of the vehicles, and/or the anticipated servicing requirements when the vehicle arrives. The infrastructure processor 200 analyzes this input data and optimizes (e.g., improves) the railroad infrastructure level 102 operation by issuing work orders or other instructions to the service facilities for the particular vehicles to be serviced, as indicated in block 208, which can include instructions for preparing for the work to be done such as scheduling work bays, work crews, tools, and/or ordering spare parts. The infrastructure level 102 also may provide instructions that are used by the lower level systems. For example, track commands 210 are issued to provide data to revise the vehicle movement plan in view of a service plan, advise the vehicle yard of the service plan such as reconfiguring the vehicle, and/or provide substitute power of a replacement powered unit of a vehicle. Vehicle commands 212 are issued to the train level 106 so that particular trains that are to be serviced may have restricted operation or to provide on-site servicing instructions that are a function of the service plan.

Figure 4:
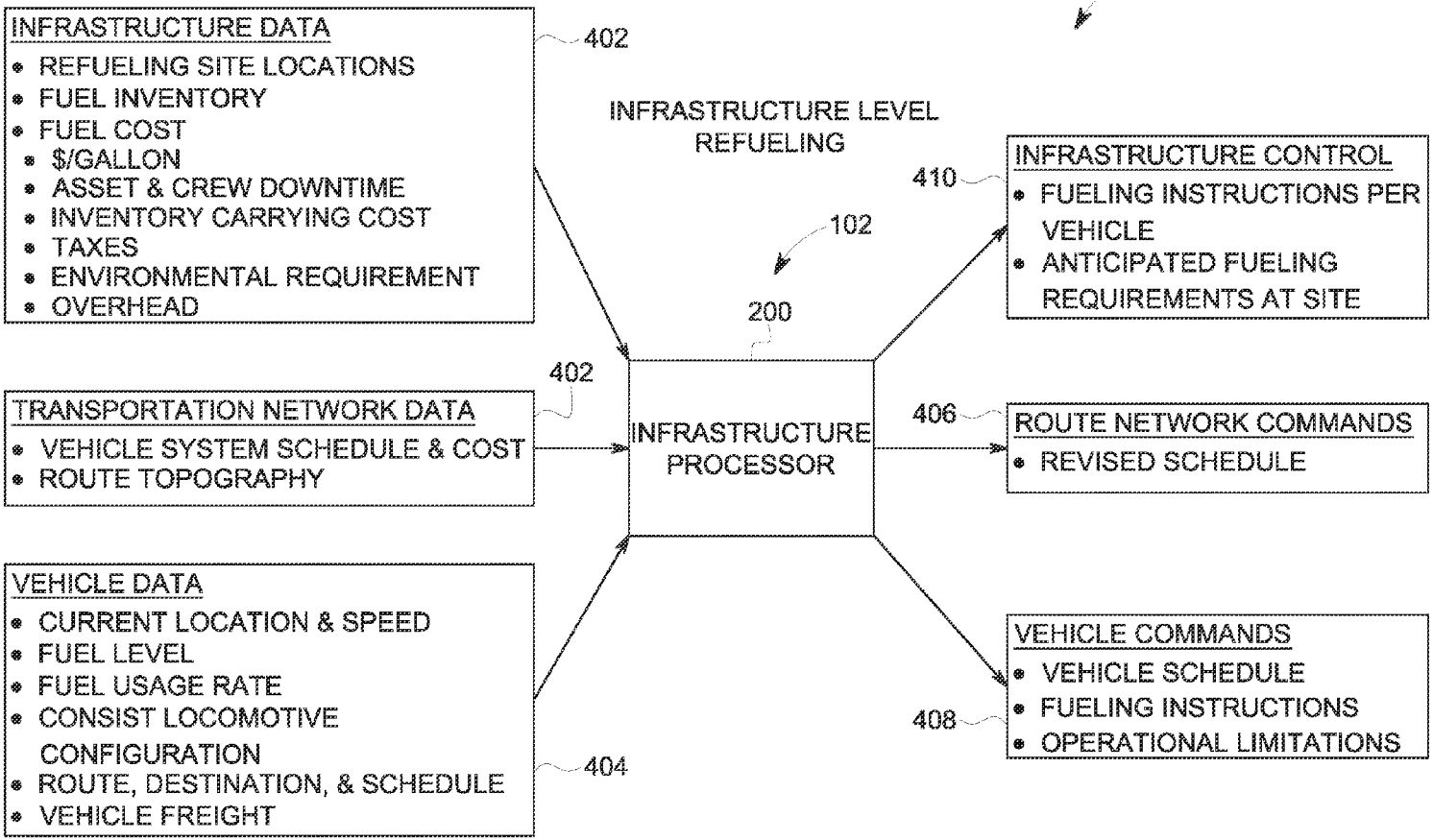
FIG. 4 is a schematic diagram illustrating details of refueling operations at the infrastructure level.

As one example of the operations of the infrastructure level 102, FIG. 4 shows an infrastructure level refueling operation 400. This is one example of optimized servicing at the infrastructure level 102. The infrastructure data 402 that is input to the infrastructure level 108 for improving refueling operations are related to fueling parameters. These may include refueling site locations (which include the large service facilities as well as fuel depots, and/or sidings at which fuel trucks can be dispatched) and/or total fuel costs, which may include not only the direct price per gallon of the fuel, but may also include asset and crew downtime, inventory carrying costs, taxes, overhead, and/or environmental requirements. Transportation network level input data 402 may include the cost of changing the vehicle schedule on the overall movement plan to accommodate refueling or reduced speeds if fueling is not done, as well as the topography of the route (e.g., track) ahead of the vehicles since the topography can have a significant impact on fuel usage. Vehicle level input data 404 can include current location and speed, fuel level and fuel usage rate data (which can be used to determine locomotive range of travel), and/or consist configurations so that alternative powered unit power generation modes can be considered. Vehicle schedules as well as vehicle weight, freight, and/or length may be relevant to the anticipated fuel usage rate. Outputs from the refueling infrastructure level 108 can include infrastructure control data 410. The control data 410 can be determined for optimization (e.g., improvement) of the fueling site both in terms of the fueling instructions for each particular vehicle, but also as anticipated over some period of time for fuel inventory purposes. Other outputs may include command data 406 to the transportation network level 104 to revise the movement plan, and vehicle level commands 408 for fueling instructions at the facility site, including schedules, as well as operational limitations on the vehicle such as the maximum or designated rate of fuel usage while the vehicle is on route to the fuel location.

Optimization of the infrastructure operation may not a static process, but rather can be a dynamic process that is subject to revision at regular scheduled intervals (such as every 30 minutes or at other time periods or frequencies), and/or as significant events occur and are reported to the infrastructure level 102 (such as vehicle brake downs and/or service facility problems). Communication within the infrastructure level 102 and with the other levels may be done on a real-time or near real-time basis to enable the flow of key information in order to keep the service plans current and distributed to the other levels. Additionally, information may be stored for later analysis of trends or the identification or analysis of particular level characteristics, performance, interactions with other levels or the identification of particular equipment problems.

Transportation Network Level

Figure 5:
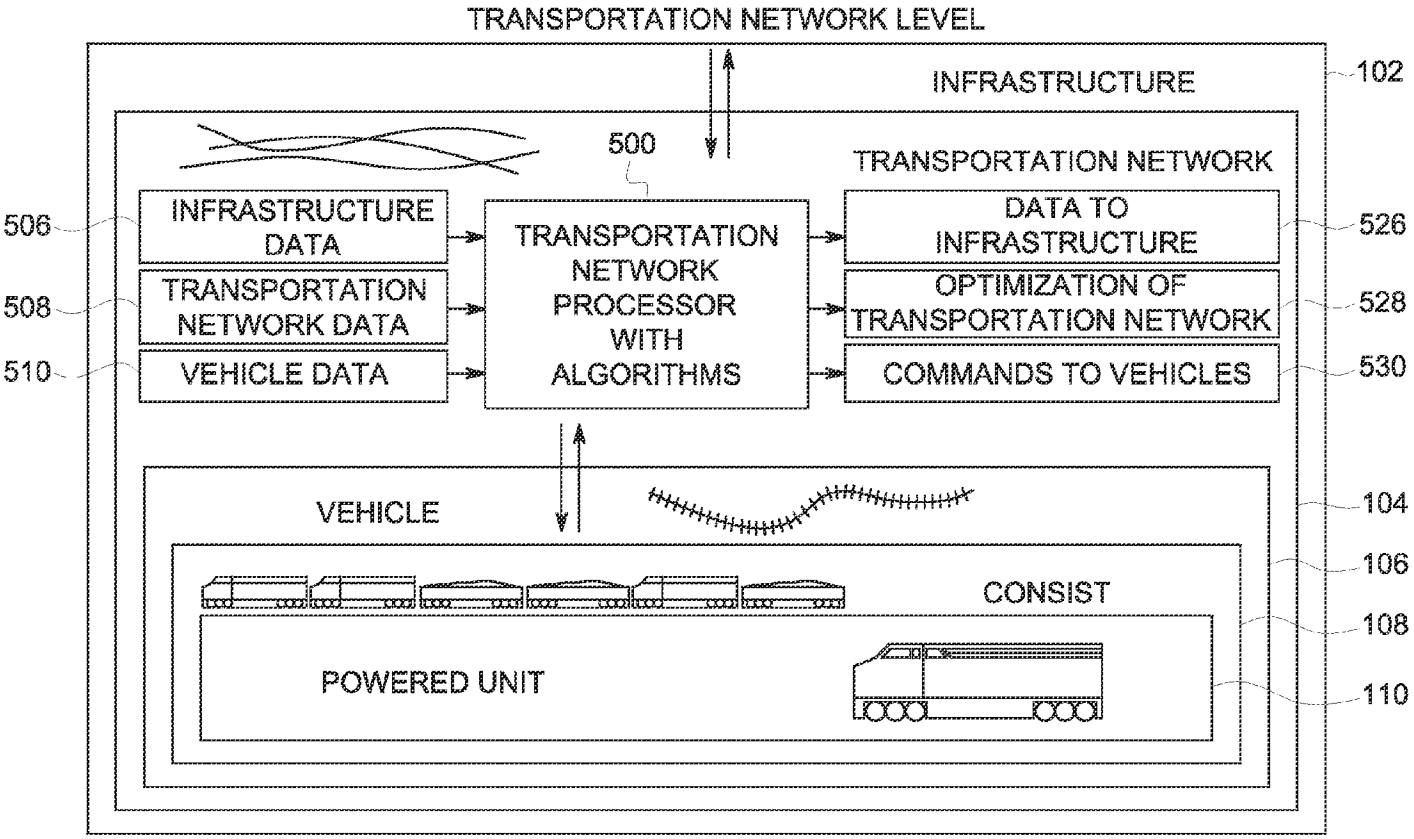
FIG. 5 is a schematic diagram of a transportation network level (e.g., a railroad track network level) illustrating relationships with the infrastructure level and a vehicle level (e.g., a rail vehicle level)
Figure 6:
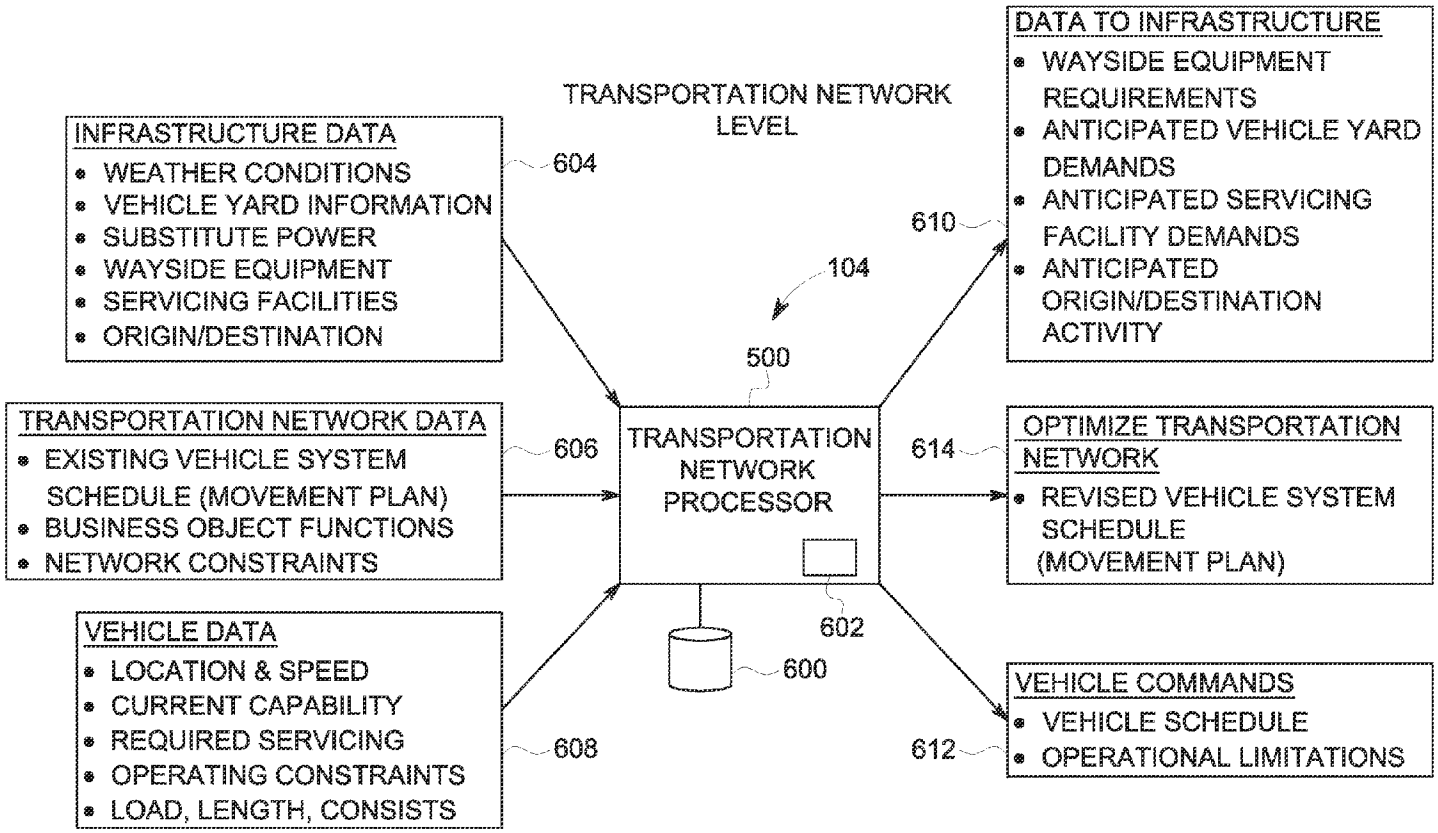
FIG. 6 is a schematic diagram illustrating the transportation network level, with inputs to and outputs from a processor at the transportation network level.

Within the operational plans of the infrastructure, optimization of the transportation network level 104 may be performed as depicted in FIGS. 5 and 6. The transportation network level 104 includes not only the route layout, but also may include plans for movement of the various vehicles over the route layout. FIG. 5 shows the interaction of the transportation network level 104 with the infrastructure level 102 above the transportation network level 104 and the individual vehicle level 106 below the transportation network level 104. As illustrated, the transportation network level 104 receives input data from the infrastructure level 102 and the vehicle level 106, as well as data (or feedback) from within the transportation network level 104. As illustrated in FIG. 6, a transportation network processor 500 may be or include a computer, including a memory 600, computer instructions 602 (e.g., one or more sets of instructions such as computer software modules or applications) including optimization algorithms, and the like. As shown in FIG. 6, infrastructure level data 604 may include information regarding the condition of the weather, vehicle yard, substitute power, servicing facilities and plans, origins, destinations, and the like. Transportation network data 606 includes information regarding the existing vehicle movement schedules, business object functions, and/or network constraints (such as limitations on the operation of certain sections of the routes). Vehicle level input data 608 can include information regarding the location and/or speed of power generating units (e.g., locomotives), current capability (health), required servicing, operating limitations, consist configurations, vehicle load, and/or length.

FIG. 6 also shows the output of the transportation network level 104 that includes output data 610 that is sent to the infrastructure level 102, vehicle commands 612 to the vehicles and optimization instructions 614 to the transportation network level 104 itself. The output data 610 that is sent to the infrastructure level 102 can include wayside equipment requirements, vehicle yard demands, servicing facility needs, and/or anticipated origin and destination activities. The vehicle commands 612 can include the schedule for one or more of the vehicles and/or operational limitations sent when the vehicles are on route. The optimization instructions 614 may include revisions to the vehicle system schedule.

As with the infrastructure level 102, schedule or movement plan of the transportation network level 104 can be revised at periodic intervals and/or as material events occur. Communication of critical data and commands may be done on a real-time basis to keep the respective plans current.

An example of an existing movement planner or planner system that establishes schedules or movement plans for the vehicles is disclosed in U.S. Pat. No. 5,794,172. Such a movement planner or system includes a computer aided dispatch (CAD) system having a power dispatching system movement planner for establishing a detailed movement plan for each power generating unit and communicating the movement plan to the power generating unit. The movement planner or system plans the movement of vehicles over routes of a transportation network with a defined planning time horizon or window, such as 8 hours. The movement planner attempts to optimize (e.g., improve) a transportation network level Business Objective Function (BOF) that is the sum of the BOF's for individual vehicles in the vehicle levels of the transportation network level. The BOF for each vehicle may be related to the termination point for the vehicle. It may also be tied to any point in the individual trip of the vehicle. Each vehicle may have a single BOF for each planning cycle in a planning territory. Additionally, each transportation network system may have a discrete number of planning territories. For example, a transportation network system may have seven (7) planning territories. As such, a vehicle that will traverse N territories may have N BOF's at one or more instances in time. The BOF can provide a basis for comparing the quality of two movement plans.

In the course of computing a movement plan for each vehicle periodically (e.g., each hour), the movement planner can compare many (e.g., thousands) of alternative movement plans. The transportation network level may be highly constrained by the physical layout of routes in the transportation network, route or vehicle operating restrictions, capabilities of the vehicles, and/or conflicting requirements for the resources (e.g., the vehicles). The time required to compute a movement plan in order to support the dynamic nature of operations can be a major constraint. For this reason, vehicle performance data can be assumed, based on pre-computed and stored data based upon consists, route conditions, and/or vehicle schedules. The procedure used by the movement planner computes a minimum or predicted run time for a schedule of a vehicle by simulating unopposed movement of the vehicle over the route, with stops and/or dwells for work activities. This process can capture the run time across each route segment and alternate route segments in the path of the vehicle. A planning cushion, such as a percentage of run time, can be added to the predicted run time of the vehicle and the cushioned time can be used to generate the movement plan.

Figure 20:
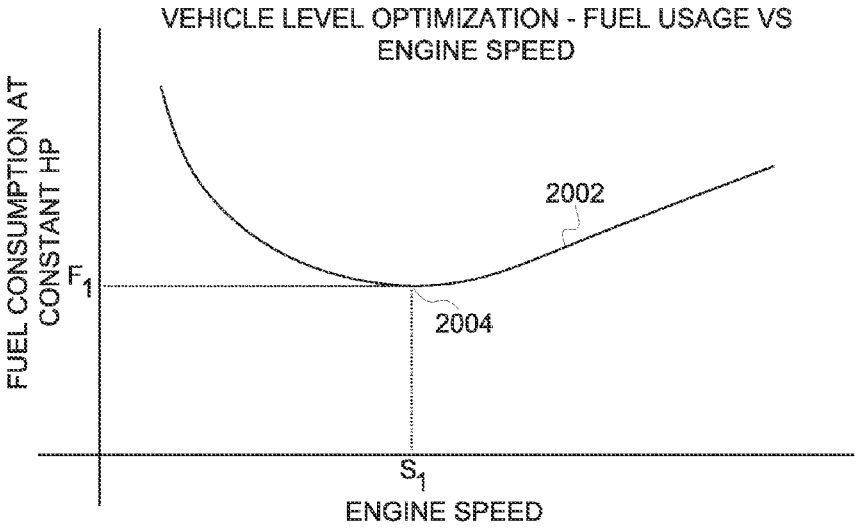
FIG. 20 is a graphic diagram illustrating fuel consumption as a function of engine speed at the power generating unit level.

One such result provided by a movement planner is illustrated in FIG. 20, where the vehicle (and thus the vehicle level, consist level, and/or the powered unit level) is at a selected speed $S_1$ along a speed/fuel consumption curve 2002. The consumption curve 2002 is shown alongside a horizontal axis representative of an engine speed of a vehicle and a vertical axis representative of fuel consumed by the vehicle. A fuel consumption amount $F_1$ represents the fuel consumed when the vehicle operates at the engine speed $S_1$. The vehicle reduces the amount of fuel consumed when traveling according to settings at or near a bottom or sag 2004 of the curve 2002. Some vehicle speeds may exceed the speed $S_1$ such that more fuel is consumed than the amount of fuel $F_1$. As a result, the movement planner may direct vehicles to travel at slower speeds such that reducing average engine speeds results in reduced fuel consumption.

Figure 7:
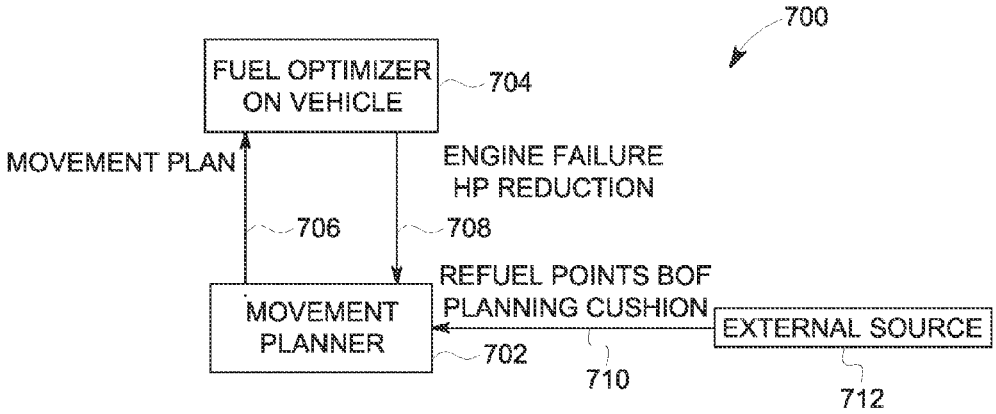
FIG. 7 is a schematic diagram illustrating inputs to and outputs from a movement planner at the vehicle level.
Figure 8:
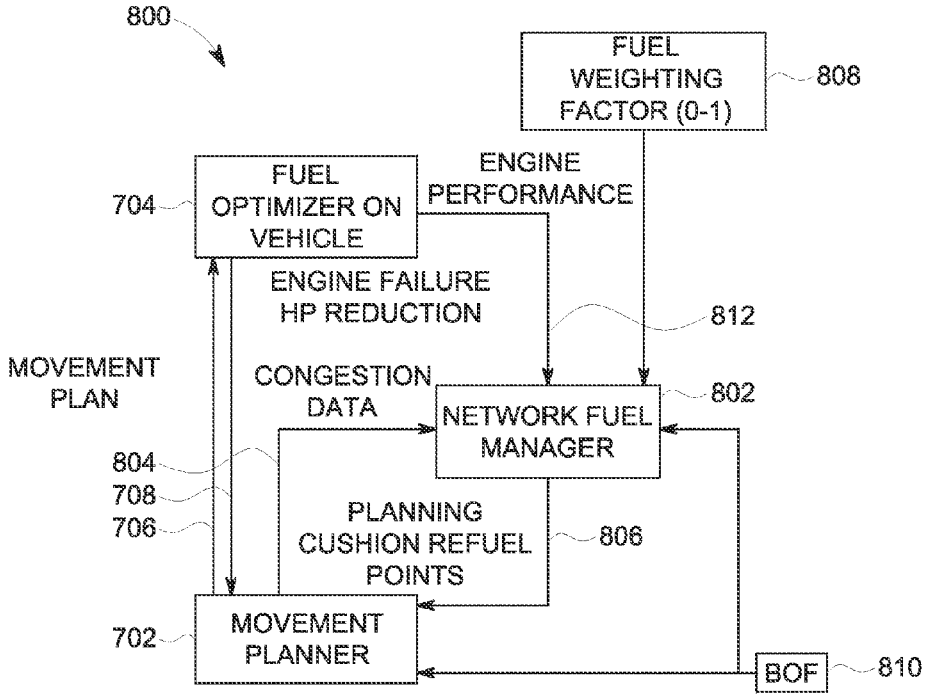
FIG. 8 is a schematic diagram of a revised transportation network processor (e.g., a revised railroad network processor) having a network fuel manager processor for determination of fuel usage parameters.

FIGS. 7 and 8 illustrate details of an embodiment of the presently described subject matter and one or more benefits to movement planning of the transportation network level 104. FIG. 7 illustrates an example of a movement planner 700 that analyzes operating parameters to improve the movement plan for vehicles in order to reduce or optimize fuel usage by the vehicles. The movement planner 702 receives input from the vehicle level 106. The embodiment of the movement planner 702 shown in FIG. 7 receives and analyzes messages from external sources 712 with respect to refueling points and Business Objective Functions (BOF) 710, which may include a planning cushion, as described above. A communication link 706 to fuel optimizers 704 (e.g., processors and the like) on vehicles in the vehicle level 106 is provided in order to transmit the latest movement plan to each of the vehicles on the vehicle level 106. In one embodiment, the movement planner may attempt to reduce or minimize delays for meet events (e.g., a first vehicle pulling off of a main line route onto a connected siding section of the route to allow a second vehicle to pass on the main line route when the first and second vehicles are traveling in opposite directions) and/or pass events (e.g., a first vehicle pulling off of a main line route onto a connected siding section of the route to allow a second vehicle to pass on the main line route when the first and second vehicles are traveling in the same direction). In another embodiment, the system can use delays associated with such meet or pass events as an opportunity for fuel optimization (e.g., reducing fuel consumed by the vehicles) at the various levels.

FIG. 8 illustrates another embodiment of a movement planner for analyzing additional operating parameters beyond those illustrated in FIG. 7 for improving fuel usage by a vehicle. A network fuel manager 802 provides the transportation network level 104 with functionality to improve fuel usage (e.g., increase fuel efficiency or decrease fuel consumption) within the transportation network level 104 based on the Business Objective Function (BOF) 810 of each of the vehicles at the vehicle level 106, an engine performance parameter 812 of the vehicles and powered units in the vehicles, congestion data 804, and/or fuel weighting factors 808. The movement planner at the transportation network level 106 receives input data 708 from the vehicle level optimizer 704 and from the network fuel manager 802. For example, the vehicle level 104 provides the movement planner 702 with engine failure and/or horsepower reduction data 708 of the vehicle. The engine failure and/or horsepower reduction data 708 may include information representative of decreased tractive and/or horsepower output from an engine of the vehicle. The movement planner 702 provides a movement plan 706 to the vehicle level 104 and/or congestion data 804 to the network fuel manager 802. The movement plan 706 can include schedules for one or more of the vehicles. The congestion data 804 can include information representative of a number and/or density of the vehicles concurrently traveling in a transportation network formed from interconnected routes, and/or information representative of areas of decreased movement of the vehicles. The vehicle level 104 provides engine performance data 812 to the network fuel manager 802. The engine performance data 812 can include information representative of engine speed, tractive output, horsepower output, and/or other information associated with operation of the engine. The movement planner 702 at the transportation network level 104 utilizes the Business Objective Function (BOF) for each vehicle, the planning cushion, and/or refueling points 806 (e.g., locations where vehicles can obtain additional fuel) and the engine failure and/or horsepower reduction data 708, to develop and/or modify the movement plan for a particular vehicle at the vehicle level 104.

As mentioned above, the embodiment of the movement planner 702 shown in FIG. 8 incorporates a network fuel manager module 802 or fuel optimizer that monitors the performance data for individual vehicles and provides inputs to the movement planner 702 to incorporate fuel optimization information into the movement plan. The fuel optimization information can include information indicative of speeds and/or other measures of tractive output from the vehicles and associated fuel efficiencies and/or fuel consumption estimates. The network fuel manager module 802 determines refueling locations for the vehicles based on this estimated fuel usage and/or fuel efficiencies, and/or fuel costs. A fuel cost weighting factor can represent a parametric balancing of fuel costs (both direct and indirect) against schedule compliance by a vehicle. This balance may be considered in conjunction with the congestion anticipated in the path of the vehicle. Slowing a vehicle for vehicle level fuel optimization can increase congestion at the transportation network level by delaying other vehicles, especially in relatively highly trafficked areas. The network fuel manager module 802 interfaces with the movement planner 702 in the transportation network level 104 to set the planning cushion (e.g., the amount of slack time in the movement plan before appreciably affecting other vehicle movements) for each vehicle and modifies the movement plan 706 to allow individual vehicle planning cushions to be set, with longer planning cushions and shorter meets and passes than typical to provide for improved fuel efficiencies.

In one embodiment, a higher or larger planning cushion may be established for vehicles that are equipped with the fuel optimizer 704 and/or the vehicles having schedules that are designated as not being critical relative to one or more other vehicles. Larger planning cushions can provide savings to local vehicles and/or vehicles running on relatively lightly trafficked routes. An interface with the movement planner 702 can be used to set the planning cushion for the vehicle and/or a modification to the movement plan 706 to allow the planning cushion to be set for individual vehicles.

Figure 9:
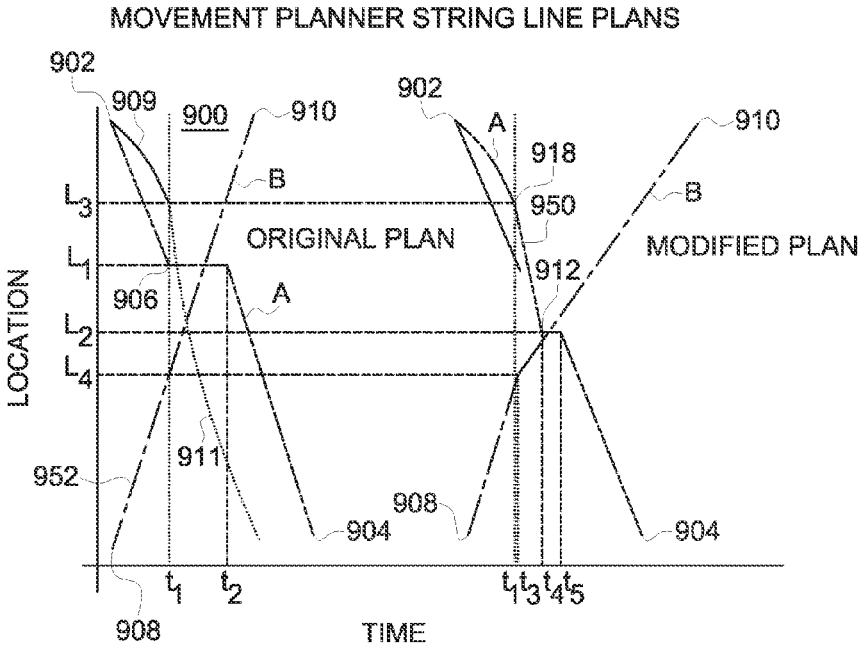
FIG. 9 illustrates string-line diagrams that include a diagram representing an initial movement plan created without consideration of reducing fuel consumption and the second diagram representing a modified movement plan created to reduce fuel consumption.

FIG. 9 illustrates a representative set of string line graphs for the planned movement (e.g., movement plan 706) of two vehicles (e.g., trains A and B) moving in opposite directions on a single route. The vehicles concurrently move in opposite directions along the route such that the vehicles participate in a meet event at a siding 906. The string line shows the vehicle location as a function of travel time for the vehicles, with line A illustrating the travel of a vehicle A as the vehicle moves from an initial location 902 to a destination location 904, and the travel of a vehicle B from an initial location 908 to a destination location 910. The "original plan" 900 as shown in the first string line of FIG. 9 is generated for the purpose of reducing or minimizing the time required to effect the vehicle movements. This string line shows that vehicle A enters the siding 906 (represented by the horizontal line segment 906) at time $t_1$, so as to let vehicle B pass the vehicle A. Vehicle A is stopped and idle (or slows down) at siding 906 from $t_1$ to $t_2$. Vehicle B, as shown by line 952, maintains a constant speed from location 908 to location 910. An upper curved line 909 and curved dotted line extension 911 represent the fastest move that vehicle A is capable of performing. The "modified plan" 950 as shown in the string line on the right of FIG. 9 was generated with consideration for fuel optimization (e.g., increasing, but not necessarily maximizing, fuel efficiency). The modified plan 950 includes the vehicle A traveling faster (e.g., as represented by the steeper slope of line 918-912 from $t_1$ to $t_4$) so as to reach a second and more distant siding 912, albeit at a somewhat later time $t_4$ (e.g., $t_4$ is later than $t_1$). The modified plan may include vehicle B traveling at a slower rate at time $t_3$ so as to pass at the second siding 912. The modified plan reduces the idle time of train A to $t_5-t_4$ from the previous $t_2-t_1$ and reduces the speed of train B beginning at $t_3$ to create the opportunity for fuel optimization at the train level 106 as reflected by the combination of the two particular trains, while maintaining the track network level movement plan at or near its earlier level of performance.

Inputs to the track network level movement planner 702 also may include locations of fuel depots, cost of fuel (cost/gallon per depot and/or cost of time to fuel or so-called "cost penalty"), engine efficiency as represented by the slope of the change in the fuel use over the change in the horsepower (e.g., slope of Δfuel use/ΔHP), fuel efficiency as represented by the slope of the change in the fuel use over the change in speed or time, derating of power for locomotives with low or no fuel, track adhesion factors (snow, rain, sanders, cleaners, lubricants), fuel level for locomotives in trains, projected range for fuel of the train, and the like.

The railroad track network level functionality established by the movement planner 702 includes determination of required or designated consist power as a function of speed under current or projected operating conditions, and determination of fuel consumption as a function of power, locomotive type, and/or network track. The movement planner 702 determinations may be made for vehicles, rail vehicles (e.g., locomotives), for one or more consists, and/or the train which would include the assigned load. The determination may be a function of the sensitivity of the change of fuel over the change of power (ΔFuel/ΔHP) and/or change in horsepower over speed (ΔHP/ΔSpeed). The movement planner 702 further may determine a dynamic compensation to fuel-rate (as provided above) to account for thermal transients (tunnels, etc.), and/or adhesion limitations, such as low speed tractive effort or grade, that may impair movement predictions (e.g., the expected speed). The movement planner 702 may predict the current out-of-fuel range based on an operating assumption, such as that the power continues at the current level or an assumption regarding the future track. Finally, the detection of parameters that have significantly changed may be communicated to the movement planner 702 and, as a result, an action such as a change in the movement plan may be required. These actions may be automatic functions that are communicated continuously or periodically, or done on exception basis such as for detection of transients or predicted out-of-fuel conditions.

The benefits of this operation of the track network level 104 can include allowing the movement planner 702 to consider fuel use in generating or modifying the movement plan without regard to or independent of details at the consist level, to predict fuel-rate as a function of power and speed, and/or by integration, to determine the expected total fuel required for the movement plan, or the amount of fuel that is calculated to be consumed for movement according to the movement plan. The movement planner 702 may predict a rate of schedule deterioration and make corrective adjustments to the movement plan if needed. This may include delaying the dispatch of trains from a yard or rerouting trains in order to relieve congestion on the main line. The track network level 104 also will enable the factoring of the dynamic consist fuel state into refueling determination at the earliest opportunity, including the consideration of power loss, such as when one locomotive within a consist shuts down or is forced to operate at reduced power. The track network level 104 will also enable the determination (at the powered unit level or consist level) of updates to the movement plan. This added data can reduce the monitoring and signal processing required in the movement plan or computer aided dispatch processes.

The movement plan output from the track network level 104 can specify a variety of information, such as where and when to stop for fuel, amount of fuel to take on, lower and upper speed limits for train, time/speed at destination, time allotted for fueling, and the like.

Train Level

Figure 10:
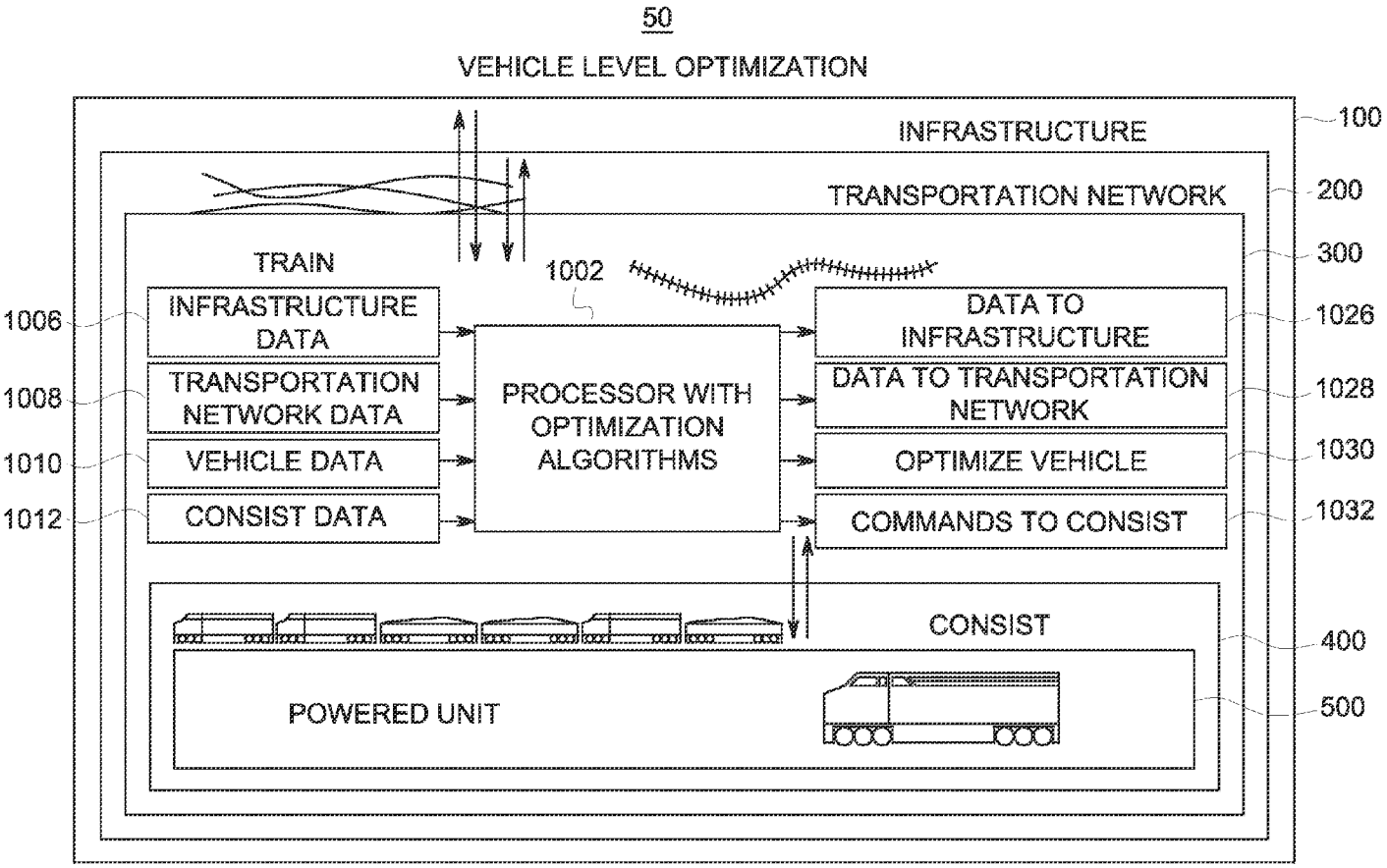
FIG. 10 is a schematic diagram of the vehicle level (e.g., rail vehicle or train level) illustrating relationship with other related levels.
Figure 11:
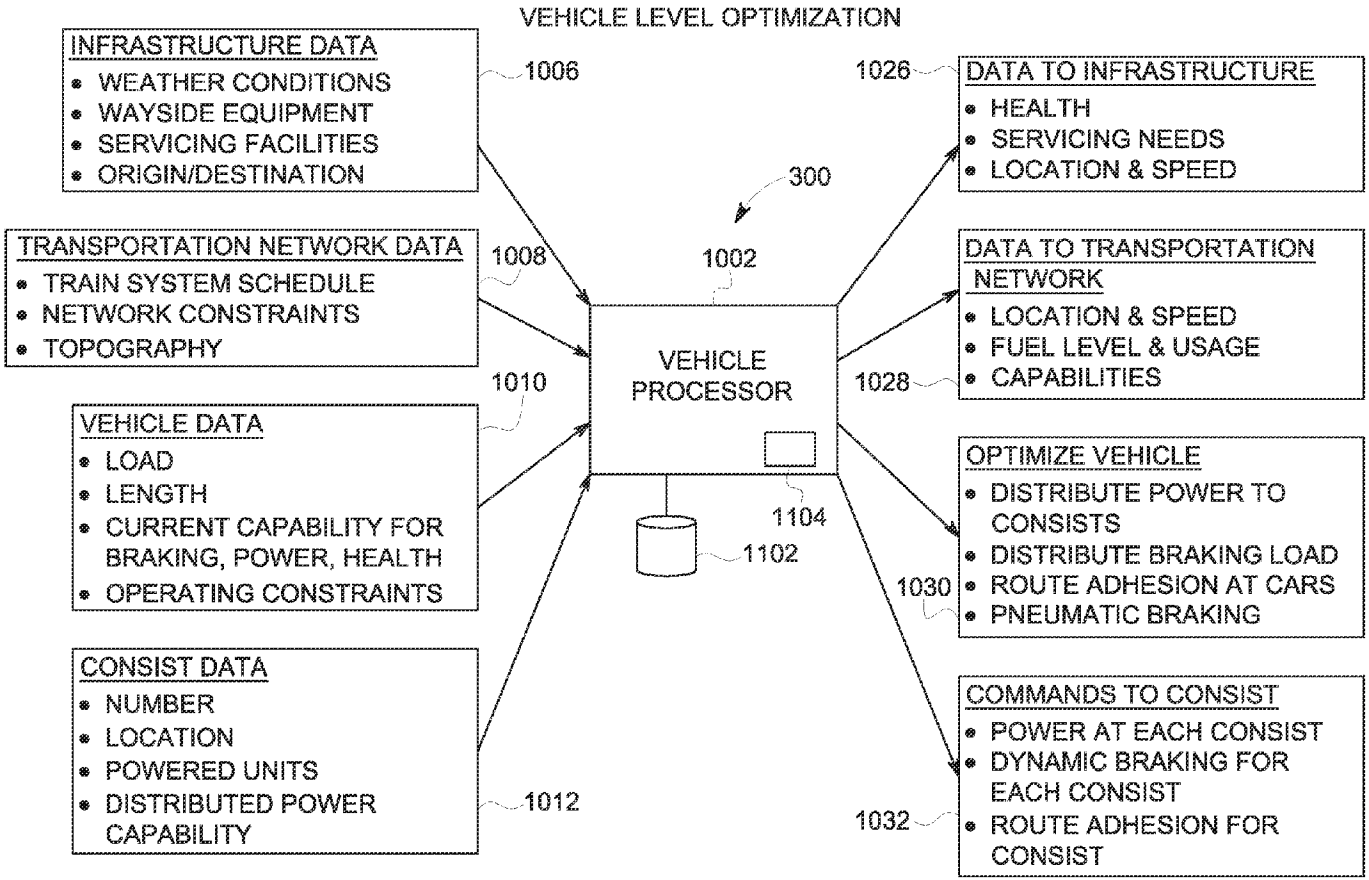
FIG. 11 is a schematic diagram illustrating details of inputs and outputs of a vehicle level processor.

FIGS. 10 and 11 depict the vehicle level operation and relationships between the vehicle level 106 and the other levels. A vehicle processor 1002 may include a memory 1102 and computer instructions 1104 including an optimization algorithm, and the like. While the vehicle level 106 may comprise a long vehicle with distributed consists (e.g., a train), with one or more of the consists having several powered units (e.g., locomotives) and with numerous cars (e.g., non-powered vehicles or vehicles that are not capable of self-propulsion) between the consists, the vehicle level 106 may be of any configuration including more complex or significantly simpler configurations. For example, the vehicle may be formed by a single powered unit consist or a single consist with multiple powered units at the head of the vehicle, both of which configurations can simplify the levels, interactions, and amount of data communicated from the vehicle level 106 to the consist level 108 and on to the powered unit level 110. In one embodiment, a single powered unit without any additional non-powered unit may constitute a vehicle. In this case, the vehicle level 106, consist level 108, and powered unit level 110 are the same. In one embodiment, the vehicle level processor 1002, the consist level processor 1202, and/or a powered unit level processor 1502 may be comprised of one, two or three processors.

Assuming for discussion purposes a more complex vehicle configuration, then the input data at the vehicle level 106, as shown in FIGS. 10 and 11, includes infrastructure data 1006, transportation network data 1008, vehicle data 1010, including feedback from the vehicle, and/or consist level data 1012. The output of the vehicle level 106 includes data sent to the infrastructure level 1026 and to the transportation network level 1028, optimization within the vehicle level 1030, and/or commands to the consist level 1032. The infrastructure level data 1006 includes weather conditions, wayside equipment, servicing facilities, and/or origin/destination information. The transportation network level data input 1008 may include vehicle system schedules, network constraints, and/or route topography (e.g., track topography). The vehicle data 1010 includes load, length, current capacity for braking and power, vehicle health, and/or vehicle operating constraints. Consist data input 1012 includes the number and/or locations of the consists within the vehicle, the number of powered units in the consist, and/or the capability for distributed power control within the consist. Inputs to the vehicle level 106 from sources other than the powered unit consist level 108 can include the following: head end and end-of-train (EOT) locations, anticipate up-coming route topography and wayside equipment, movement plan, weather (wind, wet, snow), and/or adhesion (friction) management.

The inputs to the vehicle level 106 from the consist level 108 may include the aggregation of information obtained from the powered units and potentially from the load cars (e.g., the non-powered units that are not capable of self-propulsion). These include current operating conditions, current equipment status, equipment capability, fuel status, consumable status, consist health, optimization information for the current plan, and/or optimization information for the plan optimization.

The current operating conditions of the consist may include the present total tractive effort (TE), dynamic braking effort, air brake effort, total power, speed, and/or fuel consumption rate. These may obtained by consolidating information from the consists at the consist level 108, which include the powered units at the powered unit level 110 within the consist, and/or other equipment in the consist. The current equipment status includes the ratings of powered units, the position of the powered units, and/or loads within the consist. The ratings of units may be obtained from each consist level 108 and/or the powered unit level 110 including deviations due to adhesion/ambient conditions. This may be obtained from the consist level 108 or directly from the powered unit level 110. The position of the powered unit may be determined in part by trainline information, global positioning system (GPS) position sensing, and/or air brake pressure sensing time delay. The load may be determined by the tractive effort (TE), braking effort (BE), speed, track profile, and the like.

Equipment capability may include the ratings of the powered units in the consist including the maximum tractive effort ($TE_{max}$) or an upper designated tractive effort capability, maximum braking effort ($BE_{max}$) or an upper designated braking effort capability, horsepower (HP), dynamic brake HP, and/or adhesion capability. The fuel status, such as the current and projected amount of fuel in each powered unit, is calculated by each powered unit based on the current fuel level and projected fuel consumption for the operating plan. The consist level 108 aggregates this per-powered unit information and sends a total range and possibly fuel levels/status at designated fueling points or locations. It may also send the information where the item may become critical. For example, one powered unit within a consist may run out of fuel and yet the powered unit may run to the next fueling station, if there is enough power available on the consist to get to that point. Similarly, the status of other consumables other than fuel like sand, friction modifiers, and the like, are reported and aggregated at the consist level 108. These are also calculated based on current level and projected consumption based on weather, track conditions, the load and current plan. The vehicle level aggregates this information and sends the total range and possibly consumable levels/status at known servicing points. It may also send the information where the item may become critical. For example, if adhesion limited operation requiring sand is not expected during the operation, it may not be critical that sanding equipment be serviced.

Figure 14:
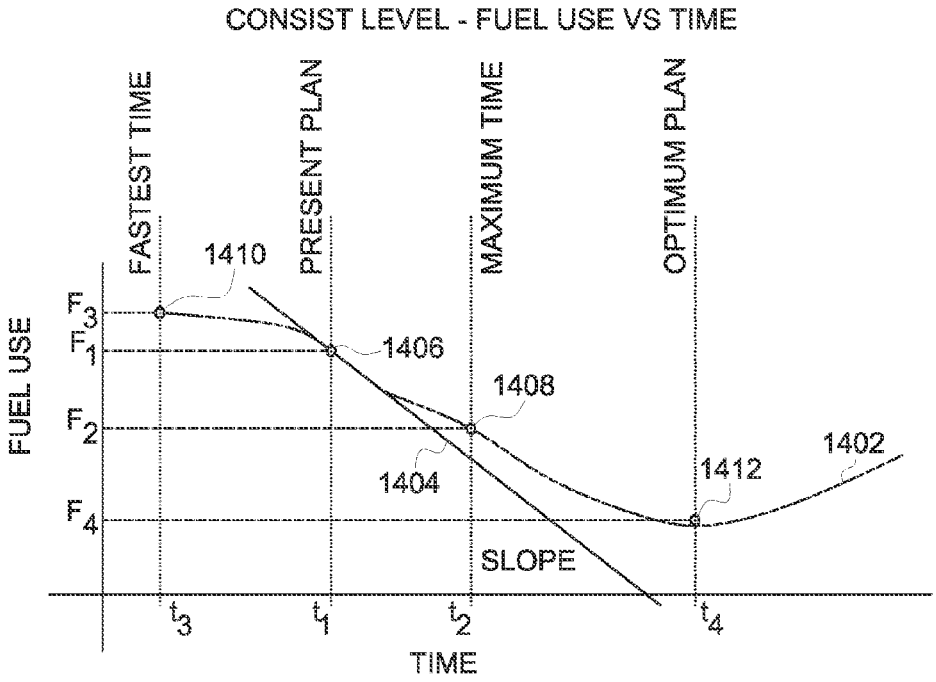
FIG. 14 is a graphic diagram illustrating fuel usage as a function of planned time for various modes of operation at the consist level.

The health of the consist may be reported and may include failure information, degraded performance, and/or maintenance requirements. The optimization information for the current plan may be reported. For example, this may include fuel optimization at the consist level 108 or locomotive level 110. For fuel optimization, as shown in FIG. 14, data and information for consist level fuel optimization is represented by the slope and shape of the line between operating points 1408 and 1410. Furthermore, optimization information for the plan optimization may include the data and information as depicted between operating points 1408 and 1412, as shown in FIG. 14, for the consist level 108.

Also as shown in FIG. 11, the output data 1026 sent by the vehicle level 106 to the infrastructure level 102 includes information regarding the location, heading, and/or speed of the vehicle, the health of the vehicle, operational derating of the vehicle performance in light of the health conditions, and/or servicing needs, both short-term needs, such as related to consumables, and long-term needs, such as system or equipment repair requirements. The data 1028 sent from the vehicle level 106 to the infrastructure network level 104 includes vehicle location, heading, and/or speed; fuel levels; range and/or usage; and train capabilities, such as power, dynamic braking, and/or friction management. Optimizing performance within the vehicle level 106 includes distributing power to the consists within the vehicle level, distributing dynamic braking loads to the consists levels within the vehicle level and pneumatic braking to the cars within the vehicle level, and/or wheel adhesion of the consists and cars. The output commands to the consist level 108 includes engine speed and power generation, dynamic braking and/or wheel/rail adhesion for each consist. Output commands from the vehicle level 106 to the consist level 108 include power for each consist, dynamic braking, pneumatic braking for consist overall, tractive effort (TE) overall, track adhesion management such as application of sand/lubricant, engine cooling plan, and/or hybrid engine plan. An example of such a hybrid engine plan is depicted in greater detail in FIG. 21.

Consist Level

Figure 12:
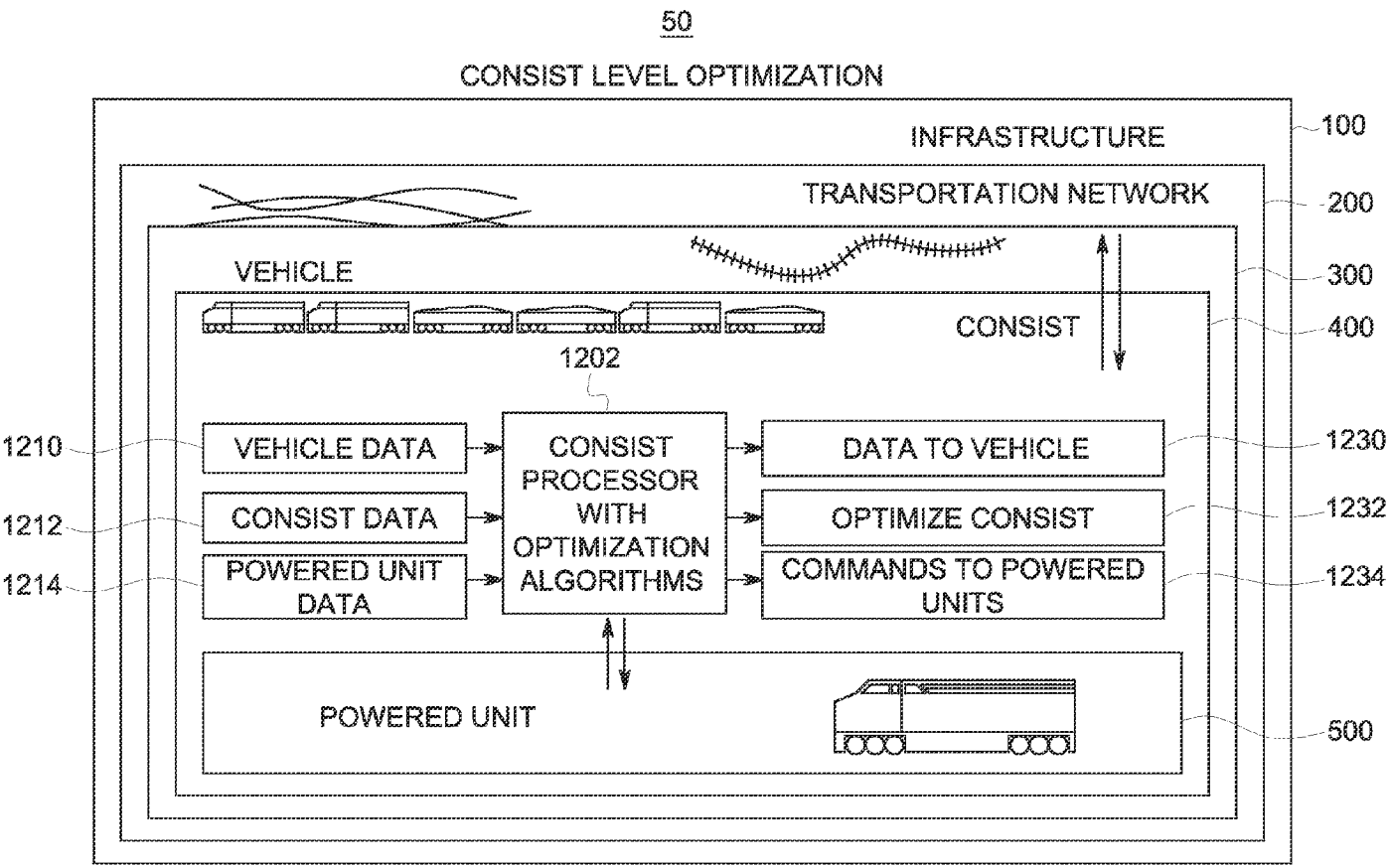
FIG. 12 is a schematic diagram of a consist level illustrating relationships with other related levels.
Figure 13:
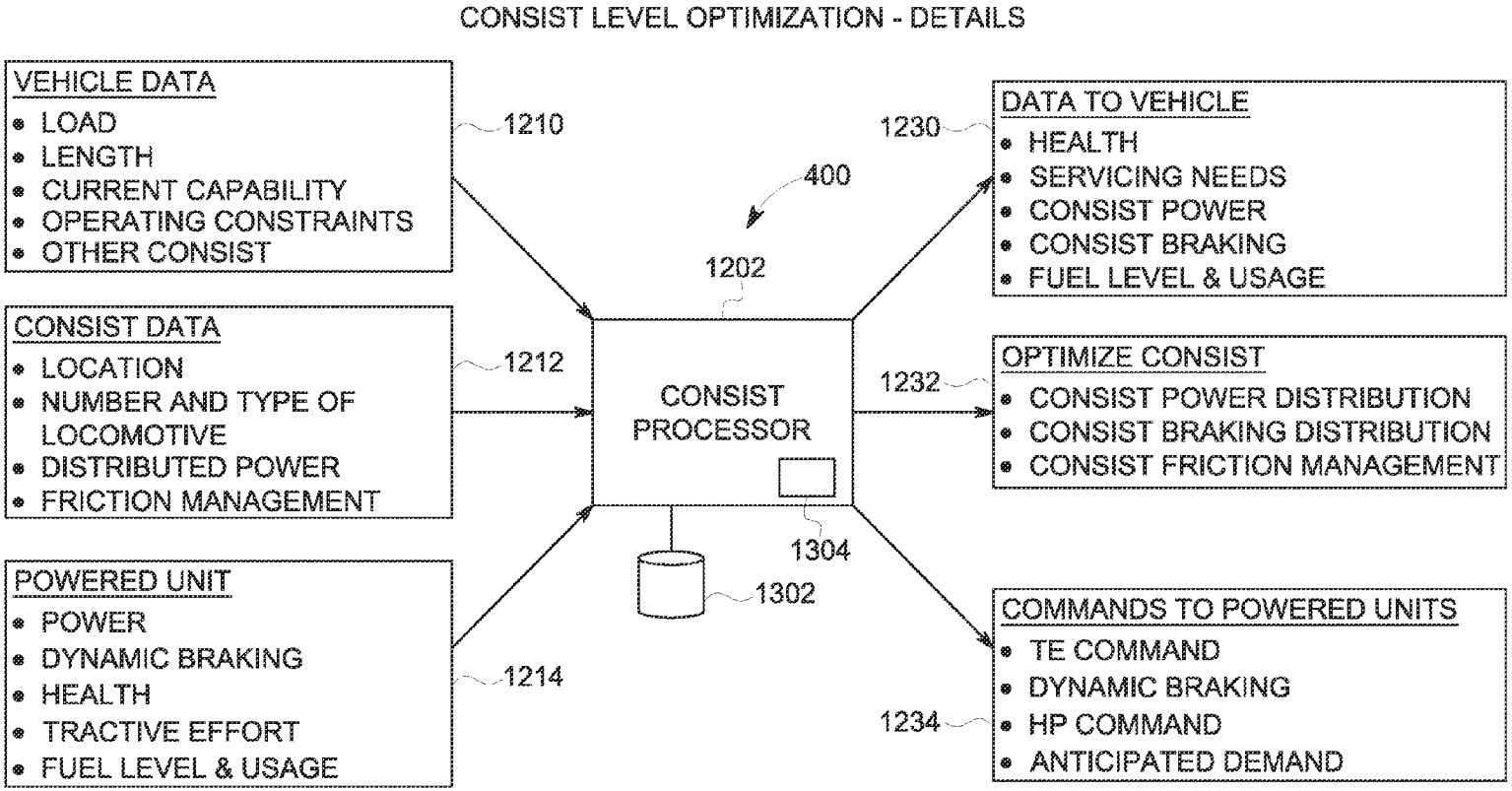
FIG. 13 is a schematic diagram illustrating inputs and outputs of a consist level processor.

FIGS. 12 and 13 illustrate the consist level relationships and exchange of data with other levels. The consist level processor 1202 includes a memory 1302 and processor instructions 1304 which includes optimization algorithms, and the like. As shown in FIG. 12, the inputs to the consist level, as depicted in the consist level 108 with optimization algorithms, include data 1210 from the vehicle level 106, data 1214 from the powered unit level 110, and/or data 1212 from the consist level 108. The outputs include data 1230 to the vehicle level 106, commands 1234 to the powered unit level 110, and/or optimization 1232 within the consist level 108.

As an input, the powered unit level 106 provides data 1210 associated with vehicle load, vehicle length, current capability of the vehicle, operating constraints, and/or data from the one or more consists within the vehicle level 106. Information 1210 sent from the powered unit level 110 to the consist level 108 may include current operating conditions and current equipment status. Current locomotive operating conditions includes data that is passed to the consist level to determine the overall performance of the consist. These may be used for feedback to the operator or to the control system (e.g., a railroad control system). The operating conditions also may be used for consist optimization. This data may include:

1. Tractive effort (TE) (motoring and dynamic braking)—This can be calculated based on current/voltage, motor characteristics, gear ratio, wheel diameter, and the like. Alternatively, this data may be calculated from draw bar instrumentation or vehicle dynamics knowing the vehicle and route information.

2. Horsepower (HP)—This is calculated based on the current/voltage alternator characteristics. It may also be calculated based on traction motor current/voltage information or from other sources or data such as tractive effort and powered unit speed, and/or engine speed and fuel flow rate.

3. Notch setting of throttle.

4. Air brake levels.

5. Friction modifier application, such as timing, type/amount/location of friction modifiers (e.g., sand and water).

Current powered unit equipment status may include data, in addition to one or more of the above items, for consist optimization and/or for feedback to the vehicle level and back up to the infrastructure network level. This can include:

Temperature of equipment such as the engine, traction motor, inverter, dynamic braking grid, and the like.

A measure of the reserve capacity of the equipment at a particular point in time and may be used determine when to transfer power from one powered unit to another.

Equipment capability such as a measure of the reserve capability. This may include engine horsepower available (considering ambient conditions, engine and cooling capability, and the like), tractive effort/braking effort available (considering route conditions, equipment operating parameters, and/or equipment capability), and/or friction management capability (e.g., friction enhancers and/or friction reducers).

Fuel level/fuel flow rate—The amount of fuel left may be used to determine when to transfer power from one powered unit to another. The fuel tank capacity along with the amount of fuel left may be used by the vehicle level and back up to the infrastructure network level to decide the refueling strategy. This information may also be used for adhesion limited tractive effort (TE) management. For example, if there is a critical adhesion limited region of operation ahead, the filling of the fuel tank may be planned to enable filing prior to the consist entering the region. Another optimization can be to keep more fuel on powered units that can convert that weight into useful tractive effort. For example, a trailing powered unit in a vehicle or consist may have a better rail and can more effectively convert weight to tractive effort provided when the axle/motor/power electronics are not limiting (from above mentioned equipment capability level). The fuel flow rate may be used for overall trip optimization. There are many types of fuel level sensors available. Fuel flow sensors are also available currently. However, it is possible to estimate the fuel flow rate from already known/sensed parameters on-board the powered unit. In one example, the fuel injected per engine stroke ($mm^3$/stroke) may be multiplied by the number of strokes/sec (function of rpm) and the number of cylinders, to determine the fuel flow rate. This may be further compensated for return fuel rate, which is a function of engine rpm, and/or ambient conditions. Another way of estimating the fuel flow rate is based on models using traction HP, auxiliary HP and losses/efficiency estimates. The fuel available and/or flow rate may be used for overall powered unit use balancing (with appropriate weighting if necessary). It may also be used to direct more use of the most fuel-efficient powered unit or a more fuel-efficient powered unit in preference to one or more less efficient powered units (e.g., within the constraint of fuel availability).

Fuel/Consumable range—Available fuel (or any other consumable) range is another piece of information that may be used. This can be computed based on the current fuel status and the projected fuel consumption based on the plan and the fuel efficiency information available on board. Alternatively, this may be inferred from models for each of the equipment or from past performance with correction for ambient conditions or based on the combination of these two factors.

Friction modifier level—The information regarding the amount and capacity of the friction modifiers may be used for dispensing strategy optimization (transfer from one powered unit to another). This information may also be used by the infrastructure network and infrastructure levels to determine the refilling strategy.

Equipment degradation/wear—The cumulative powered unit usage information may be used to make sure that one powered unit does not wear excessively. Examples of this information may include the total energy produced by the engine, temperature profile of dynamic braking grids, and the like. This may also allow powered unit operation resulting in more wear to some components if the components are scheduled for overhaul/replacement.

Powered unit position—The position and/or facing direction of the powered unit may be used for power distribution consideration based on factors like adhesion, train handling, noise, vibration, and the like.

Powered unit health—The health of the powered unit includes the present condition of the powered unit and subsystems of the powered unit. This information may be used for consist level optimization and by the transportation network and infrastructure levels for scheduling maintenance/servicing. The health includes component failure information for failures that do not degrade the current powered unit operation such as single axle components on an AC electromotive powered unit that does not reduce the horse power rating of the powered unit, subsystem degradation information, such as hot ambient condition, and engine water not fully warmed up, maintenance information such as wheel diameter mismatch information and potential rating reductions like partially clogged filters.

Figure 17:
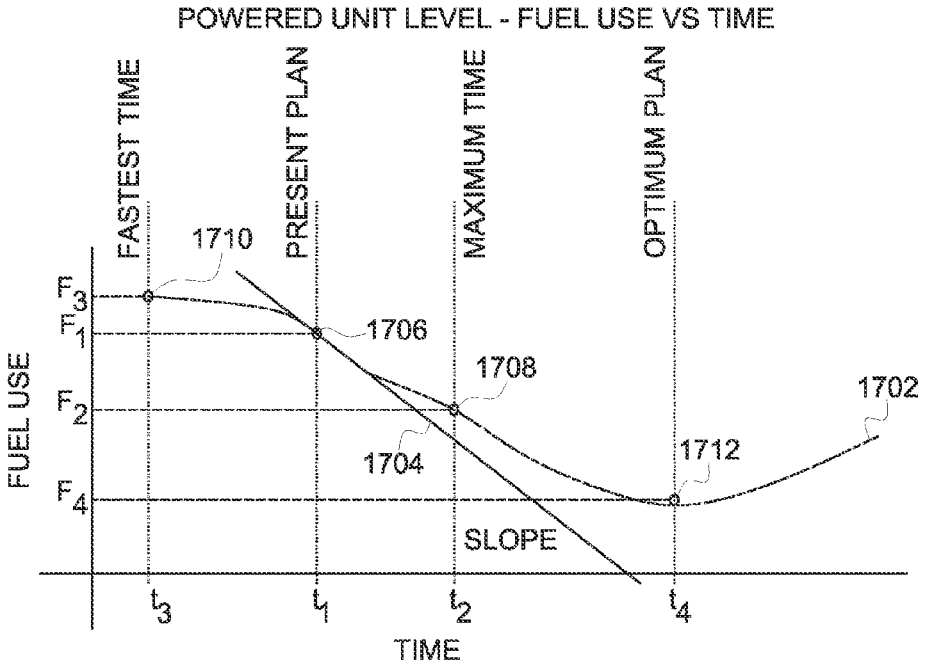
FIG. 17 is a graphic diagram illustrating fuel usage as a function of planned time of operation for various modes of operation at the power generating unit level.

Operating parameter or condition relationship information—A relation to one or more operating parameters or conditions may be defined. For example, FIG. 17 is illustrative of the type of relationship information at the powered unit level that can be developed which illustrates and/or defines the relationship between fuel use and time for a particular movement plan as shown by line 1402. This relationship information may be sent from the locomotive level 110 to the consist level 108. This may include the following:

Slope 1704 at the current operating plan time (fuel consumption reduction per unit time increase for example in gallons/sec). This parameter gives the amount of fuel reduction for every unit of travel time increase.

Fuel increase between a faster plan 1710 and a current plan 1706. This value corresponds to the difference in fuel consumption between points $F_3$ and $F_1$, as shown on FIG. 17.

Fuel reduction between an optimum plan 1712 and a current plan 1706. This value corresponds to the difference in fuel consumption between points $F_1$ and $F_4$ of FIG. 17.

Fuel reduction between the allocated plan and current plan. This value corresponds to the difference in fuel consumption between points $F_1$ and $F_2$ of FIG. 17.

The complete fuel as a function of time profile (including range).

Any other consumable information.

For optimizations at the consist level 108, multiple closed loop estimations may be done by the consist level and each of the powered units or the powered unit level. Among the consist level inputs from within the consist level are operator inputs, anticipated demand inputs, powered unit optimization, and/or feedback information.

The information flow and sources of information within the consist level include:

1. Operator inputs,
2. Movement plan inputs,
3. Route information,
4. Sensor/model inputs,
5. Inputs from the powered units and/or non-powered units,
6. Consist optimization,
7. Commands and information to the powered units in the consist,
8. Information flow for vehicle and movement optimization, and
9. General status/health and other info about the consist and the powered units in the consist. The consist level 108 uses the information from/about each of the powered units in the consist to optimize the consist level operations, to provide feedback to the vehicle level 106, and to provide instructions to the powered unit level 110. This includes the current operating conditions, potential fuel efficiency improvements possible for the current point of operation, potential operational changes based on the profile, and/or health status of the powered unit.

There are three categories of functions performed by the consist level 108 and the associated consist level processor 1202 to optimize consist performance. Internal consist optimization, consist movement optimization, and consist monitoring and control.

Internal optimization functions/algorithms optimize the consist fuel consumption by controlling operations of various equipments internal to the consist like throttle commands, brake commands, friction modifier commands, and/or anticipatory commands. This may be done based on current demand and by taking into account future demand. The optimization of the performance of the consist level include power and dynamic braking distribution among the powered unit within the consist, as well as the application of friction enhancement and reducers at points along the consist for friction management. Consist movement optimization functions and algorithms help in optimizing the operation of the vehicle and/or the operation of the movement plan. Consist control/monitoring functions help the controllers (e.g., railroad controllers) with data regarding the current operation and status of the consist and the powered units or loads in the consist, the status of the consumables, and other information to help with consist maintenance, powered unit maintenance, and/or route maintenance.

Figure 18:
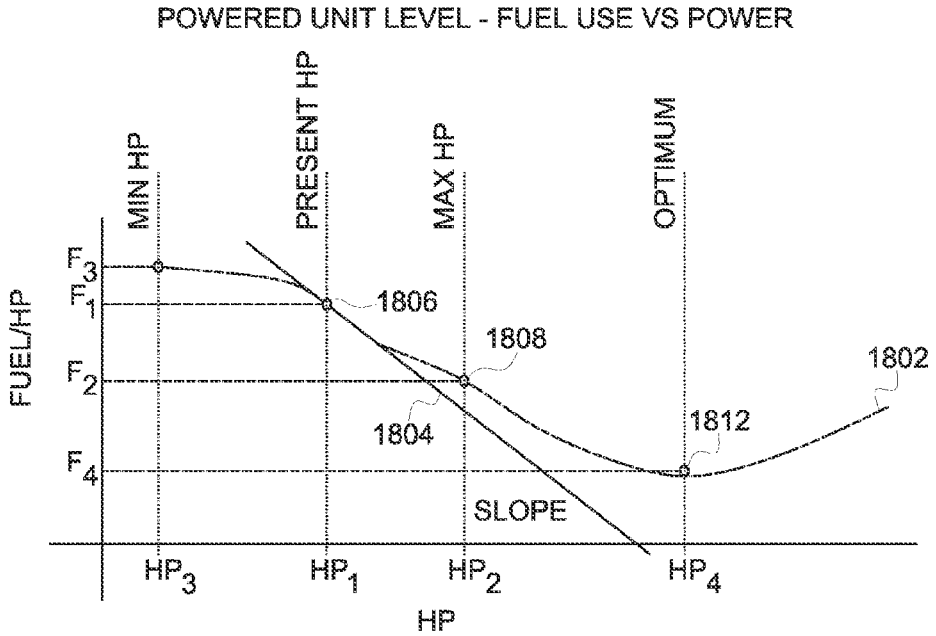
FIG. 18 is a graphic diagram illustrating power generating unit level fuel efficiency as measured in fuel usage per unit of power as a function the amount of power generated at the power generating unit level for various modes of operation.

The consist level 108 optimization provides for optimization of current consist operations. For consist optimization, in addition to the above listed information other information can also be sent from the powered unit. For example, to optimize fuel, the relationship between fuel/HP (measure of fuel efficiency) and horsepower (HP) as shown in FIG. 18 by line 1802 may be passed from each powered unit to the consist level controller 1202. One example of this relationship is shown in FIG. 18. Referring to FIG. 18, the data may also include one or more of the following items:

Slope 1804 of Fuel/HP as a function of HP at the present operating horsepower. This parameter provides a measure of fuel rate increase per horsepower increase.

Maximum or upper horsepower 1808 and the fuel rate increase corresponding to this horsepower.

Most efficient or more efficient operating point 1812 information. This includes the horsepower and the fuel rate change to operate at this point.

Complete fuel flow rate as a function of horsepower.

The update time and the amount of information may be determined based on the type and complexity of the optimization. For example, the update may be done based on significant changes. These include notch change, large speed change or equipment status changes including failures or operating mode changes or significant fuel/HP changes, for example, a variation of 5 percent. The ways of optimizing include sending only the slope (e.g., the slope 1804) at the current operating point and may be done at a slow data rate, for example, at once per second. Another way is to send the slope 1804, the upper horsepower 1808, and/or the efficient operating point 1812 information and then to send the updates when there is a change. Another option is to send the fuel flow rate once and update points that change periodically, such as once per second.

Optimization within the consist considers factors such as fuel efficiency, consumable availability and equipment/subsystem status. For example, if the current demand is for 50% horsepower for the whole consist, it may be more efficient to operate some powered units at less than a 50% horsepower rating and other powered units at more than a 50% horsepower rating so that the total power generated by the consist equals the operator demand. In this case, higher efficiency powered units will be operating at a higher horsepower than the lower efficiency powered units. This horsepower distribution may be obtained by various optimizing techniques based on the horsepower as a function of fuel rate information obtained from each powered unit. For example, for small horsepower distribution changes, the slope of the function of the horsepower as a function of the fuel rate may be used. This horsepower distribution may be modified for achieving other objective functions or to consider other constraints, such as vehicle handling/drawbar forces based on other feedback from the powered units. For example, if one of the powered units is low on fuel, it may be necessary to reduce the load of the powered unit so as to conserve fuel if the powered unit is required to produce a large amount of energy (horsepower/hour) before refueling, even if this powered unit is the most efficient one or is more efficient than one or more other powered units.

Other input information from one or more of the powered units at the powered unit level 110 may be provided to the consist level 108. This other information from the powered unit level includes:

Maintenance cost. This includes the routine/scheduled maintenance cost due to wear and tear that depends on horsepower (ex. $/kwhr) or tractive effort increase.

Transient capability. This may be expressed in terms of the continuous operating capability of the powered unit, maximum or designated capability of the powered unit and the transient time constant and gain.

Fuel efficiency at one or more points of operation.

Slope at one or more points of operation. This parameter gives the amount of fuel rate increase per horsepower increase.

Maximum or designated horsepower at one or more points of operation and the fuel rate increase corresponding to this horsepower.

Most or more efficient operating point information at one or more points of operation. This includes the horsepower and the fuel rate change to operate at this point.

Complete fuel flow rate vs. horsepower curve at one or more points of operation.

Fuel (and other consumable) range, based on current fuel level and the plan and the projected fuel consumption rate.

If the complete profile information is known, the overall consist optimization may consider the total fuel and consumables spent. Other weighting factors that may be considered include cost of powered unit maintenance, transient capability and issues like vehicle handling and/or adhesion limited operation. Additionally, if the shape of the consist level fuel use as a function of time as depicted by FIG. 14 changes significantly due to its transient nature (for example, the temperature of the electrical equipments such as traction motors, alternators, or storage elements), then this curve may be regenerated for various potential power distributions for the current plan. Similar to the previous section, the data may be sent periodically or once at the beginning and updates sent only when there is a significant change.

As input to the movement plans, optimization information may be developed at the consist level 108. Information may be sent from the powered unit level 110 to be combined by the consist level with other information or aggregated with other powered unit level data for use by the infrastructure network level 104. For example, to optimize fuel (e.g., increase fuel efficiency or reduce the amount of fuel consumed), fuel consumption information as a function of plan time, e.g., the time to reach the destination or an intermediate point like meet or pass, may be passed from each powered unit to the consist controller 1202.

To illustrate one embodiment of the operation of optimization at the consist level 108, FIG. 14 illustrates the consist level as a function of fuel use versus time. A line denoted as 1402 represents fuel use vs. time at the consist level for a consist scheduled to go from point A to point B (not illustrated). FIG. 14 shows the fuel consumption as a function of time as derived by the vehicle. The slope of line 1404 is the fuel consumption vs. time at the present plan. Point 1406 corresponds to the current operation, 1408 to the maximum time allocated (or a designated time allocated to the operation, but not necessarily the maximum time), 1410 corresponds to the best time or another designated time that the vehicle may make, and 1412 corresponds to the most or a more fuel efficient operation. Under the current plan, the vehicle will consume a certain amount of fuel and will get to a designation after a certain elapsed time $t_1$. It is also assumed that between points A and B, the vehicle at the consist level assumes to operate without regard to other vehicles on the system as long as the vehicle can reach the destination of the vehicle within the time currently allocated to the vehicle, e.g., $t_2$. Optimization may be run autonomously on the vehicle to reach point B.

As noted above, the outputs of the consist level 108 can include data to the vehicle level 106, commands and controls to the powered unit level 110 as well as the internal consist level 108 optimization. The consist level output 1230 to the vehicle level includes data associated with the health of the consist, service requirements of the consist, the power of the consist, the consist braking effort, the fuel level, and fuel usage of the consist. In one embodiment, the consist level sends the following types of additional information for use in the vehicle level 106 for vehicle level optimization. To optimize on fuel, fuel consumption information as a function of plan time (e.g., time to reach the destination or an intermediate point like meet or pass) can be passed from each of the consists to the vehicle/infrastructure controller (e.g., the controller of the vehicle or the controller of the movement of several vehicles in a transportation network). FIG. 14 discloses one embodiment of the inventive subject matter for fuel optimization and identifies the type of information and relationship between the fuel use and the time that can be sent by the consist level to the vehicle level. Referring to FIG. 14, this can include one or more of the items listed below.

Slope 1404 at the current operating plan time (fuel consumption reduction per unit time increase: gallons/sec). This parameter gives the amount of fuel reduction for every unit of time increase.

Fuel increase between the fastest plan or a faster plan and the current plan. This value corresponds to the difference in fuel consumption between points 1410 and 1406.

Fuel reduction between the best or a better (e.g., less fuel consumed) plan and current plan. This value corresponds to the difference in fuel consumption between points 1406 and 1412, of FIG. 14.

Fuel reduction between the allocated plan and current plan. This value corresponds to the difference in fuel consumption between points 1406 and 1408 of FIG. 14.

The complete fuel as a function of time profile as depicted in FIG. 14 by the line 1402.

As noted in FIG. 13, the consist level 108 provides output commands to the powered unit level 110 about current engine speed, power generation, and/or anticipated demands. Dynamic braking and horsepower requirements may also be provided to the powered unit level. The signals/commands from the consist level to the powered unit level or the powered unit within the consist level include operating commands, adhesion modification commands, and/or anticipatory controls, for example.

Figure 21:
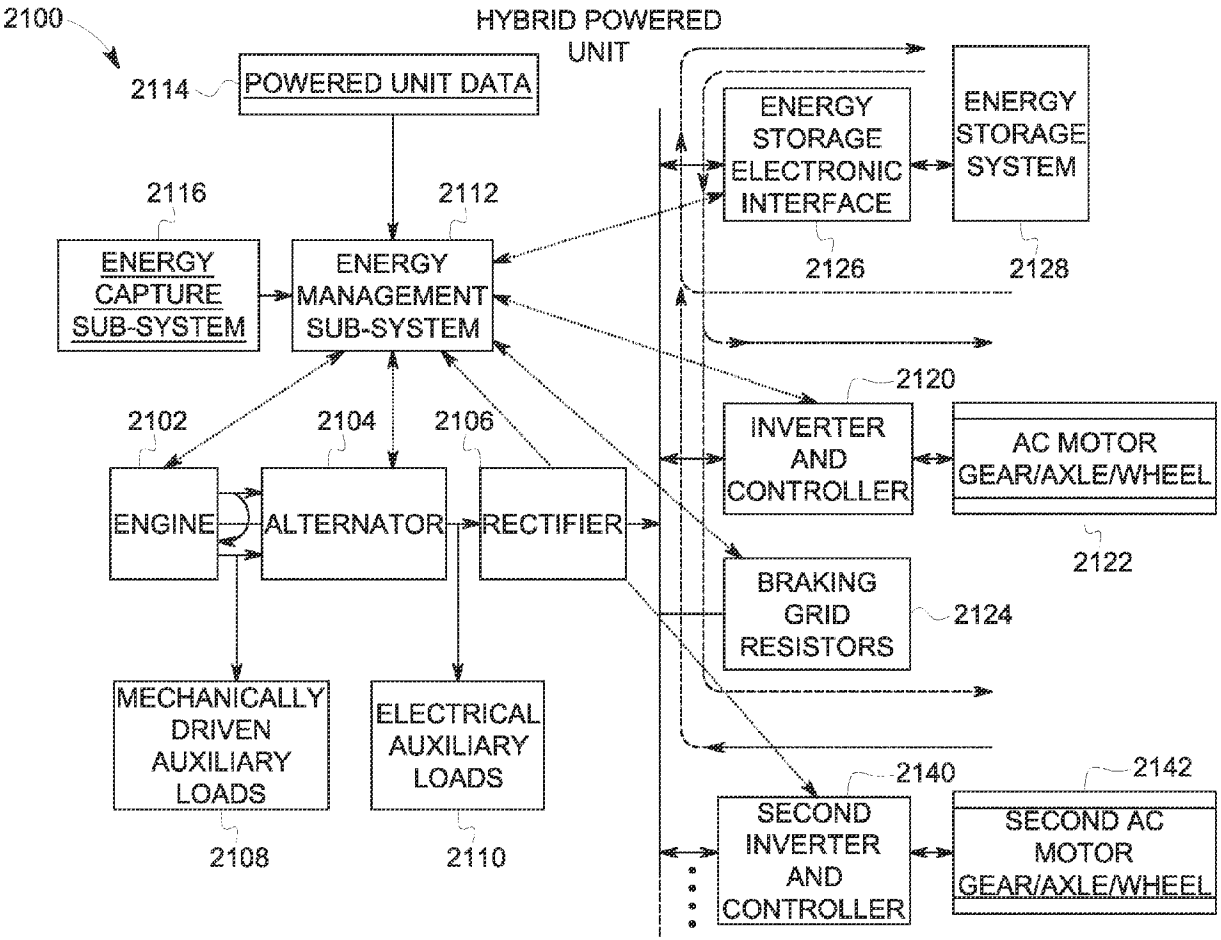
FIG. 21 is a schematic diagram of an energy management subsystem of a hybrid energy vehicle (e.g., a locomotive) having an on-board energy regeneration and storage capability as configured and operated for increasing fuel efficiency of the vehicle.

Operating commands may include notch settings for one or more, or each, of the powered units, tractive effort/dynamic braking effort to be generated for each, or one or more, of the powered units, train air brake levels (which may be expanded to individual car air brake in the event electronic air brakes are used and when individual cars/group of cars are selected), and/or independent air brake levels on each, or one or more, of the powered units. Adhesion modification commands are sent to the powered unit level or cars (for example, at the rear of the powered unit) to dispense friction-enhancing material (sand, water, and/or snow blaster) to improve adhesion of that powered unit or trailing powered units, or for use by another consist using the same track. Similarly, friction lowering material dispensing commands also may be sent. The commands can include, by way of example, the type and amount of material to be dispensed along with the location and duration of material dispensing. Anticipatory controls include actions to be taken by the individual powered units within the powered unit level to optimize the overall trip. This can include pre-cooling of the engine and/or electrical equipment to get better short-term rating or get through high ambient conditions ahead. Pre-heating may be performed (for example, water/oil may need to be at a certain temperature to fully load the engine). Similar commands may be sent to the powered unit level and/or storage tenders of a hybrid powered unit, as is depicted in FIG. 21, to adjust the amount of energy storage in anticipation of a demand cycle ahead.

The timing of updates sent to and from the consist level and the amount of information can be determined based on the type and complexity of the optimization. For example, the update may occur at a predetermined point in time, at regularly scheduled times or when significant changes occur. These later ones may include: significant equipment status changes (for example the failure of a powered unit) or operating mode changes such as the degraded operation due to adhesion limits, or significant fuel, horsepower, or schedule changes such as a change in the horsepower by 5 percent (as one example). There are many ways of optimizing based on these parameters and functions. For example, only the slope 1404 of the fuel use as a function of the time at the current operating point may be sent and this may be done at a slow rate, such as once every 5 minutes. Another way is to send the slope 1404, the fuel increase between the fastest plan or a faster plan and the current plan, and/or the fuel reduction between the best or a better plan and current plan once and only send updates when there is a change. Yet another option is to send only the fuel reduction between the allocated plan and current plan once and only update points that change periodically, such as once every 5 minutes.

As indicated in the earlier discussion, with simplified versions of vehicle configurations, such as single powered unit consists and/or single powered unit vehicles, the relationship and extent of communication between the vehicle level 106, consist level 108, and powered unit level 110 becomes less complex, and in some embodiments, collapses into less than three separately functioning levels or processors, with possibly all three levels operating within a single functioning level or processor.

Powered Unit Level

Figure 15:
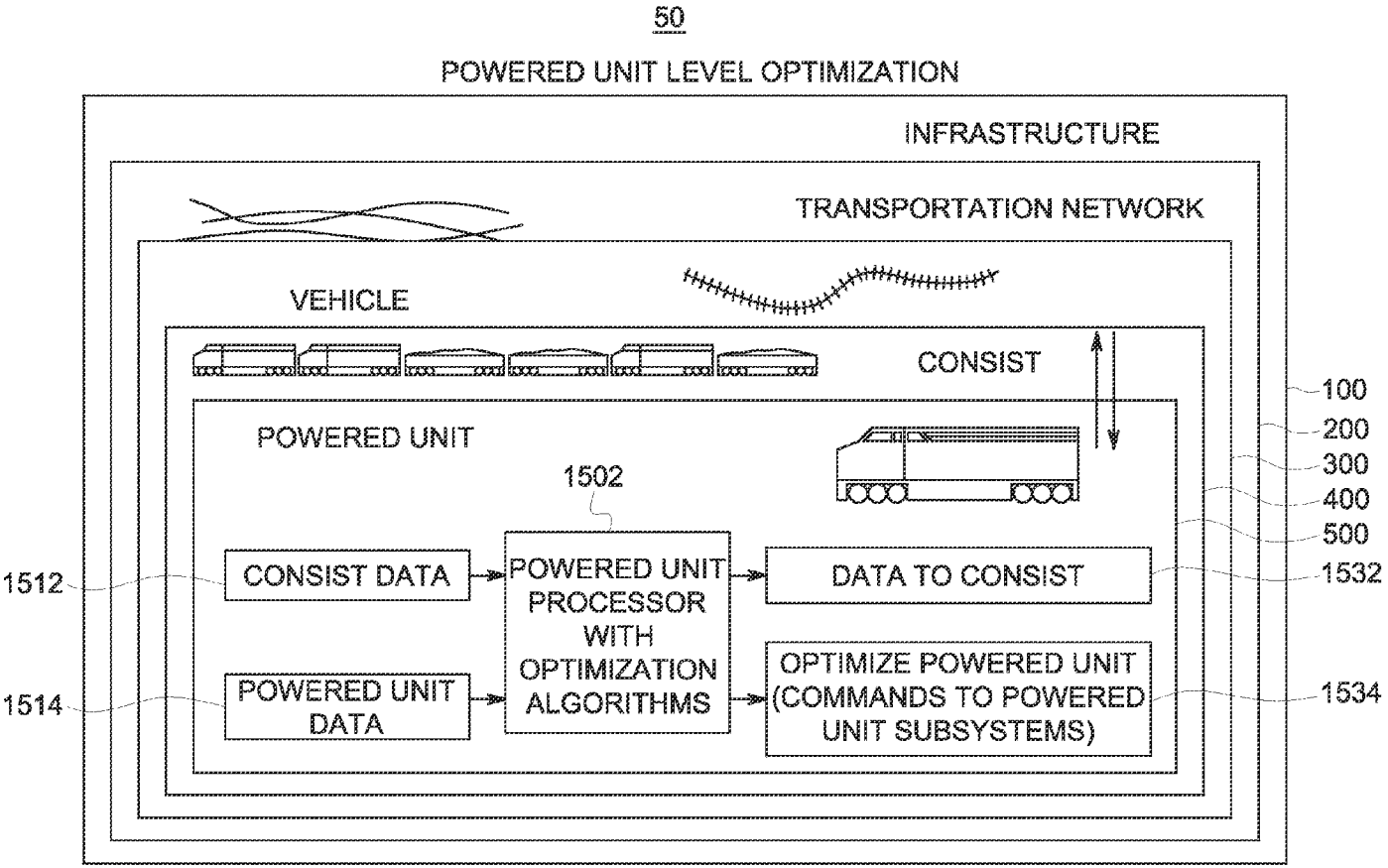
FIG. 15 is a schematic diagram of a power generating unit level (e.g., a locomotive level) illustrating relationships with the consist level.
Figure 16:
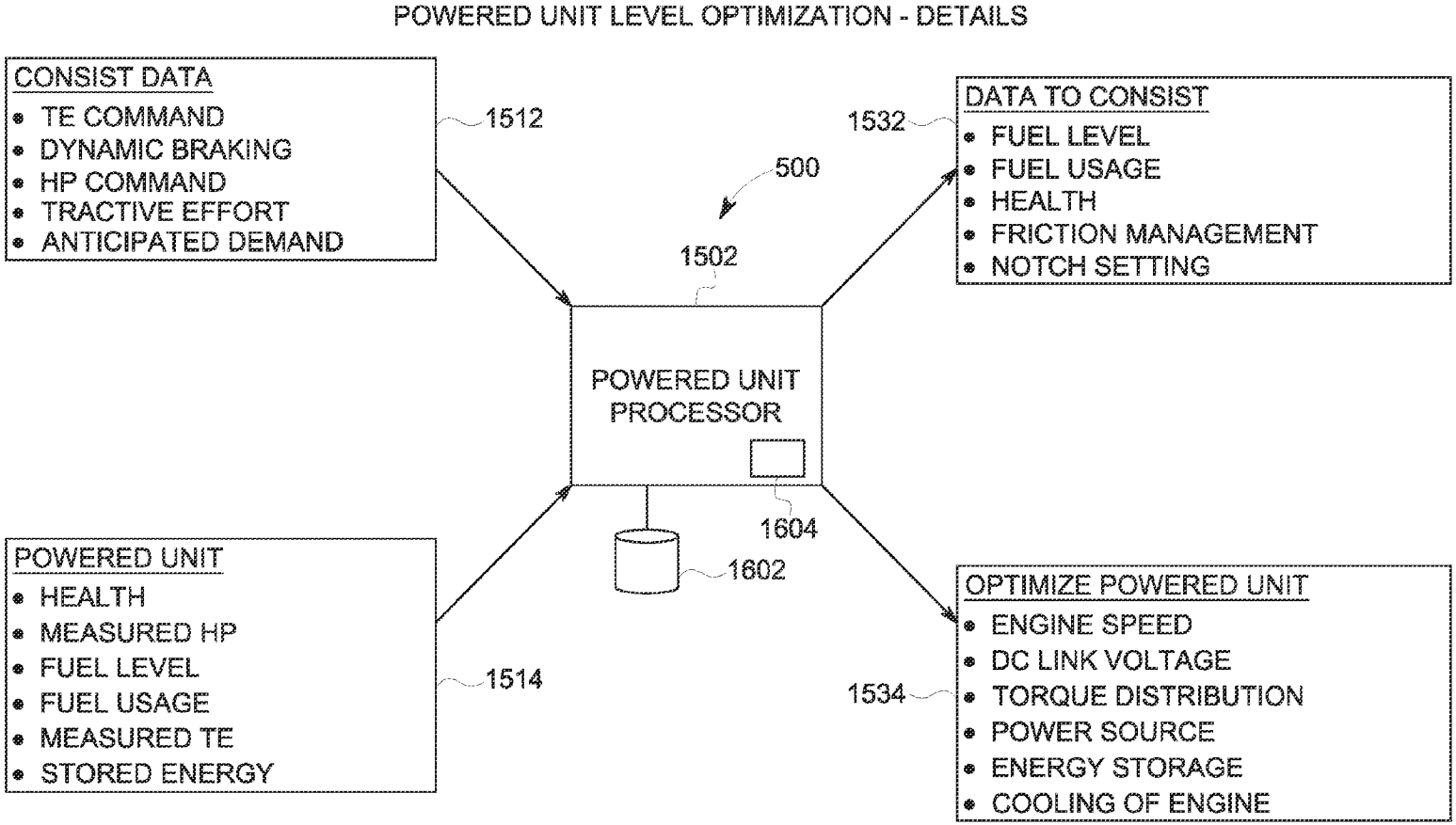
FIG. 16 is a schematic diagram illustrating inputs and outputs of a power generating unit level processor.

FIGS. 15 and 16 illustrate the powered unit level 110 relationship with the consist level 108 and optimization of the powered unit internal operation via commands to the various subsystems of the powered unit. The powered unit level includes a processor 1502 with optimization algorithms, which may be in the form of a memory 1602 and processing instructions 1604, and the like. The input data to the powered unit level includes consist level data 1512 and data 1514 from the powered unit level (including powered unit feedback). The output from the powered unit level includes data 1532 to the consist level and optimization of performance data 1534 at the powered unit level. As shown in FIG. 16, the input data 1512 from the consist level can include tractive effort command, powered unit engine speed, horsepower generation, dynamic braking, friction management parameters, and/or anticipated demands on the engine and propulsion subsystem (e.g., traction motors, brakes, and the like, that control movement of the vehicle). The input data 1514 from the powered unit level may include powered unit health, measured horsepower, fuel level, fuel usage, measured tractive effort, and/or stored electric energy. The later may be applicable to embodiments utilizing hybrid vehicle technology as shown and described hereinafter in connection with the hybrid vehicle of FIG. 21. The data output 1532 to the consist level include powered unit health, friction management, notch setting, and/or fuel information, such as fuel usage, level, and/or range. The powered unit optimization commands 1534 to the subsystems of the powered unit can include engine speed to the engine, engine cooling for the cooling system for the engine, DC link voltage to the inverters, torque commands to the traction motors, and/or electric power charging and usage from the electric power storage system of hybrid powered units. Two other types of inputs can include operator inputs and anticipated demand inputs.

The information flow and sources of information at the locomotive level 110 can include:

a. Operator inputs, b. Movement plan inputs, c. Route information, d. Sensor/model inputs, e. Onboard optimization, f. Information flow for consist and movement optimization, and g. General status/health and other information for consist consolidation and for route optimization/scheduling.

Some categories of functions performed by the powered unit level can include internal optimization functions/algorithms, powered unit movement optimization functions/algorithms, and powered unit control/monitoring. Internal optimization functions/algorithms may optimize or improve (e.g., reduce) the fuel consumption of the powered unit by controlling operations of various equipments internal to the powered unit, e.g., engine, alternator, and traction motor. This may be done based on current demand and by taking into account future demand. The movement optimization functions and/or algorithms can help in optimizing the operation of the consist and/or the operation of the movement plan. The control/monitoring functions may help the consist and route controllers (e.g., railroad controllers) with data regarding the current operation and status of the powered unit, the status of the consumables and other information to help the railroad with powered unit and/or route maintenance.

Based on the constraints imposed at the powered unit level, operation parameters that may be optimized can include engine speed, DC link voltage, torque distribution throughout the powered unit (e.g., among several fraction motors), and/or which source of power is used to propel the powered unit.

For a given horsepower command, there may be a specific engine speed which produces a fuel efficiency that is improved over other engine speeds. There may be a minimum or lower designated speed below which the engine (e.g., a diesel engine) may be unable to support the power demand. At this engine speed, the fuel combustion may not happen in the most efficient manner. As the engine speed increases, the fuel efficiency may improve. However, losses like friction and windage can increase, and therefore an optimum speed can be obtained where the total engine losses are the minimum, or are at least reduced relative to one or more other speeds. One example of this fuel consumption vs. engine speed relationship is illustrated in FIG. 20 where the curve 2002 is the total performance range of the powered unit and point 2004 is the optimum performance for fuel usage vs. speed.

Figure 19:
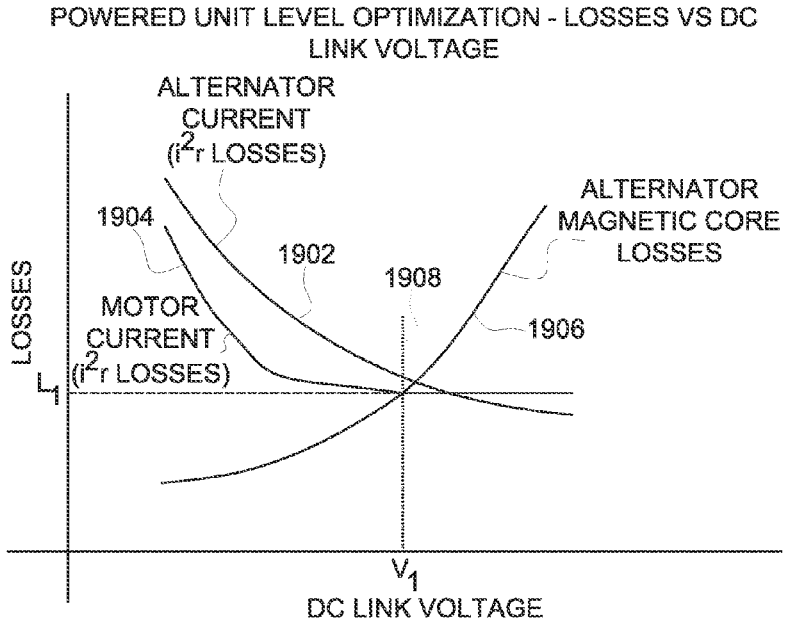
FIG. 19 is a graphic diagram illustrating various electrical system losses as a function of direct current (DC) link voltage at the power generating unit level.

The DC link voltage on an AC powered unit determines the DC link current for a given power level. The voltage typically determines the magnetic losses in the alternator and the traction motors. Some of these losses are illustrated in FIG. 19. The voltage also determines the switching losses in the power electronics devices and snubbers. It also determines the losses in the devices used to produce the alternator field excitation. On the other hand, current determines the $i^{2r}$ losses in the alternator, traction motors, and the power cables. Current also determines the conduction losses in the power semiconductor devices. The DC link voltage can be varied such that the sum of all the losses is a minimum, or at least is reduced. As shown in FIG. 19, for example, the alternator current losses vs. DC link voltage are plotted as line 1902 the alternator magnetic core losses vs. DC link voltage are plotted as line 1906, and the motor current losses vs. DC link voltage are plotted as line 1904, which are substantially optimized or at least improved at line 1908 at DC link voltage $V_1$.

For a specific horsepower demand, the distribution of power (torque distribution) to the six traction axles of one embodiment of a powered unit may be controlled or changed for improved fuel efficiency. The losses in each fraction motor, even if the traction motor is producing the same torque or same horsepower, can be different due to wheel slip (which can be different for different wheels associated with the different traction motors), wheel diameter differences (e.g., of the wheels associated with the different traction motors), operating temperature differences (e.g., different traction motors operating at different temperatures or in different temperature environments), and/or the motor characteristics differences (e.g., the characteristics of the traction motors that differ from each other). Therefore, the distribution of the power between each axles can be used to reduce the associated losses. Some of the axles may even be turned off to eliminate the electrical losses in those traction motors and the associated power electronic devices.

In powered units with additional power sources, for example, hybrid powered units such as shown in FIG. 21, the power source selection and the appropriate amount of energy drawn from each of the sources (so that the sum of the power delivered is what the operator is demanding) may be controlled to determine or improve the fuel efficiency. Hence, powered unit operation may be controlled to obtain the best or an improved fuel-efficient point of operation at any time.

For consists or powered units equipped with friction management systems, the amount of friction seen by the load cars (especially at higher speeds) may be reduced by applying friction reducing material on to the route behind the powered unit. This can reduce the fuel consumption since the tractive effort required to pull the load has been reduced. This amount and timing of dispensing may be further optimized based on the knowledge of the route and load characteristics.

A combination of two or more of the above variables (engine speed, DC link voltage, and/or torque distribution, for example) along with auxiliaries like engine and equipment cooling may be optimized. For example, the DC link voltage that is available may be determined by the engine speed and the engine speed may be increased beyond an optimum speed (based on engine only consideration) to obtain a higher voltage resulting in an optimum operating point.

There are other considerations for optimization once the overall operating profile is known. For example, parameters and operations such as powered unit cooling, energy storage for hybrid vehicles, and friction management materials may be utilized. The amount of cooling required can be adjusted based on anticipated demand. For example, if there is large or increased demand for tractive effort ahead due to high grade, the traction motors may be cooled prior to arriving at the location of the increased demand to increase a short term (thermal) rating which may be required to produce high tractive effort. Similarly, if there is a tunnel ahead, the engine and/or other components may be pre-cooled to enable operation through the tunnel to be improved. Conversely, if there is decreased demand for tractive effort ahead, then the cooling may be shut down (or reduced) to take advantage of the thermal mass present in the engine cooling and in the electric equipment such as alternators, traction motors, and/or power electronic components.

In a hybrid vehicle, the amount of power in a hybrid vehicle that should be transferred in and out of the energy storage system may be optimized based on the demand that will be required in the future. For example, if there is a large period of dynamic brake region ahead, then all the energy in the storage system can be consumed now (instead of from the engine) so as to have no stored energy at the beginning of dynamic brake region (so that increased energy may be recaptured during the dynamic brake region of operation). Similarly, if there is a heavy power demand expected in the future, the stored energy may be increased for use ahead.

The amount and duration of dispensing of friction increasing material (like sand) can be reduced if the equipment rating is not needed ahead. The trailing axle power/tractive effort rating may be increased to get more available adhesion without expending these friction-enhancing resources.

There are other considerations for optimization other than fuel. For example, emissions may be another consideration especially in cities or highly regulated regions. In those regions it is possible to reduce emissions (smoke, Nitrogen Oxide, etc.) and trade off other parameters like fuel efficiency. Audible noise may be another consideration. Consumable conservation under certain constraints is another consideration. For example, dispensing of sand or other friction modifiers in certain locations may be discouraged. These location specific optimization considerations may be based on the current location information (obtained from operator inputs, track inputs, GPS/track information along with geofence information). One or more of these factors can be considered for both the current demand and for optimizations for the overall operating plan.

Hybrid Powered Unit

Referring to FIG. 21, a hybrid powered unit level 2100 is shown having an energy storage subsystem 2116. An energy management subsystem 2112 controls the energy storage subsystem 2116 and the various components of the powered unit, such as an engine 2102 (e.g., a diesel engine), alternator 2104, rectifier 2106, mechanically driven auxiliary loads 2108, and/or electrical auxiliary loads 2110 that generate and/or use electrical power. This management subsystem 2112 operates to direct available electric power such as that generated by the traction motors during dynamic braking or excess power from the engine and alternator, to the energy storage subsystem 2116, and to release this stored electrical power within the consist to aid in the propulsion of the powered unit during monitoring operations.

To do so, the energy management subsystem 2112 communicates with the engine 2102, alternator 2104, inverters and controllers 2120 and 2140 for the traction motors 2122 and 2142, and/or the energy storage subsystem interface 2126.

As described above, a hybrid powered unit provides additional capabilities for optimizing powered unit level 110 (and thus consist level and/or vehicle level) performance. In some respects, the hybrid powered unit can allow current engine performance to be decoupled from the current powered unit power demands for motoring, so as to allow the operation of the engine to be optimized not only for the present operating conditions, but also in anticipation of the upcoming topography and operational requirements. As shown in FIG. 21, powered unit data 2114, such as anticipated demand, anticipated energy storage opportunities, speed, and/or location, are input into the energy management sub-system 2112 of the powered unit level. The energy management sub-system 2112 receives data from and provides instructions to the engine controls and system 2102, and the alternator and rectifier control and systems 2104 and 2106, respectively. The energy management sub-system 2112 provides control to the energy storage system 2128, the inverters and controllers of the traction motors 2120 and 2140, and the braking grid resistors 2124.

In another embodiment, a driving and/or operating strategy of a powered system is determined and implemented. At least one technical effect is determining and implementing a driving and/or an operating strategy of a powered system (e.g., a diesel powered system) to improve at least certain objective operating criteria parameter requirement while satisfying schedule and speed constraints. To facilitate an understanding, it is described hereinafter with reference to specific implementations thereof. The inventive subject matter is described in the general context of computer-executable instructions, such as program modules, being executed by a computer. Generally, program modules include routines, programs, objects, components, data structures, and the like, that perform particular tasks or implement particular abstract data types. For example, the software programs that underlie the inventive subject matter can be coded in different languages, for use with different platforms. Examples of the inventive subject matter may be described in the context of a web portal that employs a web browser. It will be appreciated, however, that the principles that underlie the inventive subject matter can be implemented with other types of computer software technologies as well.

Moreover, the inventive subject matter may be practiced with other computer system configurations, including handheld devices, multiprocessor systems, microprocessor-based or programmable consumer electronics, minicomputers, mainframe computers, and the like. The inventive subject matter may also be practiced in distributed computing environments where tasks are performed by remote processing devices that are linked through a communications network. In a distributed computing environment, program modules may be located in both local and remote computer storage media including memory storage devices. These local and remote computing environments may be contained entirely within the powered unit, or adjacent powered units in a consist, or off-board in wayside or central offices where wireless communication is used.

Throughout this document, the term powered unit consist is used. As used herein, a powered unit consist may be described as having one or more powered units (e.g., vehicles capable of self-propulsion) in succession, connected together so as to provide motoring and/or braking capability. The powered units are connected together where no cars are between the powered units. A vehicle, such as a rail vehicle, can have more than one consist in the composition of the vehicle. Specifically, there can be a lead consist, and more than one remote consists, such as midway in the line of cars and another remote consist at the end of the vehicle. Each powered unit consist may have a single powered unit, or a first powered unit and at least one trail powered unit. Though a consist is usually viewed as successive powered units, a consist also may include powered units that are separated by at least a car, such as when the consist is configured for distributed power operation (e.g., wherein throttle and braking commands are relayed from a lead powered unit of the consist to a remote powered unit of the same consist by a radio link or physical cable). Toward this end, the term powered unit consist should be not be considered a limiting factor when discussing multiple powered unit within the same vehicle.

Figure 22:
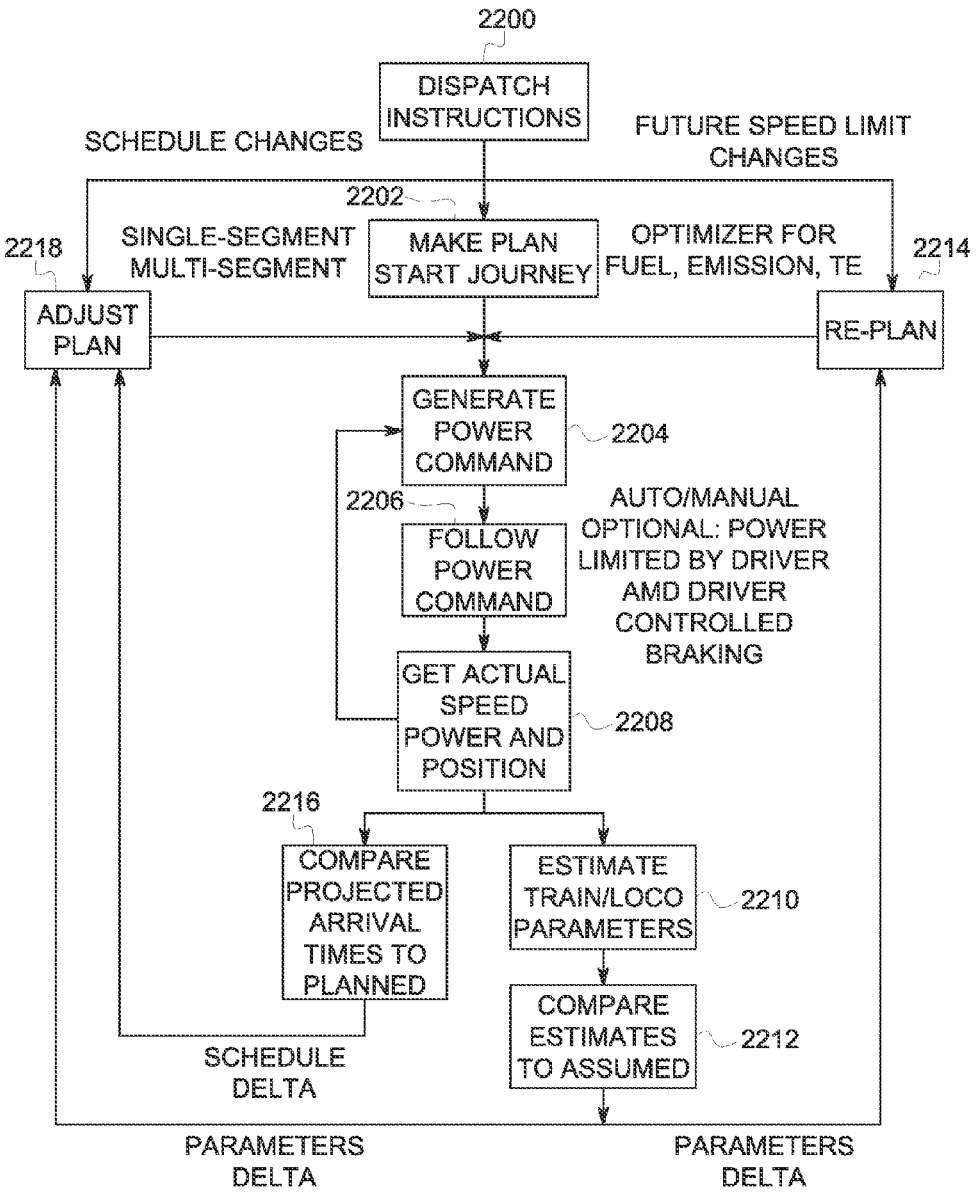
FIG. 22 depicts an exemplary illustration of a flow chart of an example embodiment.

FIG. 22 depicts an exemplary illustration of a flow chart of an example embodiment. As illustrated, instructions are input specific to planning a trip either on board or from a remote location, such as a dispatch center 2200. Such input information can include, but is not limited to, vehicle position, consist description (such as powered unit models), powered unit power description, performance of powered unit traction transmission, consumption of engine fuel as a function of output power, cooling characteristics, the intended or designated trip route (e.g., effective track grade and/or curvature as function of milepost or an "effective grade" component to reflect curvature following standard practices), the vehicle represented by car makeup and loading together with effective drag coefficients, trip desired parameters including, but not limited to, start time and location, end location, desired travel time, crew (user and/or operator) identification, crew shift expiration time, and/or route.

Figure 24:
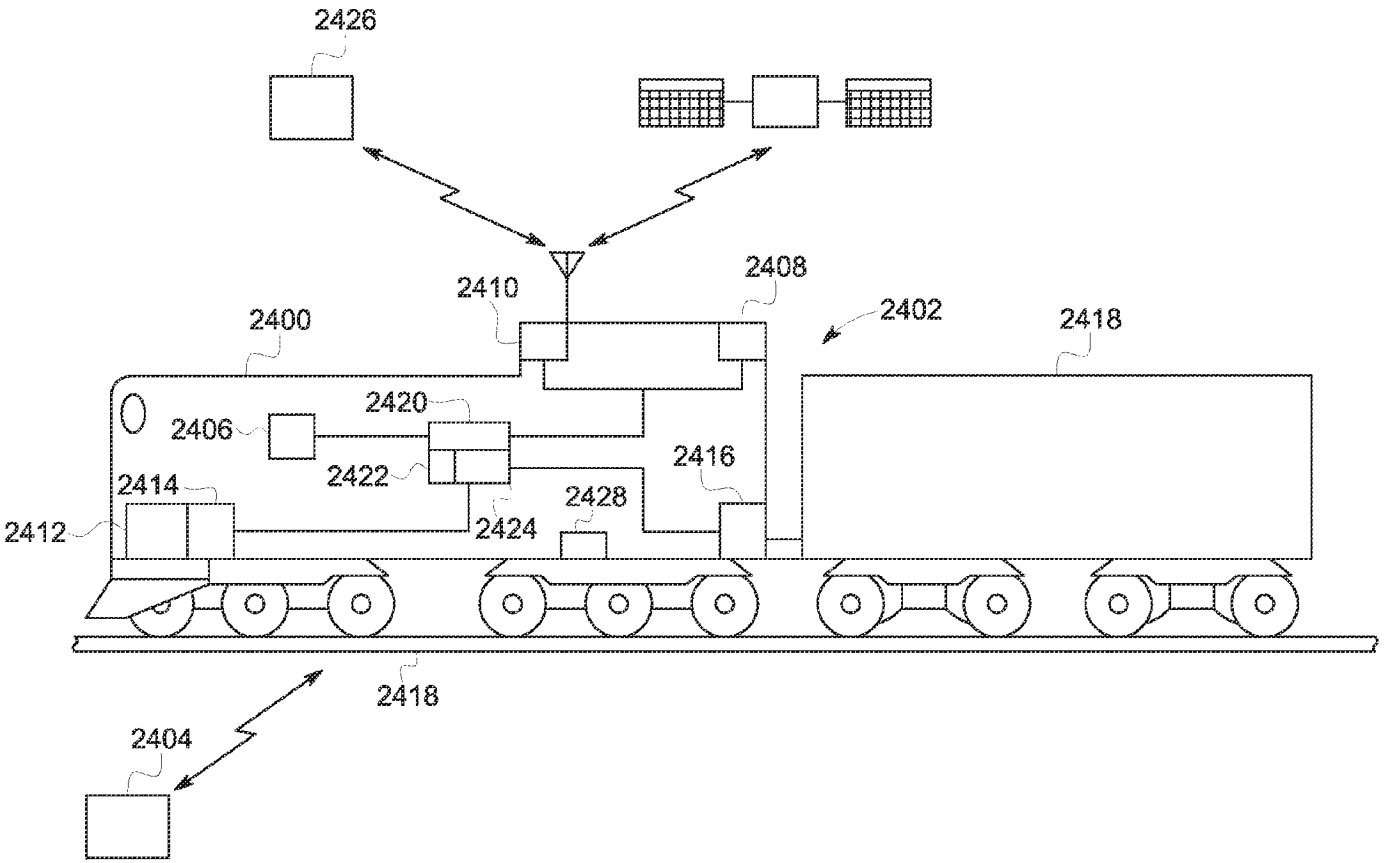
FIG. 24 depicts one embodiment of a vehicle and powered unit described herein.

This data may be provided to a powered unit 2400 (shown in FIG. 24) of a vehicle 2402 shown in FIG. 24 (e.g., a vehicle capable of self-propulsion) in a number of ways, such as, but not limited to, an operator manually entering this data into the powered unit 2400 via an onboard display, inserting a memory device such as a hard card and/or USB drive containing the data into a receptacle aboard the powered unit, and transmitting the information via wireless communication from a central or wayside location 2404 (shown in FIG. 24), such as a track signaling device and/or a wayside device, to the powered unit 2400. Load characteristics (e.g., drag) of the powered unit 2400 and/or vehicle 2402 (e.g., a train) may also change over the route (e.g., with altitude, ambient temperature, and/or condition of the routes and other cars of the vehicles, such as rail-cars), and the plan may be updated to reflect such changes as needed by any of the methods discussed above and/or by real-time autonomous collection of powered unit/vehicle conditions. This can include for example, changes in powered unit or vehicle characteristics detected by monitoring equipment on or off board the powered unit(s) 2400.

Figure 32:
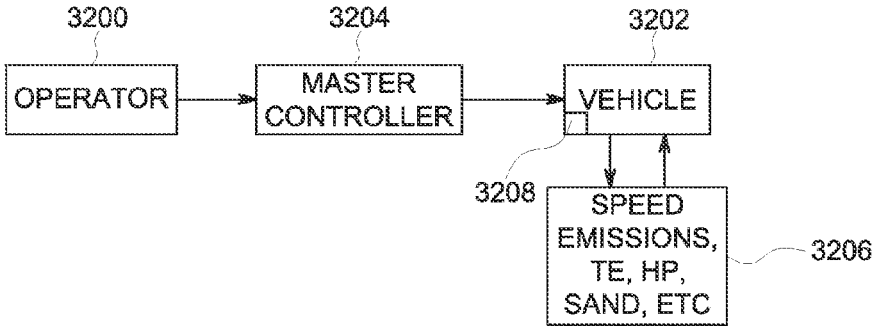
FIG. 32 depicts an example block diagram of how a vehicle (e.g., a rail vehicle) is controlled.

FIG. 32 depicts a block diagram of how a vehicle, such as a rail vehicle, can be controlled. An operator 3200 controls a vehicle 3202 by manually moving a master controller device 3204 to a specific setting. Though a master controller is illustrated, other system controlling devices may be used in place of the master controller device 3204. Therefore, the term master controller is not intended to be a limiting term. The operator 3200 determines the setting or position of the master controller device 2304 based a plurality of factors 3206 including, but not limited to, current speed, desired speed, emission requirements, tractive effect, desired horse power, information provided remotely, and the like. One or more of the factors 3206 may be obtained by a sensor 3208

Returning to the discussion of FIG. 24, a route signal system determines allowable speeds of the vehicle (e.g., a train). There may be many types of track signal systems and the operating rules associated with each of the signals. For example, some signals have a single light (on/off), some signals have a single lens with multiple colors, and some signals have multiple lights and colors. These signals can indicate the route is clear and the vehicle may proceed at a maximum or increased allowable speed. They can also indicate a reduced speed or stop is required. This reduced speed may need to be achieved immediately, or at a certain location (e.g., prior to the next signal or crossing).

The signal status is communicated to the vehicle (e.g., a rail vehicle such as a train) and/or operator of the vehicle through various systems. Some systems have circuits in the route (e.g., the track) and inductive pick-up coils on the powered units of the vehicle. Other systems have wireless communication systems. Signal systems can involve the operator visually inspecting the signal in order to take the appropriate actions.

The signaling system may interface with an on-board signal system on the vehicle and adjust the speed of the vehicle and/or powered unit according to the inputs and the appropriate operating rules. For signal systems that involve the operator visually inspecting the signal status, an operator screen onboard the vehicle can present signal options for the operator to enter based on the location of the vehicle. The type of signal systems and operating rules, expressed as a function of location, may be stored in an onboard database 2800 (shown in FIG. 28) of the vehicle.

Based on specification data that is input, a designated plan (also referred to herein as an optimal plan) which reduces or minimizes fuel use and/or emissions produced by the vehicle subject to speed limit constraints along the route with desired start and end times is computed. The designated plan may reduce the fuel consumed and/or emissions generated by the vehicle over a trip from a starting location to a destination location (and/or one or more intermediate locations) relative to traveling over the same route or portion of a route according to another plan. The designated plan is used to produce a trip profile or a trip plan. The trip profile designates one or more speed and/or power (e.g., notch) settings, brake settings, speeds, or other operational conditions of the vehicle that the vehicle is to follow, expressed as a function of distance and/or time of a trip along a route, and such vehicle operating limits (such as upper or designated (e.g., maximum) notch power and/or brake settings, speed limits as a function of location, and/or expected fuel used and emissions generated by the vehicle. In one embodiment, the value for the notch setting is selected to obtain throttle change decisions about once every 10 to 30 seconds. Alternatively, the throttle change decisions may occur more or less frequently, if needed and/or desired to follow a designated speed profile (e.g., various designated speeds of the vehicle expressed as a function of time and/or distance along a route). The trip profile can provide throttle, power, and/or brake settings (and/or one or more other operational conditions) for the vehicle, either at the vehicle level, consist level and/or powered unit level, as described above. Power comprises braking power, motoring power, and/or air-brake power. In another embodiment, instead of operating at the traditional discrete notch power settings, a continuous power setting may be used for the selected trip profile. Thus, for example, if a trip profile specifies a notch setting of 6.8, the powered unit 2400 can operate at 6.8 instead of operating at notch setting 7. Allowing such intermediate power settings may bring additional efficiency benefits as described below.

The procedure used to compute the trip profile can be any number of methods for computing a power sequence that drives the vehicle 2402 to reduce or minimize fuel consumed and/or emissions generated subject to vehicle or powered unit operating and schedule constraints, as summarized below. In some cases, the trip profile may be similar or close enough to one previously determined, owing to similarities between the vehicle configurations, routes to be traversed over the trip, and/or environmental conditions associated with the previously determined trip profile and a new or current trip profile. In these cases, it may be sufficient to look up the previously determined trip profile or driving trajectory within a database 2800 and attempt to use the previously determined trip profile for a current or upcoming trip instead of recalculating or determining a new trip profile. When no previously computed trip profile is suitable, methods to compute a new trip profile can include, but are not limited to, direct calculation of the trip profile using differential equation models which approximate the physics of motion of the vehicle 2402. In one embodiment, the setup can involve selection of a quantitative objective function, such as a weighted sum (e.g., integral) of model variables that correspond to rate of fuel consumption and/or emissions generation, plus a term to penalize excessive throttle variation.

A control formulation is set up to reduce or minimize the quantitative objective function subject to constraints including but not limited to, speed limits and designated minimum and maximum power (throttle) settings. As used herein, a "designated minimum," "designated maximum," "minimum," or "maximum" may not necessarily mean the smallest or largest value, as described above. Instead, these terms may appropriately indicate a value that is smaller or larger, but not necessarily the smallest or largest value, than one or more other potential values. Depending on planning objectives at any time, the problem may be setup flexibly to reduce fuel consumed subject to constraints on emissions and/or speed limits, and/or to reduce emissions generated, subject to constraints on fuel use and/or arrival time. It is also possible to setup, for example, a goal to reduce the total travel time without constraints on total emissions generated and/or fuel consumed where such relaxation of constraints would be permitted or required for the mission (e.g., the trip of the vehicle 2402 over a route from a starting location to a destination location or one or more intermediate locations).

Throughout this document, example equations and objective functions are presented for reducing powered unit (e.g., locomotive) fuel consumption. These equations and functions are for illustration only as other equations and objective functions can be employed to reduce fuel consumption, emissions generated, and/or to otherwise "optimize" other operating parameters of the vehicle 2402 and/or powered units 2400.

Mathematically, the problem to be solved may be stated by one or more relationships. In one embodiment, the basic physics are expressed by:

$$\frac{dx}{dt} = v;\ x(0) = 0.0;\ x(T_f) = D \quad \text{(Eqn. 1)}$$

$$\frac{dv}{dt} = T_e(u, v) - G_a(x) - R(v);\ v(0) = 0.0;\ v(T_f) = 0.0 \quad \text{(Eqn. 2)}$$

where x represents the position of the vehicle 2402 or powered unit 2400, v represents a velocity of the vehicle 2402 or powered unit 2400, t represents time (expressed in distance along a trip, miles per hour, and minutes or hours as appropriate), and u represents a command input to the vehicle 2402 or powered unit 2400, such as a notch (e.g. throttle) setting. Further, D represents a distance to be traveled, $T_f$ represents a designated or scheduled arrival time at a distance D along the route, $T_e$ represents effort produced by the vehicle 2402 or powered unit 2400 (e.g., tractive effort or braking effort), $G_a$ represents a gravitational drag, which can depend on a size (e.g., length) of the vehicle 2402 or powered unit 2400, makeup (e.g. number, type, size, and the like, of the cars in the vehicle 2402), and/or terrain on which the vehicle 2402 is located, R represents a net speed dependent drag of the vehicle 2402 (e.g., of a locomotive consist and train combination). The initial and final speeds can also be specified, but without loss of generality are taken to be zero here (e.g., representative of the vehicle 2402 being stopped at a beginning and end points of the trip). Finally, the model may be readily modified to include other dynamics such a lag between a change in throttle, u, and a resulting actual change in tractive effort or braking. Using this model, a control formulation may be established to reduce a quantitative objective function subject to constraints including, but not limited to, speed limits and/or designated minimum and maximum power (throttle) settings. Depending on planning objectives at any time, the problem may be setup flexibly to reduce fuel consumed subject to constraints on emissions and speed limits, or to reduce emissions, subject to constraints on fuel use and arrival time.

As another example, a goal may be designated to reduce a total travel time of a trip without constraints on emissions generated and/or fuel consumed where such relaxation of constraints would be permitted or required for the trip or mission. These performance measures can be expressed as a linear combination of one or more expressions or relationships, such as:

$$\min_{u(t)} \int_0^{T_f} F(u(t))\,dt \quad \text{(Eqn. 3)}$$

Reduce Fuel Consumed $$\min_{u(t)} T_f \quad \text{(Eqn. 4)}$$

Reduce Travel Time $$\min_{u_i} \sum_{i=1}^{n_d} (u_i - u_{i=1})^2 \quad \text{(Eqn. 5)}$$

Reduce Notch Jockeying (Piecewise Constant Input)

$$\min_{u(t)} \int_0^{T_f} (du/dt)^2\,dt \quad \text{(Eqn. 6)}$$

Reduce Notch Jockeying (Continuous Input)

The fuel term F may be replaced in Equation 3 with a term corresponding to emissions production. For example, for emissions reduction, the following expression may be used:

$$\min_{u(t)} \int_0^{T_f} E(u(t))\,dt \quad \text{(Eqn. 7)}$$

Reduce Total Emissions Consumption.

In this equation, E represents a quantity of emissions generated in gm/hphr for each of the notches (or power settings). Additionally, a reduction or minimization could be performed based on a weighted total of fuel and emissions.

At least one representative objective function (referred to herein as "OP") may be expressed as $$\min_{u(t)} \alpha_1 \int_0^{T_f} F(u(t))\,dt + \alpha_3 T_f + \alpha_2 \int_0^{T_f} (du/dt)^2\,dt \quad \text{(Eqn. 8)}$$

The coefficients of the linear combination may depend on a relative designated importance (e.g., weight) assigned or given for one or more of the terms. Note that in equation (OP), u(t) may represent the variable that is "optimized" (e.g., increased or decreased), which can be a continuous notch position. If discrete notch is used, e.g., for older powered units (e.g., locomotives), the solution to equation (OP) may be discretized, which can result in reduces fuel savings. Finding a reduced time solution (e.g., setting $\alpha_1$ and $\alpha_2$ to zero) can be used to find a lower bound, and, in at least one embodiment, this can be used to solve the equation (OP) for various values of $T_f$ with $\alpha_3$ set to zero. In one embodiment, it may be necessary to adjoin constraints, e.g., the speed limits along the path $$0 \le v \le SL(x) \quad \text{(Eqn. 9)}$$

or when using minimum or reduced time as the objective, that an end point constraint may hold, e.g., total fuel consumed may be less than what is in the tank of the vehicle 2402 or powered unit 2400, e.g., via $$0 < \int_0^{T_f} F(u(t))dt \le W_F \quad \text{(Eqn. 10)}$$

where $W_F$ represents an amount of fuel remaining in a tank of the vehicle 2402 or powered unit 2400 at $T_f$. The equation (OP) can be in other forms as well, and that what is presented above is an example equation for use in one or more embodiments of the presently described inventive subject matter.

Reference to emissions in the context of an example embodiment of the presently described inventive subject matter may actually be directed towards cumulative emissions produced in the form of oxides of nitrogen (NOx), unburned hydrocarbons, particulates, and the like. By design, the vehicle 2402 and/or powered units 2400 may be subject to regulatory standards, limits, or other requirements (e.g., EPA standards) for emissions (such as brake-specific emissions), and thus when emissions are optimized or reduced in the example embodiment, this could be total emissions for a trip. At all times, operations may be limited to be compliant with federal EPA mandates. If one objective during a trip or mission is to reduce emissions, the optimal control formulation, equation (OP), could be amended to consider this trip objective. One flexibility in the optimization setup is that any or all of the trip objectives can vary by geographic region or mission/trip. For example, for a high priority vehicle 2402, a minimum or designated trip time may be the only objective on one route because the route is associated with high priority traffic. In another example, emission output could vary from state to state along the planned route.

To solve the resulting optimization problem, in an example embodiment, a dynamic optimal control problem in the time domain is transcribed to an equivalent static mathematical programming problem with N decision variables, where the number "N" depends on a frequency at which throttle and/or braking adjustments are made and the duration of the trip. In one or more embodiments, this number N can be in the thousands. For example, suppose a train is traveling a 172-mile stretch of track in the southwest United States. Utilizing the example embodiment, an example 7.6% savings in fuel consumed may be realized when comparing a trip determined and followed using the example embodiment versus an actual driver throttle/speed history where the trip was determined by an operator (and deviates from the determined trip, e.g., the trip profile). The improved fuel savings can be realized because the trip profile may produce a driving strategy with reduced drag loss and/or reduced braking loss compared to operating the vehicle 2402 according to another trip profile or plan. As used herein, a trip plan and a trip profile may both refer to designated operational conditions (e.g., settings or parameters related to control and/or movement of the vehicle) expressed as a function of at least one of time and/or distance along a trip.

Figure 23:
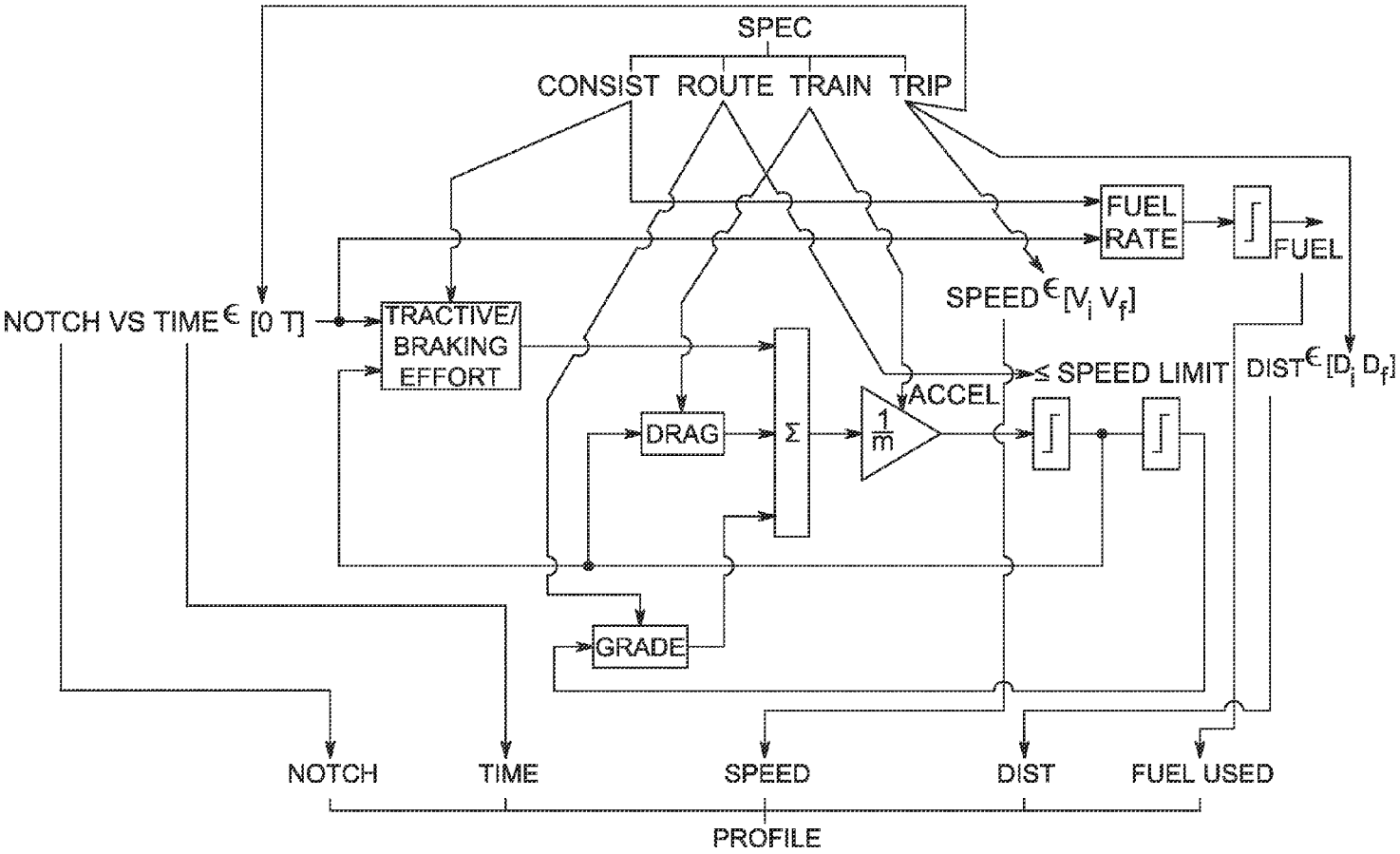
FIG. 23 depicts a model of a vehicle (e.g., a rail vehicle or train) that may be employed in connection with one or more embodiments described herein.

In one embodiment, to make the optimization described above computationally tractable, a simplified model of the vehicle 2402 may be employed, such as illustrated in FIG. 23 and the equations discussed above. One refinement to the trip profile can be produced by driving a more detailed model with a power sequence generated, to test if other thermal, electrical and mechanical constraints are violated, leading to a modified trip profile of speed as a function of distance and/or time that is closer to a run that can be achieved by the vehicle 2402 without harming powered units 2400 or vehicle equipment (e.g., by satisfying additional implied constraints such as thermal and electrical limits on the powered units and/or inter-car forces in the vehicle 2402).

Referring back to FIG. 22, once the trip is started at 2202, power commands are generated at 2204 to put the plan in motion. Depending on the operational set-up of the exemplary embodiment of the present invention, one command is for the powered unit to follow a designated power command at 2206 of the power commands that are generated so as to achieve an optimal or designated speed. One embodiment includes obtaining actual speed and/or power information from the powered unit and/or a consist that includes a powered unit of the vehicle at 2208. Owing to the one or more approximations in the models used for the generating the trip profile, a closed-loop calculation of corrections to optimized power is obtained to track the desired optimal speed. Such corrections of train operating limits can be made automatically or by the operator, who always has ultimate control of the train. For example, one or more actual operational parameters of the vehicle and/or operational unit may be monitored. These actual operational parameters may include the actual power and/or throttle setting being used by the powered unit, the actual brake setting of the powered unit and/or one or more other units or cars of the vehicle, and the like. These actual operational parameters can include the actual speed, actual rate of fuel consumption and/or amount of fuel consumed, actual emissions generated by the powered unit, the vehicle, and/or one or more other units or cars of the vehicle. The actual operational parameters can be compared to the designated settings or conditions of the trip profile. For example, the actual throttle settings, brake settings, speed, rate of fuel consumption, amount of fuel consumed, emissions generated, and the like, can be compared with the throttle settings, brake settings, speed, rate of fuel consumption, amount of fuel consumed, emissions generated, and the like, that is designated by the trip profile. A difference between the actual settings and/or conditions and the designated settings and/or conditions of the trip profile can be determined. A correction to the actual settings and/or conditions may be determined in order to reduce the difference between the actual settings and/or conditions and the designated settings and/or conditions. For example, if the actual throttle setting, brake setting, speed, and the like, is greater or faster than the designated throttle setting, brake setting, speed, and the like, of the trip profile, then the actual throttle setting, brake setting, speed, and the like, may be reduced. This closed-loop correction of the actual operational parameters to more closely match the designated settings and/or conditions of the trip profile may be implemented automatically and/or manually, such as by recommending changes to an operator so that the operator can manually make the changes to the settings.

In some cases, the model of the vehicle that is used in the creation of the trip profile may significantly differ from the actual vehicle. For example, extra cargo pickups or setouts, powered vehicles that fail en route, errors in the database 2800, errors in data entry by the operator, and the like, may cause characteristics of the model of the vehicle upon which the trip profile is based to differ from the actual characteristics of the vehicle. For these reasons, a monitoring system can be used to employ real-time operational data of the vehicle to estimate parameters or characteristics of the powered unit and/or vehicle in real time (e.g., as the vehicle travels) at 2210. The estimated parameters are compared to the assumed parameters that are used when the trip profile is created at 2212. Based on differences between the assumed and estimated values, the trip profile may be re-planned at 2214, should large enough savings accrue from a new trip profile or plan.

The trip profile may be re-planned for one or more other reasons, such as directives from a remote location, such as dispatch and/or the operator requesting a change in objectives to be consistent with more global movement planning objectives. More global movement planning objectives may include, but are not limited to, other vehicle schedules, allowing exhaust to dissipate from a tunnel, maintenance operations, and the like. Another reason may be due to an onboard failure of a component. Strategies for re-planning may be grouped into incremental and major adjustments depending on the severity of the disruption, as discussed in more detail below. In general, a "new" plan may be derived from a solution to the optimization problem equation (OP) described above, but frequently faster approximate solutions can be found, as described herein.

In operation, the powered unit 2400 can continuously or periodically monitor system efficiency and continuously or periodically update the trip plan or trip profile based on the actual efficiency measured, whenever such an update would improve trip performance. Re-planning computations may be carried out entirely within the powered unit(s) and/or vehicles, or fully or partially moved to a remote location, such as dispatch or wayside processing facilities, where wireless technology is used to communicate the plans to the powered units 2400 and/or vehicles. In one embodiment, efficiency trends can be generated and used to develop vehicle fleet data regarding efficiency transfer functions. The fleet-wide data may be used when determining the initial trip plan or trip profile, and may be used for network-wide optimization tradeoff when considering locations of a plurality of vehicles. For example, the travel-time fuel use tradeoff curve shown in FIG. 25 may reflect a capability of a vehicle on a particular route at a current time, updated from ensemble averages collected for many similar vehicles on the same route. Thus, a central dispatch facility collecting curves like FIG. 25 from many vehicles could use that information to better coordinate overall vehicle movements to achieve a system-wide advantage in fuel use or throughput.

Many events in daily operations can lead to a need to generate or modify a currently executing plan, such as a movement plan that dictates or coordinates concurrent movements (e.g., schedules) of several vehicles in a transportation network such as described above, where it is desired to keep the same trip objectives, for when a vehicle is not on schedule for planned movement event (e.g., a meet or pass event) with another vehicle and, for example, the vehicle needs to make up time. Using the actual speed, power, and/or location of the vehicle, a comparison can be made between a planned arrival time and a currently estimated (e.g., predicted) arrival time at 2216. Based on a difference in the times, and/or the difference in parameters (detected or changed by dispatch or the operator), the trip profile can be adjusted at 2218. As one example, this adjustment may be made automatically following a railroad company's desire for how such departures from plan should be handled or manually propose alternatives for the on-board operator and dispatcher to jointly decide the best way to get back on plan. Whenever a plan is updated but where the original objectives, such as but not limited to arrival time, remain the same, additional changes may be factored in concurrently, e.g., new future speed limit changes, which could affect the feasibility of ever recovering the original plan. In such instances, if the original trip profile of a vehicle cannot be maintained, or in other words the vehicle is unable to meet the original trip plan objectives, as discussed herein, other trip plan(s) may be presented to the operator and/or remote facility, or dispatch.

A re-plan of a trip profile for a vehicle may also be made when it is desired to change the original objectives of a previously determined trip profile. Such re-planning can be done at either fixed preplanned times, manually at the discretion of the operator or dispatcher, or autonomously when predefined limits, such as designated vehicle operating limits, are exceeded. For example, if the current execution of a trip profile is running late by more than a specified threshold, such as thirty minutes, the trip profile may be re-planned in one embodiment to accommodate the delay at the expense of increased fuel consumption (as described above) or to alert the operator and dispatcher how much of the time can be made up at all (e.g., what minimum time to go or the maximum fuel that can be saved within a time constraint). Other triggers for re-plan can also be envisioned based on fuel consumed or the health of the powered unit, consist that includes the powered unit, and/or vehicle, including but not limited time of arrival, loss of horsepower due to equipment failure and/or equipment temporary malfunction (such as operating too hot or too cold), and/or detection of gross setup errors, such in the assumed vehicle load. For example, if the change reflects impairment in the performance of the powered unit for a current trip, these may be factored into the models and/or equations used in the creation of a new or updated trip profile.

Changes in plan objectives also can arise from a need to coordinate events where the trip profile for one vehicle compromises the ability of another vehicle to meet objectives and arbitration at a different level, e.g., the dispatch office is required. For example, the coordination of meets and passes may be further optimized through vehicle-to-vehicle communications. Thus, as one example, if a vehicle knows that it is behind schedule in reaching a location for a meet and/or pass with another vehicle, communications from the other vehicle can notify the vehicle train (and/or dispatch). The operator can then enter information pertaining to being late for recalculating the late vehicle's trip profile. Alternatively or additionally, the other vehicle also may re-plan its trip profile based on the late vehicle being late to the meet or pass and/or the re-planning of the late vehicle's trip profile. An example embodiment can also be used at a high level, (e.g., one or more levels above the vehicle level described above, such as the network level) to allow a dispatch to determine which vehicle should slow down or speed up should a scheduled meet and/or pass time constraint may not be met. As discussed herein, this can be accomplished by vehicles transmitting data to the dispatch to prioritize how each vehicle should change its planning objective or trip profile, and/or by vehicle-to-vehicle communication. A choice could depend either from schedule or fuel saving benefits, depending on the situation.

Figure 25:
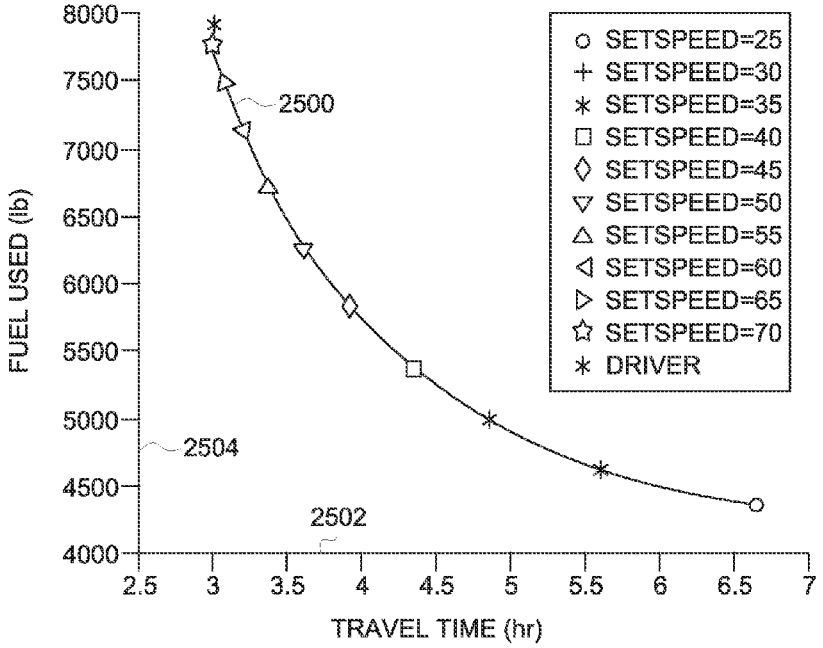
FIG. 25 depicts an example embodiment of a fuel-use/travel time curve.
Figure 26:
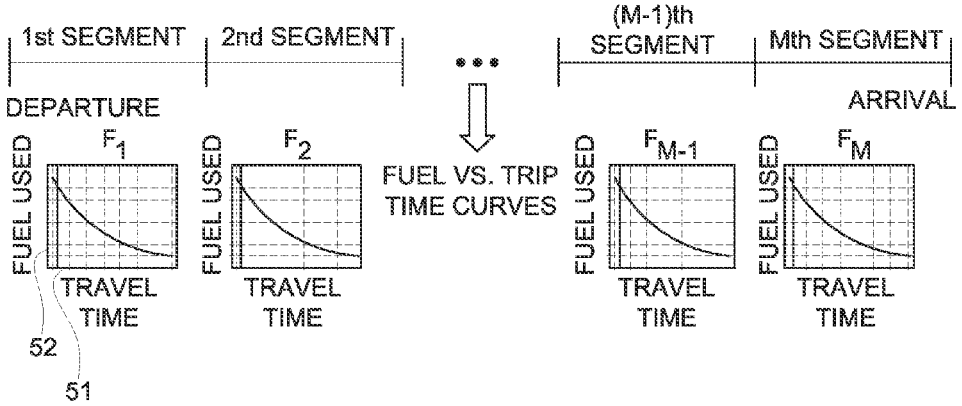
FIG. 26 depicts an example embodiment of segmentation decomposition for trip planning.

For one or more of the manually or automatically initiated re-plans of a trip profile, one example embodiment may present more than one trip profile to the operator of a vehicle. For example, different trip profiles may be presented to the operator, thereby allowing the operator to select the arrival time and understand the corresponding fuel and/or emission impact of the selected arrival time based on the trip profile associated with the selected arrival time. Such information can also be provided to the dispatch for similar consideration, either as a simple list of alternatives or as a plurality of tradeoff curves, such as illustrated in FIG. 25.

One or more changes in the vehicle and/or consist that includes the powered unit can be incorporated either in the current trip profile and/or for future trip profiles. For example, one of the triggers discussed above is loss of horsepower. When building up horsepower over time, either after a loss of horsepower or when beginning a trip, transition logic can be utilized to determine when a desired or designated horsepower is achieved by the vehicle or powered unit. This information can be saved in a vehicle database 2406 disposed onboard the vehicle for use in optimizing either future trips or the current trip should loss of horsepower of the vehicle or powered unit occur again.

FIG. 24 depicts one embodiment of the vehicle 2402 and powered unit 2400 described herein. A locator element or locator device 2408 to determine a location of the vehicle 2402 is provided. The locator element 2408 can be a global positioning system (GPS) sensor, or a system of sensors, that determines a location of the vehicle 2402. Examples of such other systems may include, but are not limited to, wayside devices, such as radio frequency automatic equipment identification (RF AEI) tags, dispatch, and/or video determination. Another system may include the tachometer(s) onboard the powered unit 2400 or other unit 2418 of the vehicle 2402 (e.g., a nonpowered unit that is incapable of self-propulsion, such as a cargo or passenger car) and distance calculations from a reference point. As discussed previously, a wireless communication system 2410 may also be provided to allow for communications between vehicles 2402 and/or with a remote location, such as dispatch. Information about travel locations may also be transferred from other vehicles 2402.

A route characterization element 2412 to provide information about a route, such as grade information, elevation information, curvature information, and the like, also is provided. The route characterization element 2412 may include an onboard route integrity database 2414. Sensors 2416 are used to measure operational characteristics of the vehicle 2402, such as a tractive effort used to move the unit 2418 being hauled by the powered unit 2400 in the vehicle 2402, throttle settings of the powered unit 2400, configuration information of the vehicle 2400 (such as configuration information of a consist that includes the powered unit 2400), speed of the vehicle 2402, individual configuration of the powered unit 2400, individual capability of the powered unit 2400, and the like. In one example embodiment, the configuration information may be loaded without the use of a sensor 2416, but is input by other approaches, as discussed above. Furthermore, the health or other limitations of the powered units 2400 (although a single powered unit 2400 is shown in the vehicle 2402 of FIG. 24, additional powered units 2400 also may be provided) in the consist may also be considered. For example, if one or more powered units 2400 in the consist are unable to operate above a designated power notch level (such as level 5), this information can be used when creating the trip profile for the vehicle 2402.

Information from the locator element 2408 may also be used to determine an appropriate arrival time of the vehicle 2402. For example, if there is a vehicle 2402 moving along a route 2418 toward a destination and no vehicle is following behind it, and the vehicle 2402 has no fixed arrival deadline to adhere to, the locator element 2408, including but not limited to radio frequency automatic equipment identification (RF AEI) tags, dispatch, and/or video determination, may be used to gage the exact location of the vehicle 2402. Furthermore, inputs from these signaling systems may be used to adjust the speed of the vehicle 2402 based on the location. Using the on-board route database 2414, discussed below, and the locator element 2408, an example embodiment can adjust the operator interface to reflect the signaling system state at the given location of the vehicle 2402. In a situation where signal states would indicate restrictive speeds ahead, a trip planner device 2806 (shown in FIG. 28, which can create and/or implement a trip profile) may elect to slow the vehicle 2402 to conserve fuel consumption.

Information from the locator element 2408 may also be used to change planning objectives for the trip profile as a function of distance to destination. For example, owing to uncertainties about congestion along the route, "faster" time objectives on the early part of a route may be employed as hedge against delays that statistically occur later. If it happens on a particular trip that these delays do not occur, the objectives on a latter part of the journey can be modified to exploit the resultant built-in slack time that was banked earlier, and thereby recovering some fuel efficiency. A similar strategy could be invoked with respect to emissions restrictive objectives, e.g., approaching an urban area.

As one example of such as hedging strategy, if a trip is planned from New York to Chicago, the system may have an option to operate the vehicle 2402 slower at one or more stages of the trip, such as the beginning of the trip, the middle of the trip, and/or the end of the trip. The trip profile may be generated to allow for slower operation or movement of the vehicle 2402 at the end of the trip since unknown constraints, such as but not limited to weather conditions, track maintenance, and the like, may develop and become known during the trip. As another consideration, if traditionally congested areas are known, the trip profile can be developed with an option to have more flexibility around these traditionally congested regions. Therefore, one example embodiment may also consider weighting and/or penalties in connection with one or more characteristics, parameters, and the like, upon which the trip profile is based when forming the trip profile as a function of time and/or distance into the future and/or based on known and/or past experience. The term "as a function of time and/or distance" (and derivations thereof) may refer to the operational settings of the trip plan or trip profile being different as the vehicle travels, but may not necessarily be based on, or calculated as a function of, time and/or distance along the route(s). Such planning and re-planning of trip profiles may take into consideration weather conditions, route conditions, other vehicles on the route, and the like, may take into consideration at any time during the trip wherein the trip profile is adjusted accordingly.

FIG. 24 further discloses other elements that may be part of one example embodiment. A processor 2420 is provided that is operable to receive information from the locator element 2408, route characterizing element 2412, and/or sensors 2416. A tangible and non-transitory computer readable storage medium (such as a computer memory) 2422 may store one or more algorithms (e.g., software applications and/or systems) that direct the processor 2420 to perform one or more operations described herein. The one or more algorithms may be used to compute the trip profiles described herein based on parameters involving the powered unit 2400, vehicle 2402, route 2418, objectives of the trip or mission of the vehicle 2402, and the like, as described above. In one embodiment, the trip profile is established based on models for train behavior as the vehicle 2402 moves along the route 2418 as a solution of non-linear differential equations derived from physics with simplifying assumptions that are provided in the one or more algorithms. The algorithms may have access to the information from the locator element 2408, route characterizing element 2412, and/or sensors 2416 to create a trip profile that reduces fuel consumption of the vehicle 2402 and/or powered unit 2400, reduces emissions generated by the vehicle 2402 and/or powered unit 2400, establishes a desired trip time, and/or ensures proper crew operating time aboard the vehicle 2402, as described above. In one embodiment, a driver, or controller element, 2424 also is provided. As discussed herein, the controller element 2424 can be used for controlling the vehicle 2402 as the vehicle 2402 follows the trip profile. In one example embodiment discussed further herein, the controller element 2424 makes operating decisions based on the trip profile autonomously. In another embodiment, the operator may be involved with directing the vehicle 2402 to follow the trip profile. For example, the controller element 2424 may present the operator with directions on how to control the vehicle 2402 to follow the trip profile. The operator may then control the vehicle 2402 in response thereto.

The trip profile may be created and/or modified relatively quickly while the vehicle is traveling according to the trip profile (e.g., "on the fly"). This can include creating the initial plan when a long distance is involved, owing to the complexity of the algorithm. When a total length of a trip profile exceeds a given distance, algorithm (e.g., stored on medium 2422) may be used to segment the mission or trip wherein the mission or trip may be divided by waypoints or other locations. Though only a single algorithm and a single medium 2422 are discussed, more than one algorithm and/or medium 2422 may be used where the algorithms and/or media may be connected together. The waypoint may include natural locations where the vehicle 2402 stops, such as, but not limited to, sidings where a meet with opposing traffic, or pass with a vehicle behind the current vehicle is scheduled to occur on single-track route or rail, or at yard sidings or industry where cars are to be picked up and set out, and locations of planned work. At such waypoints, the vehicle 2402 may be scheduled to be at the location at a scheduled time and be stopped or moving with speed in a specified range. The time duration from arrival to departure at waypoints can be called dwell time.

In an example embodiment, a longer trip can be broken down into smaller segments in a systematic way. Each segment can be somewhat arbitrary in length, but can be picked at a natural location such as a stop or significant speed restriction, or at mileposts that define junctions with other routes. Given a partition, or segment, a driving profile is created for one or more of the segments of the route as a function of travel time taken as an independent variable, such as shown in FIG. 25. The fuel used/travel-time tradeoff associated with each segment can be computed prior to the vehicle 2402 reaching that segment of track. A total trip plan or profile can be created from the driving profiles created for each segment. Travel time can be distributed among the segments of the trip in way so that a designated or predetermined (e.g., scheduled) total trip time is satisfied while the fuel consumed and/or emissions generated over the trip is reduced relative to traveling over one or more of the segments according to another plan or profile. An exemplary three segment trip is disclosed in FIG. 27 and discussed below. Those skilled in the art will recognize however, through segments are discussed, the trip plan may comprise a single segment representing the complete trip.

FIG. 25 depicts an example embodiment of a fuel-use/travel time curve 2500. As mentioned previously, such a curve 2500 is created when calculating trip profile for various travel times for one or more segments of a trip. In one embodiment, for a given travel time 2502, fuel used 2504 by the vehicle 2402 is the result of a detailed driving profile computed as described above. Once travel times for one or more segments are allocated, a power and/or speed plan can be determined for the one or more segments from previously computed solutions. If there are waypoint constraints on speed between segments, such as, but not limited to, a change in a speed limit, the constraints can be matched up or accounted for during creation of the trip profile. If speed restrictions change in only a single segment, the fuel use/travel-time curve 2500 can be re-computed for only the segment changed. This can reduce time for having to re-calculate more parts, or segments, of the trip. If the consist or vehicle changes significantly along the route, e.g., from loss of a powered unit or pickup or set-out of cars, then driving profiles for subsequent segments may be recomputed to create new instances of the curve 2500. These new curves 2500 can then be used along with new schedule objectives to plan the remaining trip.

Once a trip plan or profile is created, a trajectory of speed, braking, and/or power versus distance and/or time can be used to reach a destination with reduced fuel consumption and/or emission generation at the scheduled or designated trip time. There are several ways in which to execute the trip profile. As provided below, in one example embodiment, a coaching mode displays information to the operator for the operator to follow to achieve the operating parameters, information, or conditions (e.g., power, brake settings, throttle settings, speeds, and the like) that are designated by the trip profile. In this mode, the operating information is suggested operating conditions that the operator should use in manually operating the vehicle. In another embodiment, acceleration and maintaining a constant speed are performed. However, when the vehicle 2402 is slowed, the operator may be responsible for applying a braking system 2428. In another embodiment, commands specific to power and braking as required to follow the desired speed-distance path are provided to the operator.

Alternatively, the trip profile may be automatically implemented. For example, the processor 2420 can generate commands used to control movement of the vehicle 2402 based on the trip profile. The processor 2420 can create commands that control operation of the propulsion components (e.g., the motors, brakes, and the like) of the vehicle 2402 based on the trip profile and the location or time along the trip. These commands can automatically match the output of the propulsion components to match the designated settings (e.g., throttle settings, brake settings, speed, power output, and the like) of the trip profile.

Feedback control strategies can be used to provide corrections to the actual operational parameters and the operational conditions designated by the trip profile. For example, in a closed-loop control system of the vehicle 2402, the actual throttle settings, brake settings, speed, emissions output, power output, and the like, of the vehicle may be compared with the designated throttle settings, brake settings, speed, emissions output, power output, and the like, of the trip profile. A difference between the actual and designated operational conditions or settings may be determined at one or more locations and/or at one or more times of the trip. The difference may be examined to determine if corrective action is to be taken. For example, the difference can be compared to a designated threshold. If the difference exceeds the threshold, then the processor 2420 can generate commands to direct one or more components of the vehicle 2402 to change settings and/or output to reduce the difference and/or otherwise cause the actual operational parameter to move closer to the designated operational condition of the trip profile. For example, if the vehicle 2402 is traveling at speeds much faster than the designated speeds of the trip profile, then the processor 2420 may change the throttle settings and/or brake settings to slow down the vehicle 2402 to more closely match the designated speeds.

Feedback control strategies also can be used to provide corrections to power control sequence in the trip profile to correct for such events as, but not limited to, vehicle load variations caused by fluctuating head winds and/or tail winds. Another such error may be caused by an error in vehicle parameters, such as, but not limited to, vehicle mass and/or drag, when compared to assumptions in the trip profile. A third type of error may occur with information contained in the route database 2414. Another possible error may involve un-modeled performance differences due to the powered unit engine, traction motor thermal duration, and/or other factors. In another embodiment, feedback control strategies can involve comparing the actual speed (or other designated operating condition or parameter) as a function of position to the designated speed in the trip profile. Based on this difference, a correction to the trip profile can be added to drive the actual operational condition or parameter of the vehicle toward the operational condition or parameter designated by the trip profile. To assure stable regulation, a compensation algorithm may be provided which filters the feedback speeds into power corrections to assure closed-performance stability is assured. Compensation may include standard dynamic compensation to meet performance objectives.

At least one embodiment accommodates changes in trip objectives. In an example embodiment, to determine a fuel-optimal trip from point A to point B where there are stops along the way, and for updating the trip for the remainder of the trip once the trip has begun, a sub-optimal decomposition method is usable for finding an optimal trip profile. Using modeling methods, the computation method can find the trip plan with specified travel time and initial and final speeds, so as to satisfy the speed limits and powered unit capability constraints when there are stops. Though the following discussion is directed toward improving (e.g., decreasing) fuel use, the discussion also can be applied to improve other factors, such as, but not limited to, emissions (e.g., reducing emissions generated), schedule (e.g., keeping the vehicle on schedule), crew comfort (e.g., reducing overly long or overtime work days), and/or load impact. The method may be used at the outset in developing a trip plan, and/or to adapting to changes in objectives after initiating a trip. For example, the trip plan or profile may be altered during movement of the vehicle in the trip. The trip plan or profile may be re-planned when one or more differences between actual operational parameters of the vehicle and the designated operational conditions of the vehicle become too large.

Figure 27:
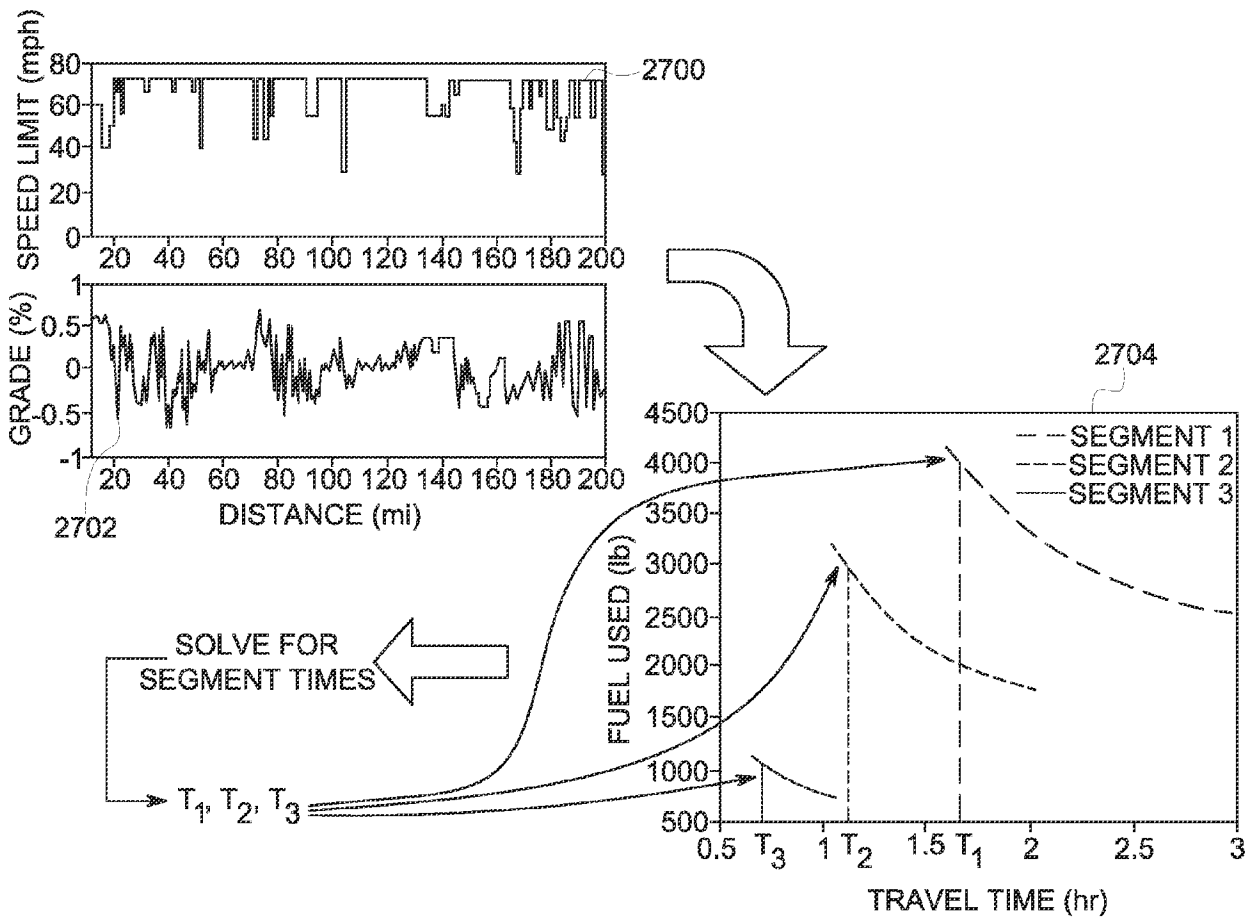
FIG. 27 depicts one embodiment of a segmentation example.
Figure 28:
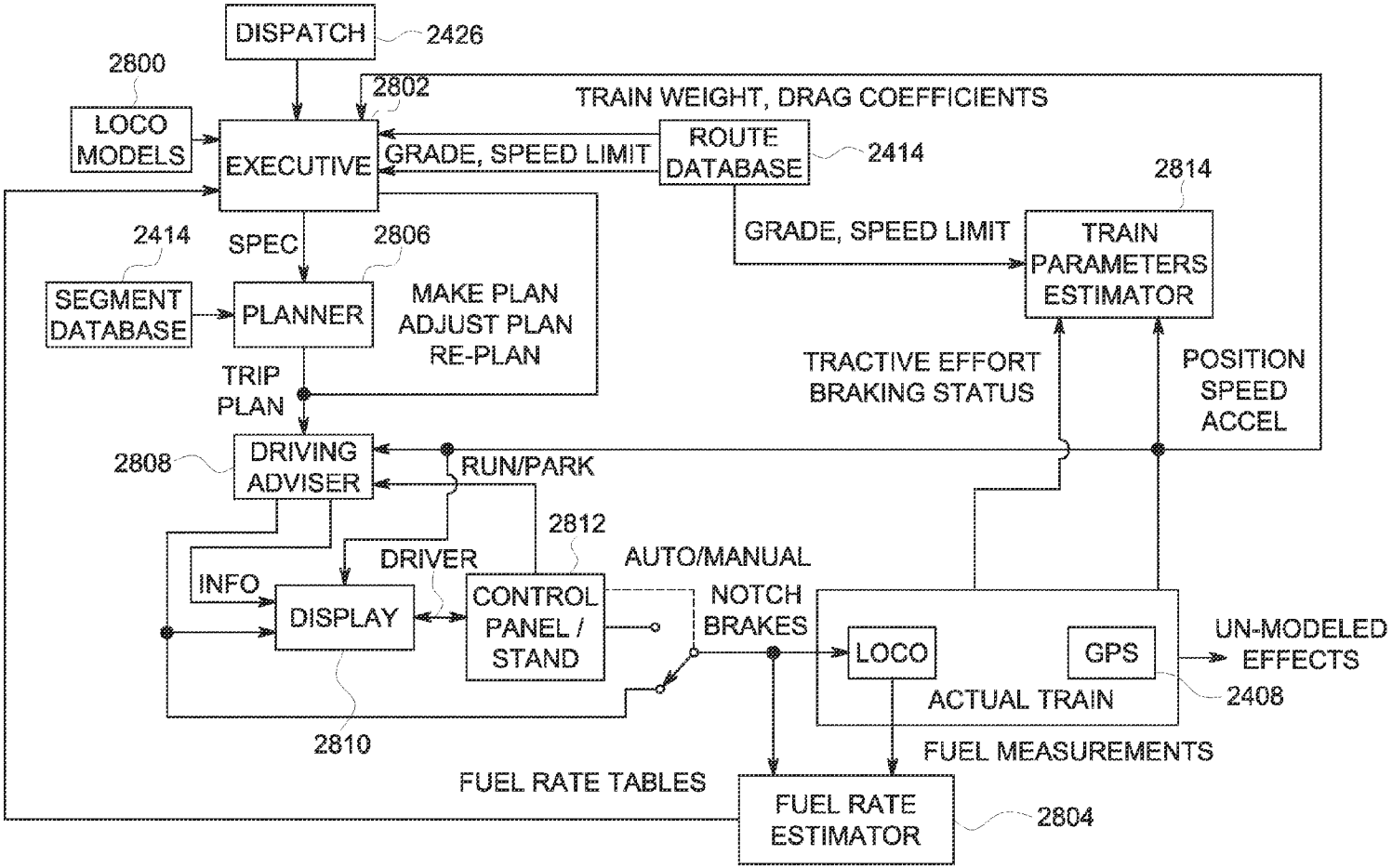
FIG. 28 depicts an example flow chart of one embodiment of the presently described subject matter.

As discussed herein, an example embodiment may employ a setup as illustrated in the flow chart depicted in FIG. 28, and as an exemplary three segment example depicted in detail in FIG. 27. As illustrated, the trip may be broken into two or more segments, T1, T2, and T3. Though as discussed herein, it is possible to consider the trip as a single segment. As discussed herein, the segment boundaries may not result in equal segments. Instead, the segments may use natural or mission specific boundaries. Trip plans can be pre-computed for each segment. If fuel use versus trip time is the trip objective to be met, fuel versus trip time curves are built for each segment. As discussed herein, the curves may be based on other factors, wherein the factors are objectives to be met with a trip plan. When trip time is the parameter being determined, trip time for each segment is computed while satisfying the overall trip time constraints. FIG. 27 illustrates speed limits 2700 for an exemplary three segment, two hundred mile long trip. Further illustrated are grade changes 2702 over the trip. A combined chart 2704 illustrating curves for each segment of the trip of fuel used over the travel time also is shown.

Using the control setup described previously, the present computation method can find the trip plan with specified travel time and initial and final speeds, so as to satisfy the speed limits and powered unit capability constraints when there are stops. Though the following detailed discussion is directed towards reducing fuel use, the discussion can also be applied to improve other factors as discussed herein, such as, but not limited to, reducing the generation of emissions. One flexibility is to accommodate desired dwell times at stops and to consider constraints on earliest arrival and departure at a location as may be required, for example, in single-track operations where the time to be in or get by a siding can impact the travel of one or more other vehicles.

One example embodiment finds a fuel-optimal trip from distance $D_0$ to $D_M$, traveled in time T, with M−1 intermediate stops at $D_1, \ldots, D_{m-1}$, and with the arrival and departure times at these stops constrained by:

$$t_{min}(i) \le t_{arr}(D_i) \le t_{max}(i) - \Delta t_i \quad \text{(Eqn. 11)}$$

$$t_{arr}(D_i) + \Delta t_i \le t_{dep}(D_i) \le t_{max}(i) \; i = 1, \ldots, M-1 \quad \text{(Eqn. 12)}$$

where $t_{arr}(D_i)$, $t_{dep}(D_i)$, and $\Delta t_i$ represent the arrival, departure, and minimum or designated stop time at the $i^{th}$ stop, respectively. Assuming that fuel-optimality implies reducing stop time, therefore $t_{dep}(D_i) = t_{arr}(D_i) + \Delta t_i$ which eliminates the second inequality above, in one embodiment. Suppose for each i=1, . . . , M, the fuel-optimal trip from $D_{i-1}$ to $D_i$ for travel time t, $T_{min}(i) \le t \le T_{max(i)}$, is known. Let $F_i(t)$ be the fuel-use corresponding to this trip. If the travel time from $D_{j-1}$ to $D_j$ is denoted $T_j$, then the arrival time at $D_i$ may be given by:

$$t_{arr}(D_i) = \sum_{j=1}^{i} (T_j + \Delta t_{j-1}) \quad \text{(Eqn. 13)}$$

where $\Delta t_0$ is defined to be zero. The fuel-optimal trip from $D_0$ to $D_M$ for travel time T can then be obtained by finding $T_i$, i=1, . . . , M, which reduces $$\sum_{i=1}^{M} F_i(T_i)T_{min}(i) \le T_i \le T_{max}(i) \quad \text{(Eqn. 14)}$$

subject to $$t_{min}(i) \le \sum_{j=1}^{i} (T_j + \Delta t_{j-1}) \le t_{max}(i) - \Delta t_i \quad \text{(Eqn. 15)}$$

$$i = 1, \ldots, M-1$$

$$\sum_{j=1}^{M} (T_j + \Delta t_{j-1}) = T \quad \text{(Eqn. 16)}$$

Once a trip is underway, the issue is re-determining the fuel-optimal solution for the remainder of a trip (originally from $D_0$ to $D_M$ in time T) as the trip is traveled, but where disturbances preclude following the fuel-optimal solution. Let the current distance and speed be x and v, respectively, where $D_{i-1}<x\le D_i$.

Also, let the current time since the beginning of the trip be $t_{act}$. Then the fuel-optimal solution for the remainder of the trip from x to $D_M$, which retains the original arrival time at $D_M$, is obtained by finding $\tilde{T}_i$, $T_j$, j=i+1, . . . M, which reduces $$\tilde{F}_i(\tilde{T}_i, x, v) + \sum_{j=i+1}^{M} F_j(T_j) \quad \text{(Eqn. 17)}$$

subject to $$t_{min}(i) \le t_{act} + \tilde{T}_i \le t_{max}(i) - \Delta t_i \quad \text{(Eqn. 18)}$$

$$t_{min}(k) \le t_{act} + \tilde{T}_i + \sum_{j=i+1}^{k} (T_j + \Delta t_{j-1}) \le t_{max}(k) - \Delta t_k \quad \text{(Eqn. 19)}$$

$$k = i+1, \ldots, M-1 \quad \text{(Eqn. 20)}$$

$$t_{act} + \tilde{T}_i + \sum_{j=i+1}^{M} (T_j + \Delta t_{j-1}) = T \quad \text{(Eqn. 21)}$$

Here, $\tilde{F}_i(t,x,v)$ represents the fuel-used of the optimal trip from x to $D_i$, traveled in time t, with initial speed at x of v.

As discussed above, one example way to enable more efficient re-planning is to construct the optimal solution for a stop-to-stop trip from partitioned segments. For the trip from $D_{i-1}$ to $D_i$, with travel time $T_i$, choose a set of intermediate points $D_{ij}$, j=1, . . . , $N_{i-1}$. Let $D_{i0}=D_{i-1}$ and $D_{iN_i}=D_i$. Then express the fuel-use for the optimal trip from $D_{i-1}$ to $D_i$ as $$F_i(t) = \sum_{j=1}^{N_i} f_{ij}(t_{ij} - t_{i,j-1}, v_{i,j-1}, v_{ij}) \quad \text{(Eqn. 22)}$$

where $f_{ij}(t, v_{ij-1}, v_{ij})$ is the fuel-use for the optimal trip from $D_{i,j-1}$ to $D_{ij}$, traveled in time t, with initial and final speeds of $v_{i,j-1}$ and $v_{ij}$. Furthermore, $t_{ij}$ represents the time in the optimal trip corresponding to distance $D_{ij}$. By definition, $t_{iN_i}-t_{i0}=T_i$. Since the train is stopped at $D_{iO}$, and $D_{iN_i}$, $V_{iO}=V_{iN_i}=0$.

The above expression enables the function $f_{ij}(t)$ to be alternatively determined by first determining the functions $f_{ij}(\bullet)$, $1\le j\le N_i$, then finding and $\tau_{ij}$, $1\le j\le N_i$ and $v_{ij}$, $1\le j\le N_i$, which reduce $$F_i(t) = \sum_{j=1}^{N_i} f_{ij}(\tau_{ij}, v_{i,j-1}, v_{ij}) \quad \text{(Eqn. 23)}$$

subject to $$\sum_{j=1}^{N_i} \tau_{ij} = T_i \quad \text{(Eqn. 24)}$$

$$v_{min}(i, j) \le v_{ij} \le v_{max}(i, j) \quad j = 1, \ldots, N_i - 1 \quad \text{(Eqn. 25)}$$

$$v_{i0} = v_{iN_i} = 0 \quad \text{(Eqn. 26)}$$

By choosing $D_{ij}$ (e.g., at speed restrictions or meeting points), $v_{max}(i, j)-v_{min}(i, j)$ can be reduced or minimized, thus reducing or minimizing the domain over which $f_{ij}()$ is to be known.

Based on the partitioning above, another suboptimal re-planning approach includes restricting re-planning to times when the train is at distance points $D_{ij}$, $1\le i\le M$, $1\le j\le N_i$. At point $D_{ij}$, the new optimal trip from $D_{ij}$ to $D_M$ can be determined by finding $\tau_{ik}$, $j<k\le N_i$, $v_{ik}$, $j<k<N_i$, and $\tau_{mn}$, $i<m\le M$, $1\le n\le N_m$, $v_{mn}$, $i<m\le M$, $1\le n<N_m$, which reduces or minimizes $$\sum_{k=j+1}^{N_i} f_{ik}(\tau_{ik}, v_{i,k-1}, v_{ik}) + \sum_{m=i+1}^{M} \sum_{n=1}^{N_m} f_{mn}(\tau_{mn}, v_{m,n-1}, v_{mn}) \quad \text{(Eqn. 27)}$$

subject to $$t_{min}(i) \le t_{act} + \sum_{k=j+1}^{N_i} \tau_{ik} \le t_{max}(i) - \Delta t_i \quad \text{(Eqn. 28)}$$

$$t_{min}(n) \le t_{act} + \sum_{k=j+1}^{N_i} \tau_{ik} + \sum_{m=i+1}^{n} (T_m + \Delta t_{m-1}) \le t_{max}(n) - \Delta t_n \quad \text{(Eqn. 29)}$$

$$n = 1+1, \ldots, M-1 \quad \text{(Eqn. 30)}$$

$$t_{act} + \sum_{k=j+1}^{N_i} \tau_{ik} + \sum_{m=i+1}^{M} (T_m + \Delta t_{m-1}) = T \quad \text{(Eqn. 31)}$$

where $$T_m = \sum_{n=1}^{N_m} \tau_{mn} \quad \text{(Eqn. 32)}$$

A further simplification is obtained by waiting on the re-computation of $T_m$, $i<m\le M$, until distance point $D_i$ is reached. In this way, at points $D_{ij}$ between $D_{i-1}$ and $D_i$, the reduction or minimization above may only be performed over $\tau_{ik}$, $j<k\le N_i$, $v_{ik}$, $j<k\le N_i$. $T_i$ is increased as needed to accommodate any longer actual travel time from $D_{i-1}$ to $D_{ij}$ than planned. This increase can be later compensated, if possible, by the re-computation of $T_m$, $i<m\le M$, at distance point $D_i$.

With respect to the closed-loop configuration disclosed above, the total input energy required to move a train 2402 from point A to point B can include a sum of components, such as four components (or a different number of components). In one embodiment, these components include a difference in kinetic energy between points A and B; a difference in potential energy between points A and B; an energy loss due to friction and other drag losses; and energy dissipated by the application of brakes. Assuming the start and end speeds to be equal (e.g., stationary), the first component is zero. Furthermore, the second component is independent of driving strategy. Thus, it suffices to minimize or reduce the sum of the last two components.

Following a constant speed profile can reduce or minimize drag loss. Following a constant speed profile also can reduce or minimize total energy input when braking is not needed to maintain constant speed. However, if braking is required to maintain constant speed, applying braking just to maintain constant speed can increase total required energy because of the need to replenish the energy dissipated by the brakes. A possibility exists that some braking may actually reduce total energy usage if the additional brake loss is more than offset by the resultant decrease in drag loss caused by braking, by reducing speed variation.

After completing a re-plan from the collection of events described above, the new trip profile or plan can be followed using the closed loop control described herein. However, in some situations there may not be enough time to carry out the segment decomposed planning described above, and particularly when there are critical speed restrictions that must be respected, an alternative may be needed. One example embodiment of the presently described inventive subject matter accomplishes this with an algorithm referred to as "smart cruise control"." The smart cruise control algorithm can be stored on the medium 2422 and/or on a medium disposed off-board the vehicle 2402. The algorithm can provide an efficient way to generate, on the fly, an energy-efficient (e.g., fuel-efficient) sub-optimal prescription for operating the vehicle 2402 over a route. This algorithm may assume knowledge of the position of the vehicle 2402 along the route 2418 at one or more times (or all times), as well as knowledge of the grade and/or curvature of the route 2418 versus position. The algorithm can rely on a point-mass model for the motion of the vehicle 2402, whose parameters may be adaptively estimated from online measurements of vehicle motion as described earlier.

The smart cruise control algorithm includes several functional components in one embodiment, such as a modified speed limit profile generator that serves as an energy-efficient guide around speed limit reductions; a throttle or dynamic brake setting profile generator that attempts to balance between reducing speed variation and braking; and a combination mechanism for combining the latter two components to produce a notch command, while employing a speed feedback loop to compensate for mismatches of modeled parameters when compared to reality parameters (e.g., a closed-loop control system such as described herein). The smart cruise control algorithm can accommodate strategies in the example embodiments described herein that do no active braking (e.g., the driver of the vehicle 2402 is signaled and assumed to provide the requisite braking) or a variant that does active braking.

With respect to the cruise control algorithm that does not control dynamic braking, the algorithm may include functional components such as a modified speed limit profile generator that serves as an energy-efficient guide around speed limit reductions, a notification signal generator directed to notify the operator when braking should be applied, a throttle profile generator that attempts to balance between reducing speed variations and notifying the operator to apply braking, a mechanism employing a feedback loop to compensate for mismatches of model parameters to reality parameters (e.g., similar to the closed-loop control system described herein).

Also included in one example embodiment is an approach to identify parameter values of the vehicle 2402. For example, with respect to estimating vehicle mass, a Kalman filter and/or a recursive least-squares approach may be utilized to detect errors in the estimated mass that may develop over time.

FIG. 28 depicts an example flow chart of one example embodiment of the presently described inventive subject matter. As discussed previously, a remote facility, such as a dispatch 2426, can provide information to an executive control element 62. Also supplied to the executive control element 2802 is locomotive modeling information database 2800, information from a route database 2414 such as, but not limited to, route grade information and speed limit information, estimated vehicle parameters such as, but not limited to, vehicle weight and drag coefficients, and fuel rate tables from a fuel rate estimator system 2804. The executive control element 2802 supplies information to a trip planner device 2806, which also is described in FIG. 22. For example, the trip planner device 2806 may include a system (e.g., having a processor, controller, control unit, and the like, that operates based on one or more sets of instructions, such as software code, stored on a tangible computer readable storage medium to perform one or more of the operations described in connection with FIG. 22). Once a trip plan or trip profile has been calculated by the trip planner device 2806, the plan is supplied to a driving advisor, driver, or controller element 2808. The trip plan also can be supplied to the executive control element 2802 so that the executive control element 2802 can compare the trip plan when other new data is provided.

As discussed above, the driving advisor 2808 can automatically control operations of the vehicle 2402 based on the trip profile, such as by automatically setting or establishing a notch power, throttle setting, brake setting, and the like, of the vehicle 2402. The operational setting that is controlled by the driving advisory 2808 may be a pre-established notch setting or an optimum continuous notch setting. A display 2810 is provided so that the operator can view what the planner 2806 has recommended. For example, the planner 2806 may present the operational settings designated by the trip profile to the operator on the display 2810 so that the operator can manually implement the designated operational settings. The operator also has access to a control panel 2812. Through the control panel 2812, the operator can decide whether to apply the operational setting designated by the trip profile. Toward this end, the operator may limit a targeted or recommended operational setting of the vehicle 2402, such as power. For example, in one embodiment, at any time the operator always has final authority over what operational setting the vehicle consist will operate at. This includes deciding whether to apply braking if the trip profile recommends slowing the vehicle 2402. For example, if operating in dark territory, or where information from wayside equipment cannot electronically transmit information to the vehicle 2402 and instead the operator views visual signals from the wayside equipment, the operator inputs commands based on information contained in the route database 2414 and visual signals from the wayside equipment. Based on how the vehicle 2402 is functioning, information regarding fuel measurement is supplied to the fuel rate estimator 2804. Since direct measurement of fuel flows may not be available in a vehicle consist, the information on fuel consumed so far during a trip and projections into the future following trip plans can be carried out using calibrated physics models such as those used in developing the trip plans. For example, such predictions may include but are not limited to, the use of measured gross horsepower and known fuel characteristics to derive the cumulative fuel used.

The vehicle 2402 also has the locator device 2408 such as a GPS sensor, as discussed above. Information is supplied to a vehicle parameters estimator system 2814. Such information may include, but is not limited to, GPS sensor data, tractive/braking effort data, braking status data, speed, changes in speed data, and the like. With information regarding grade and speed limit information, vehicle weight, drag coefficients, and the like, information is supplied to the executive control element 2802.

One example embodiment may also allow for the use of continuously variable power throughout the trip planning and/or closed loop control implementation. In a powered unit 2400, such as a locomotive, power may be quantized to discrete levels, such as eight discrete levels. Some powered units 2400 can realize continuous variation in horsepower which may be incorporated into the previously described optimization methods. With continuous power, the powered unit 2400 can further improve operating conditions, e.g., by reducing auxiliary loads and power transmission losses, fine tuning engine horsepower regions of increased efficiency, or to points of increased emissions margins. Examples include, but are not limited to, reducing cooling system losses, adjusting alternator voltages, adjusting engine speeds, and/or reducing number of powered axles. Further, the powered unit 2400 may use the on-board route database 2414 and the forecasted performance requirements to reduce auxiliary loads and power transmission losses to provide increased efficiency for the target fuel consumption/emissions dictated by the trip profile. Examples include, but are not limited to, reducing a number of powered axles on flat terrain and/or pre-cooling the engine of the powered unit 2400 prior to entering a ventilation-restricted space, such as a tunnel.

At least one example embodiment also may use the on-board route database 2414 and the forecasted performance to adjust the performance of the powered unit 2400, such as to insure that the vehicle 2402 has sufficient speed as the vehicle 2402 approaches a hill and/or tunnel in order to crest the hill and/or travel through the tunnel. For example, this could be expressed as a speed constraint at a particular location that becomes part of the trip plan generation created solving the equation (OP). Additionally, the example embodiment may incorporate vehicle-handling rules, such as, but not limited to, tractive effort ramp rates, maximum or upper designated braking effort ramp rates, and the like, that may be used with one or more types of vehicles, such as trains. These may incorporated directly into the formulation for generating the trip profile or alternatively incorporated into the closed loop control system used to control power application to achieve the target speed or other operational settings designated by the trip profile.

In one embodiment of the presently described inventive subject matter, the components used to generate and/or implement the trip profile may only be disposed or installed on a lead powered unit of the vehicle consist, such as a lead locomotive. Even though one or more embodiments described herein may not be dependent on data or interactions with other powered units (e.g., locomotives), it may be integrated with consist manager functionality, as disclosed in U.S. Pat. No. 6,691,957 and/or U.S. Pat. No. 7,021,588 (both of which are incorporated by reference) and/or consist optimizer functionality to improve efficiency. Interaction with multiple vehicles is not precluded as illustrated by the example of dispatch arbitrating two "independently optimized" vehicles described herein.

Vehicles with distributed power systems can be operated in different modes. One mode can include all powered units in the vehicle operating at the same notch command or operational setting. For example, if a lead powered unit (e.g., a lead locomotive) is commanding motoring at a notch level of N8, all powered units in the vehicle may be commanded to generate motoring at the same notch level of N8. Another mode of operation may include "independent" control. In this mode, powered units (e.g., locomotives) or sets of powered units distributed throughout the vehicle can be operated at different operational settings (e.g., motoring or braking powers) in order to achieve the designated operational setting or condition of a trip profile (e.g., a speed, tractive effort, braking effort, power output, and the like, of the vehicle). For example, as a vehicle (e.g., a train) crests a mountaintop, the lead powered units (such as lead locomotives on the down slope of the mountain) may be placed in braking, while the powered units in the middle or at the end of the vehicle (e.g., on the up slope of mountain) may be in motoring. This can be done to reduce tensile forces on the mechanical couplers that connect the nonpowered units (e.g., the railcars) and the powered units (e.g., the locomotives). Traditionally, operating the distributed power system in "independent" mode involved the operator manually commanding each remote powered unit or set of powered units via a display in the lead powered unit. Using the physics based planning model, vehicle set-up information, on-board route database, on-board operating rules, location determination system, real-time closed loop power/brake control, sensor feedback, and the like, one or more embodiments of the system described herein can automatically operate the distributed power system in "independent" mode, where the operational settings of two or more of the powered units may be different or independent of each other.

When operating in distributed power, the operator in a lead powered unit (e.g., a lead locomotive) can control operating functions of remote powered units in the remote consists via a control system, such as a distributed power control element. Thus when operating in distributed power, the operator can command each powered unit and/or consist to operate at a different operational setting (e.g., a different notch power level), or one consist could be in motoring and other consist be in braking, where each individual powered unit in the consist operates at the same operational setting (e.g., the same notch power). In an example embodiment, the components used to generate and/or implement the trip profile are installed on the vehicle, and may be in communication with the distributed power control element. When an operational setting such as a notch power level for a remote consist is desired as recommended by the trip plan, the operational setting can be communicated to the remote consists for implementation.

One or more embodiments described herein may be used with consists in which the powered units in at least one of the consists are not contiguous (e.g., with 1 or more powered units located up front, others in the middle and/or at the rear for vehicle). Such configurations are called distributed power wherein the standard connection between the powered units is replaced by radio link or auxiliary cable to link the powered units externally. When operating in distributed power, the operator in a lead powered unit can control operating functions of remote powered units in the consist via a control system, such as a distributed power control element. In particular, when operating in distributed power, the operator can command each powered unit consist to operate at a different operational setting, such as a different notch power level, (or one consist could be in motoring and other could be in braking) wherein each individual in the powered unit consist operates at the same notch power.

In an example embodiment, installed on the vehicle such as a train, in communication with the distributed power control element, when a notch power level for a remote powered unit consist is desired as recommended by the trip plan, the example embodiment can involve communicating a power setting to the remote powered unit consists for implementation. As described herein, the same may be true for braking.

When operating with distributed power, the optimization previously described can be enhanced to allow additional degrees of freedom, in that one or more of the remote units can be independently controlled from the lead unit. Additional objectives or constraints relating to in-vehicle forces may be incorporated into the performance function, assuming the model to reflect the in-vehicle forces is also included. Thus, the example embodiment may include the use of multiple throttle controls to better manage in-vehicle forces as well as fuel consumption and emissions.

In a vehicle utilizing a consist manager, the lead powered unit in a consist may operate at a different notch power setting than other powered units in the same consist. The other powered units in the consist can operate at the same notch power setting. One example embodiment may be utilized in conjunction with the consist manager to command notch power settings for the powered units in the consist. Thus, based on the example embodiment, since the consist manager divides a consist into two or more groups, including a lead powered unit and trail powered units, the lead powered unit can be commanded to operate at a certain notch power and the trail powered units can be commanded to operate at another notch power. In one example embodiment, the distributed power control element may be the same system and/or apparatus where this operation is housed.

Likewise, when a consist optimizer is used with a powered unit (e.g., locomotive) consist, the example embodiment can be used in conjunction with the consist optimizer to determine notch power for each powered unit in the powered unit consist. For example, if a trip plan recommends a notch power setting of four for the powered unit consist, the consist optimizer may take information representative of the location of the vehicle and determine the notch power setting for each powered unit in the consist. In this implementation, the efficiency of setting notch power settings over intra-vehicle communication channels can be improved. Furthermore, as discussed above, implementation of this configuration may be performed utilizing the distributed control system.

Furthermore, as previously described, one example embodiment of the presently described inventive subject matter may be used for continuous corrections and/or re-planning with respect to when the vehicle consist uses braking based on upcoming items of interest, such as but not limited to route crossings (e.g., railroad crossings), grade changes, approaching sidings, approaching depot yards, approaching fuel stations, and the like, where each or two or more powered units (e.g., locomotives) in the consist may require a different braking option. For example, if the vehicle is coming over a hill or crest, the lead powered unit may enter a braking condition while rearward remote powered units that have not reached the peak or crest of the hill may remain in a motoring state to continue provide tractive effort.

Figure 29:
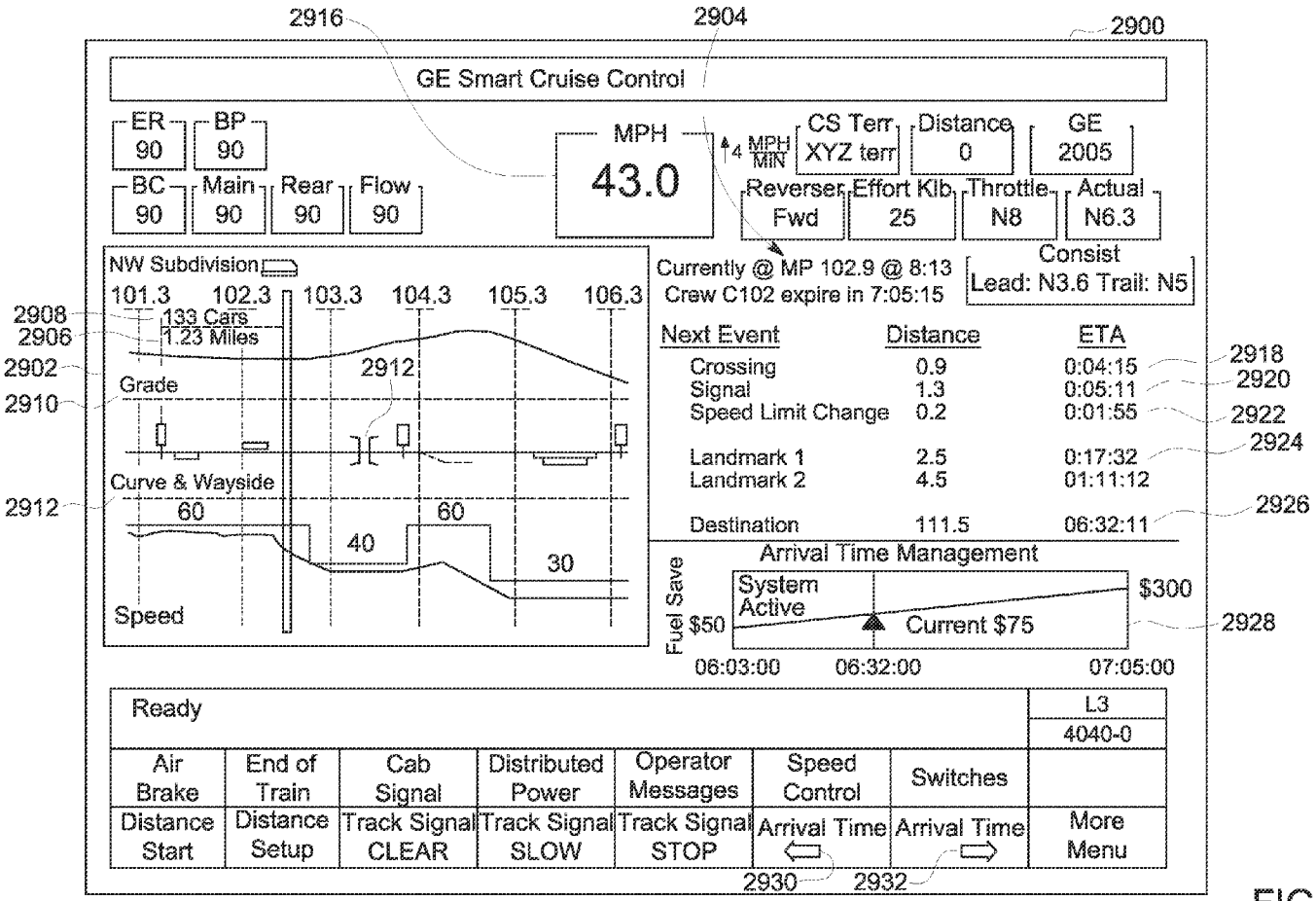
FIG. 29 depicts an example illustration of a dynamic display for use by an operator.
Figure 30:
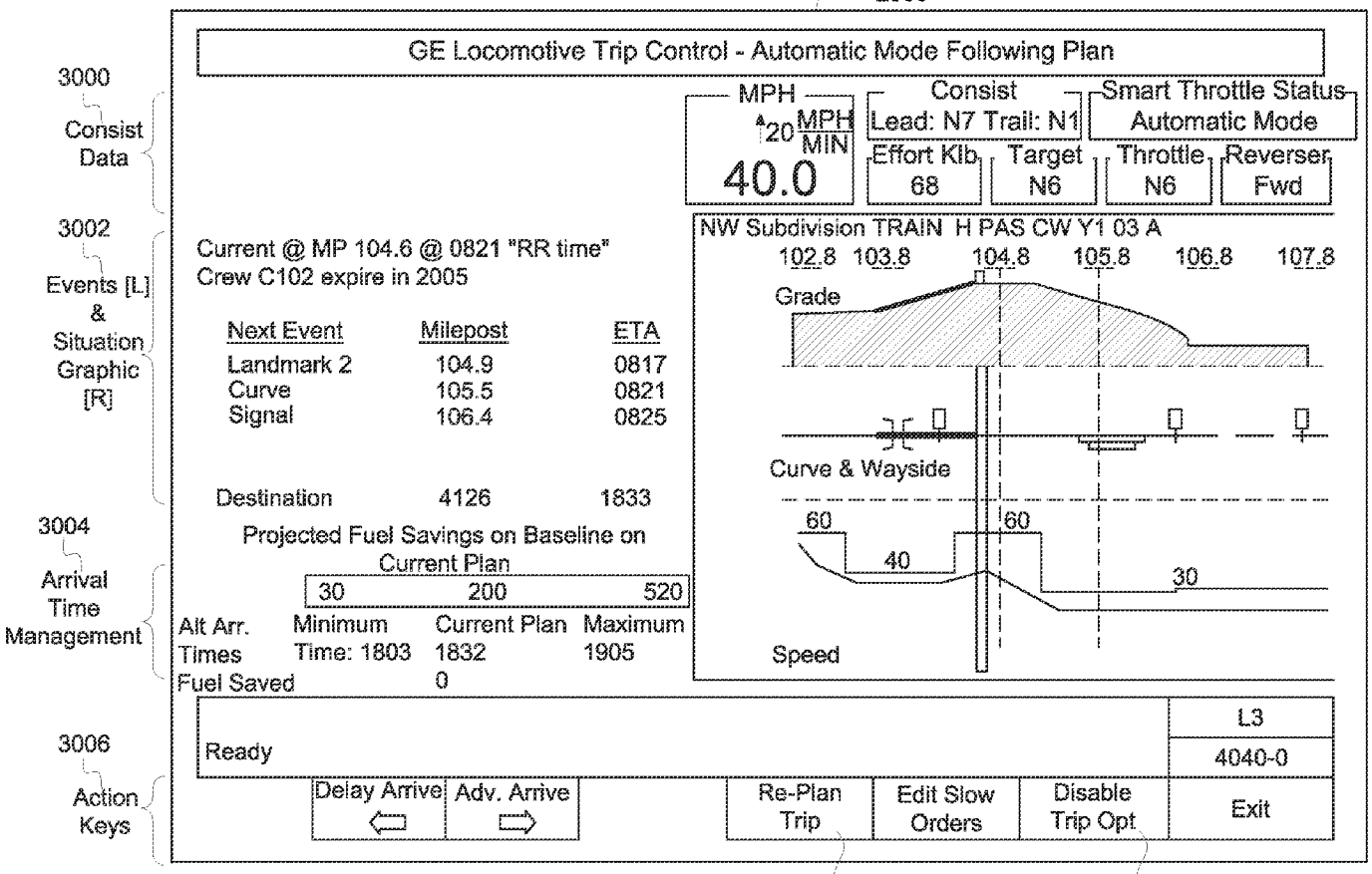
FIG. 30 depicts another example illustration of a dynamic display for use by the operator.
Figure 31:
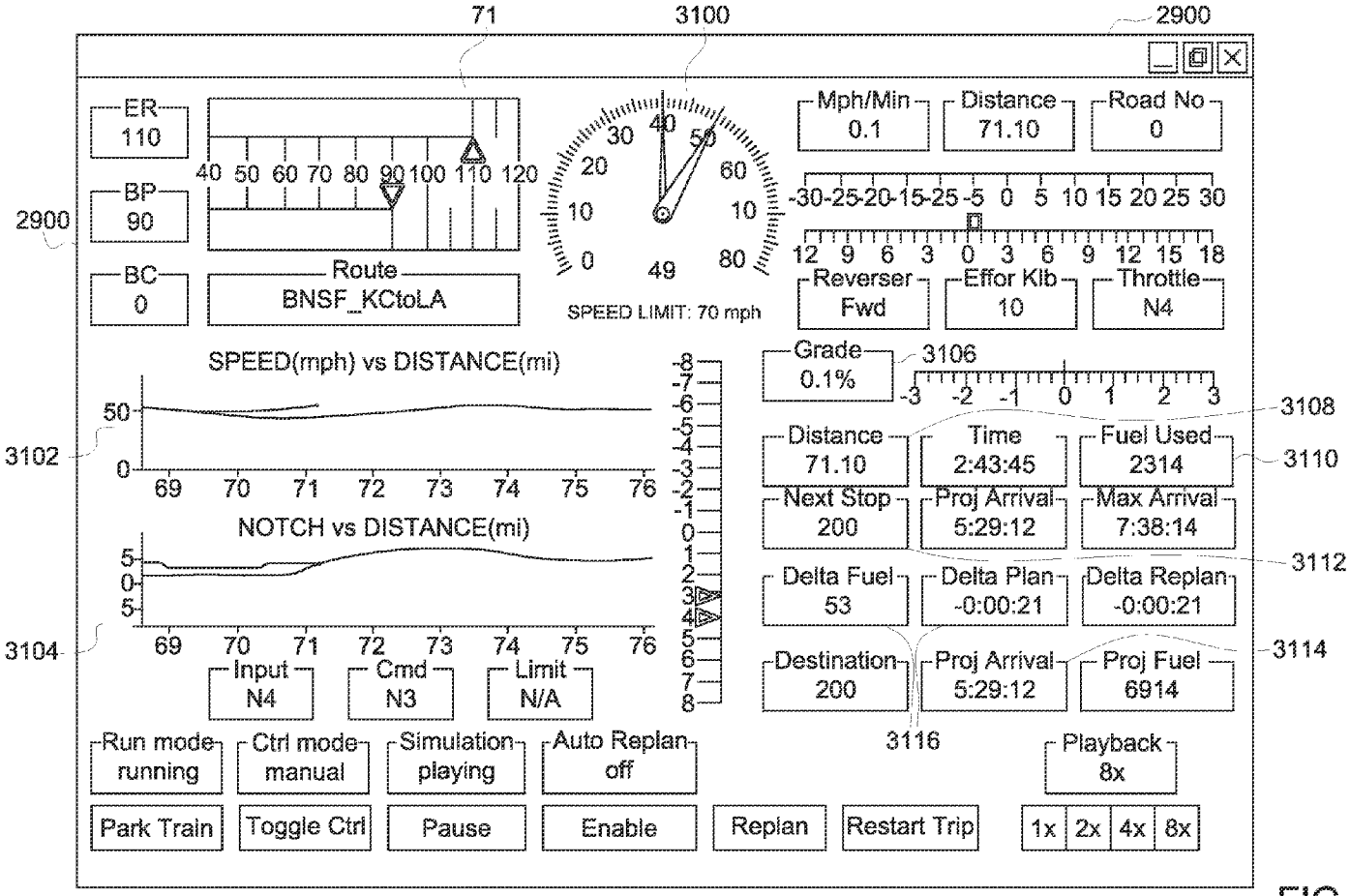
FIG. 31 depicts another example illustration of a dynamic display for use by the operator.

FIGS. 29, 30, and 31 depict example illustrations of dynamic displays 2900 for use by the operator. As provided, FIG. 29, a trip profile is provided and displayed in a first subarea 2902 of the display 2900. Within the trip profile, a location 2904 of a powered unit of a vehicle and/or the vehicle is provided. Information such as vehicle length 2906 and the number of units (e.g., powered units and/or unpowered units) 2908 in the vehicle is provided. Visual elements (e.g., indicia, text, and the like) can be provided for indicating route grade 2910, route curvature and/or locations of wayside elements or equipment 2912 (e.g., bridge locations 2914), and/or vehicle speed 2916. The display 2900 can allow the operator to view such information and also see where the vehicle is located along the route. Information pertaining to distance and/or estimated time of arrival to locations such as route crossings 2918, signals 2920, speed changes 2922, landmarks 2924, and/or destinations 2926 can be provided. An arrival time management tool 2928 is also provided to allow the operator to determine the estimated and/or actual fuel savings that is being realized during the trip. For example, the management tool 2928 may present the operator with indicia and/or text representative of the actual or estimated amount of fuel that is consumed by the vehicle when the vehicle follows the trip profile versus following another profile or plan, or not following any profile or plan. Alternatively, the management tool 2928 may present the operator with indicia and/or text representative of the fewer amount of emissions generated by following the trip profile. The operator has the ability to vary arrival times 2930, 2932 and witness how this affects the fuel savings. For example, the operator can change an arrival time of the vehicle at a scheduled destination. The trip planner device 2806 may re-plan or create another potential trip profile or plan based on the changed arrival time. The change in fuel savings and/or emissions generated that may be achieved by changing the arrival time can be shown in the management tool 2928. The operator may experiment and try several different arrival times and select the arrival time based on the corresponding fuel savings and/or reduction in emissions shown in the management tool 2928. Alternatively, the management tool 2928 may present changes in one or more other operational parameters or conditions of the vehicle that are increased or decreased by following the trip profile. The operator also can be provided with information on the display 2900 about how long the crew has been operating the vehicle. In an example embodiment, time and distance information may be illustrated as the time and/or distance until a particular event and/or location, or as a total elapsed time and/or distance.

In one embodiment, the trip planner device 2806 can be used to "optimize" performance of one or more of the levels 102, 104, 106, 108, 110 described in connection with one or more of FIGS. 1 through 21. For example, the trip planner device 2806 may be disposed onboard or off board a vehicle to create or re-plan one or more trip plan or trip profiles that reduce at least one of fuel consumed or emissions generated by plural vehicles concurrently traveling in the infrastructure level 102 and/or the transportation level 104, by a vehicle in the vehicle level 106, by one or more consists of a vehicle in the consist level 108, and/or by one or more powered units in the powered unit level 110.

As illustrated in FIG. 30, another example of the display 2900 provides information about consist data 3000, an events and situation graphic 3002, an arrival time management tool 3004, and/or action keys 3006. Similar information as discussed above can be provided on the display 2900 shown in FIG. 30 as well. The display 2900 shown in FIG. 30 also provides action keys 3008 to allow the operator to direct the trip planner device to re-plan a trip profile and/or disengage (e.g., turn off) 3010 the trip planner device.

FIG. 31 depicts another example embodiment of the display 2900. Data typical of a vehicle (such as a modern locomotive), including air-brake status, speedometer 3100, information about tractive effort (e.g., in pounds force or traction amps for DC locomotives), and the like, may be visually presented. The speedometer 3100 may show the current designated speed of a trip plan being executed by the vehicle and/or an accelerometer graphic to supplement the readout in mph/minute. Additional data used for execution of the trip plan may be visually presented, such as one or more rolling strip graphics 3102 with designated speed and/or notch settings for the vehicle expressed as a function of distance and/or time compared to a current history of these variables (e.g., speed and/or notch settings). In one embodiment, the location of the vehicle may be derived using the locator element. As illustrated, the location can be provided by identifying how far the train is away from a designated destination (e.g., final or intermediate location along the trip), an absolute position, an initial destination, an intermediate point, and/or an operator input.

The strip chart can provide a look-ahead to changes in speed required to follow the trip plan, which can be useful in manual control, and to monitor the plan versus actual during automatic control. As described herein, such as when in the coaching mode, the operator can either follow the notch or speed designated by a trip plan. The vertical bar gives a graphic of the designated operational setting (e.g., speed or notch) and the actual operational parameter (e.g., actual speed or notch), which are also displayed digitally below the strip chart in the illustrated embodiment. When continuous notch power is utilized, as discussed above, the display can round to closest discrete equivalent, or the display may be an analog display so that an analog equivalent or a percentage or actual horse power/tractive effort is displayed.

Additional information on trip status can be displayed on the display 2900, such as the current grade 3106 of the route that the vehicle is traversing, either by the lead powered unit of the vehicle, a location elsewhere along the vehicle, or an average grade over the length of the vehicle. A distance traveled 3108 so far in the trip plan, cumulative fuel consumed 3110 by the vehicle, where or the distance 3112 away from the next planned stop, current and/or projected arrival time 3114 expected time to be at next stop are also disclosed. The display 2900 may also show the estimated time (e.g., such as an upper or maximum time) to a destination that is possible when the vehicle travels according to one or more of the potential trip plans for the vehicle. If a later arrival was required or requested, a re-plan (e.g., adjustment) of the trip plan can be carried out. Delta plan data 3116 shows status for fuel and/or schedule ahead or behind the current trip plan. Negative numbers may indicate less fuel or early arrival time compared to plan, positive numbers may indicate more fuel or late arrival compared to plan, and typically trade-off in opposite directions (e.g., slowing down to save fuel makes the vehicle late).

The displays 2900 may give the operator a snapshot of where the operator stands with respect to the currently instituted trip plan. The displays 2900 shown in FIGS. 29, 30, and 31 are for illustrative purposes only as there may be other ways of displaying/conveying this information to the operator and/or dispatch. Toward this end, the information disclosed above could be intermixed to provide a display different than the ones disclosed.

Other features that may be included in one or more embodiments include, but are not limited to, allowing for the generation of data logs and/or reports. This information may be stored on the vehicle and downloaded to an off-board system at some point in time. The information may be downloaded via manual and/or wireless transmission. This information may also be viewable by the operator via the display. The information may include, but is not limited to, operator inputs, the time period(s) that the system is operational, fuel saved, fuel imbalance across powered units in the vehicle, vehicle journey off course, system diagnostic issues (such as if GPS sensor is malfunctioning), and the like.

Since trip plans may take into consideration allowable crew operation time, in one embodiment, the trip planner device may take such information into consideration when a trip plan is created such that the trip plan is based on the allowable crew operation time. For example, if an upper designated or maximum time that a crew may operate is eight hours, then the trip planner device may create the trip plan to include one or more stopping locations for one or more new or replacement crew members to take the place of one or more of the present crew members. Such specified stopping locations may include, but are not limited to, rail yards, meet/pass locations, and the like. If, as the trip progresses, the trip time may be exceeded, the trip plan may be overridden by the operator to meet criteria as determined by the operator, such as by speeding up to complete the trip or a segment of the trip on time (e.g., according to a schedule). Ultimately, regardless of the operating conditions of the vehicle, such as but not limited to high load, low speed, vehicle stretch conditions, and the like, the operator can remain in control to command a speed and/or operating condition of the vehicle in one embodiment.

Using one example embodiment of the presently described inventive subject matter, the vehicle may operate in a plurality of operations or operational modes. In one operation, the trip planner device may provide commands for commanding propulsion and/or dynamic braking. The operator may then control other vehicle functions. In another operation, the trip planner device may provide commands for commanding propulsion only. The operator may then control dynamic braking and/or other vehicle functions. In yet another operation, the trip planner device may provide commands for commanding propulsion, dynamic braking, and/or application of the airbrake. The operator may then handle one or more other vehicle functions.

In one embodiment, the trip planner device may notify the operator of upcoming items of interest and/or actions to be taken. Specifically, forecasting logic of the trip planner device may be used to provide for continuous corrections and/or re-planning of the trip plan and/or the route database. The operator may be notified of upcoming route crossings, signals, grade changes, brake actions, sidings, rail or vehicle yards, fuel stations, and the like. This notification may be provided audibly and/or through the operator interface, such as the display.

Specifically, using the physics based planning model, vehicle set-up information, on-board route database, on-board operating rules, location determination system, real-time closed loop control, and/or sensor feedback, the system can present and/or notify the operator of required actions in order to cause the vehicle to follow or more closely follow the trip profile or trip plan. The notification can be visual and/or audible. Examples include notifying of crossings that require the operator activate the locomotive horn and/or bell, notifying of "silent" crossings that do not require the operator activate a horn or bell of the vehicle or powered unit.

In another example embodiment, using the physics based planning model discussed above, vehicle set-up information, on-board route database, on-board operating rules, location determination system, real-time closed loop control, and/or sensor feedback, at least one example embodiment described herein may present the operator information (e.g., a gauge on a display) that allows the operator to see when the vehicle will arrive at various locations as illustrated in FIG. 30. The system can allow the operator to adjust the trip plan (e.g., by changing the target or scheduled arrival time of the vehicle at a destination). This information (e.g., actual estimated arrival time or information needed to derive the actual estimated arrival time at an off-board location) can also be communicated to the dispatch center to allow the dispatcher or dispatch system to adjust the target arrival times. This allows the system to quickly adjust and optimize for the appropriate target function (for example trading off speed and fuel usage).

Based on the information provided above, one or more example embodiments of the presently described inventive subject matter may be used to determine a location of the vehicle 2402 on a route, such as at 2208 of the method represented in the flowchart illustrated in FIG. 22. A determination of one or more route characteristics may also be accomplished, such as by using the vehicle parameter estimator 2814 (shown in FIG. 28). A trip plan or a trip profile may be created based on the location of the vehicle, the characteristic(s) of the route, and/or an operating condition of at least one powered unit of the vehicle. Furthermore, an optimal or designated power requirement or setting may be communicated to vehicle and the operator of the vehicle may be directed to a powered unit, powered unit consist and/or vehicle in accordance with the optimal or designated power, such as through the wireless communication system 2414. In another example, instead of directing the operator, the vehicle 2402, powered unit consist, and/or powered unit may be automatically operated based on the optimal or designated power setting.

Additionally, a method may also involve determining a power setting, or power commands, at 2204 of the method shown in FIG. 22, for the consist based on the trip plan. The consist can then be operated at the power setting. Operating parameters of the vehicle and/or consist may be collected, such as but not limited to actual speed of the vehicle, actual power setting of the consist, and/or a location of the vehicle. At least one of these parameters can be compared to a designated operational setting or condition of the vehicle (e.g., the power setting the consist is commanded to operated at by the trip plan or profile). If the parameters differ from the designated operational setting or condition, the control of the vehicle may be changed to more closely match the parameters to the designated operational setting or condition.

In another embodiment, a method may involve determining operational parameters of the vehicle and/or consist. A desired or designated operational parameter is determined based on determined operational parameters. The determined parameter is compared to the operational parameter. If a difference is detected, the trip plan can be adjusted, such as at 2214 of the method shown in FIG. 22. For example, actual operational parameters (e.g., throttle settings, brake settings, speed, emissions generation, rate of fuel consumption, and the like) may be monitored as the vehicle moves along the route according to a trip plan. The actual operational parameters are compared to operational settings or conditions of the trip plan, such as the throttle settings, brake settings, speed, emissions generation, rate of fuel consumption, and the like, that are calculated to reduce at least one of fuel consumed, emissions generated, or another parameter, over the course of a trip. In one embodiment, if the differences between the actual operational parameters and the designated operational settings or conditions are significant (e.g., exceed one or more thresholds), then the actual operational parameters may be automatically adjusted (e.g., changed) to more closely match the designated operational settings or conditions. In another embodiment, if the differences between the actual operational parameters and the designated operational settings or conditions are significant (e.g., exceed one or more thresholds), then the trip plan may be adjusted, such as by changing the scheduled arrival time of the vehicle at a destination or intermediate location, a route taken by the vehicle, and the like.

Another embodiment may entail a method where a location of the vehicle 2402 on the route 2418 is determined. A characteristic of the route 2418 can also be determined (e.g., grade, curvature, coefficient of friction, and the like). A trip plan, or drive plan, is developed, or generated in order to reduce fuel consumption relative to traveling along the route 2418 according to another plan. The trip plan may be generated based on the location of the vehicle, the characteristic of the route, and/or the operating condition of the consist and/or vehicle 2402. In a similar method, once a location of the vehicle is determined on the route and a characteristic of the route is known, propulsion control and/or notch commands are provided to reduce fuel consumption, as described above.

Figure 33:
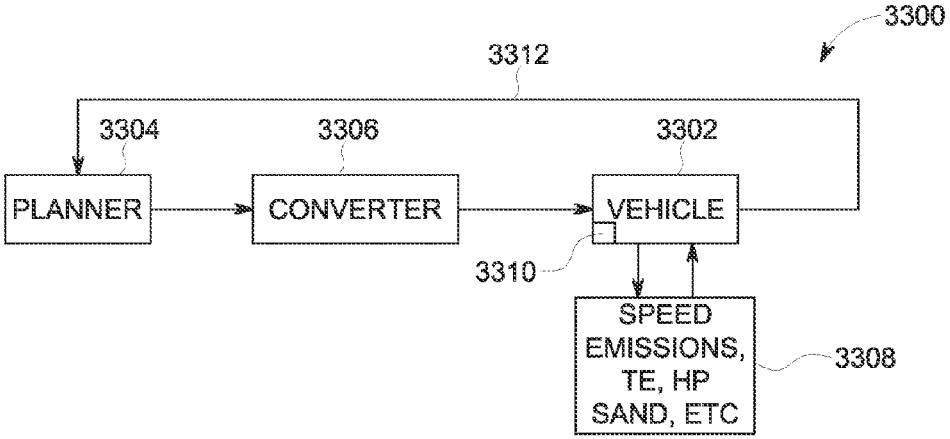
FIG. 33 depicts an example embodiment of a closed-loop system for operating a vehicle (e.g., a rail vehicle)

FIG. 33 depicts an example embodiment of a closed-loop system 3300 for operating a vehicle 3302, such as a rail vehicle. As illustrated, the system 3300 includes a trip planner 3304 (such as the trip planner device 2806 shown in FIG. 28), a converter device 3306 and at least one sensor 3308 that communicates information such as, but not limited to, speed, emissions, tractive effort, horse power, sand (e.g., friction or coefficients of friction related to the route, and the like. The sensors 3308 are provided to gather operating condition data, such as but not limited to speed, emissions, tractive effort, horse power, etc. Output information is then provided from the sensors 3308 to the trip planner device 3304, such as through the vehicle 3302.

Additional output information may be determined by a sensor 3310 which may be part of the vehicle 3302, or in another embodiment, is separate from the vehicle 3302. The sensors 3302, 3308 may be onboard or off board the vehicle to collect information on a variety of operational parameters. For example, with respect to the amount of a friction-modifying substance (e.g., sand) that is placed onto the route to improve friction or traction between the vehicle 3302 and the route, a determination can be made, such as with the sensor 3310, as to how much sand is released onto the route to assist a wheel of the vehicle with fraction and to prevent or reduce slippage of the wheel relative to the route. Similar consideration is applicable for the other outputs identified above. For example, the sensor 3310 may measure actual operational parameters (e.g., information or data representative of actual speeds, actual throttle settings, actual brake settings, actual emission generation, actual fuel consumption or rates thereof, actual friction-modifying substances output from the vehicle, actual friction or incidences of wheel slip, and the like). Information initially derived from information generated from the trip planner 3304 and/or a regulator is provided to the vehicle 3302 through the converter device 3306. Information gathered by the sensor 3310 from the vehicle 3302 is then communicated through a network 3312, either wired and/or wireless, back to the trip planner device 3304. In an example embodiment, the trip planner device 3304 may utilize any variable and use that variable in determining at least one of speed, power, and/or notch setting. For example, the trip planner device 3304 may be at least one of an optimizer for fuel, time, emissions, and/or a combination thereof, as described herein.

The trip planner device 3304 determines operating characteristics (e.g., designated operational settings) for at least one factor that is to be regulated, such as but not limited to speed, fuel, emissions, and the like. The trip planner device 3304 determines at least one designated operational setting (e.g., a power and/or torque setting) based on a determined "optimized" value. For example, the trip planner device 3304 may determine speeds of a trip plan at which the vehicle 3302 is to travel in order to reduce fuel consumed, emissions generated, and the like (or increase another parameter) relative to traveling according to other speeds while still resulting in the vehicle 3302 arriving at one or more locations at scheduled arrival times (or within a designated time threshold of the scheduled arrival times). The trip planner device 3304 can then determine what operational settings (e.g., throttle settings, brake settings, and the like) that are to be used by the vehicle 3302 in order to travel at the speeds of the trip plan. For example, the trip planner device 3304 can determine the operational settings as a function of time and/or distance along a trip in order to cause the vehicle 3302 to travel at the designated speeds of the trip plan. The converter device 3306 can include one or more logic-based devices, such as a processor, controller, control unit, and the like, that receives the designated operational settings from the trip planner device 3304 and determines corresponding control signals for transmission to the vehicle 3302. For example, the converter device 3306 can receive the designated throttle settings, brake settings, and the like, and convert these settings into control signals that direct the vehicle 3302 to use the designated settings, such as control signals that direct the vehicle 3302 to use the power, torque, speed, emissions, sanding, setup, configurations, and the like, and/or other control inputs for the vehicle 3302 (such as a locomotive). This information or data about power, torque, speed, emissions, sanding, setup, configurations etc., and/or control inputs is converted to an electrical signal as the control signal in one embodiment.

The converter device 3306 can generate the control signals to match the control signals that the various subsystems of the vehicle 3302 are designated or expect to receive in order to control operations of the subsystems. For example, fraction motors, dynamic brakes, airbrakes, sand applicators, and the like, are designed to receive different signals in order to change operations of these subsystems. A controller device, such as the master controller device 3204, can be used by an operator to manually change the settings and/or output of the subsystems. For example, the operator can manually actuate a handle, button, switch, and the like, to change the throttle setting (and tractive output) of the vehicle. When the operator actuates the master controller device 3204 to change the setting, the master controller device 3204 can generate a control signal associated with the subsystem having the changed setting. Alternatively, several controller devices may be provided, with each controller device dedicated to controlling operational settings of a different subsystem (e.g., propulsion, braking, and the like) of the vehicle 3302. Each controller device may generate a control signal that is recognized by the associated subsystem (and/or may not be recognized by other subsystems) to cause the subsystem to perform in a manner indicated by the actuated controller device.

The converter device 3306 can generate control signals that mimic the control signals sent from the controller devices to the various subsystems. For example, if movement of a throttle handle between different notch positions causes a first control signal to be transmitted from a first controller device to the traction motors of the vehicle, then the converter device 3306 may generate similar or the same first control signal when dictated by the trip plan and/or the trip planner device 3304. For example, when the trip plan dictates that the speed or tractive output of the vehicle 3302 is to change, the converter device 3306 may generate a first control signal that directs the traction motors to change the speed, tractive output, torque, and the like, of the traction motors and cause the vehicle to change speed. As another example, the converter device 3306 may generate a second control signal (that differs from the first control signal) for transmission to a different subsystem, such as brakes of the vehicle. The second control signal may cause actuation of the brakes and may mimic or otherwise be the same as similar control signals send from a controller device that controls actuation of the brakes. The converter device 3306 can be added to an existing vehicle in a communication path with the subsystems so that the subsystems receive control signals from the converter device 3306 that are followed by the subsystems similar to how control signals are otherwise sent from the controller device(s).

Alternatively, the converter device 3306 may transmit the control signals to a display (e.g., the display 2900) that visually presents instructions to an operator of the vehicle as to how to manually control (e.g., manually implement) the operational settings designated by the trip plan or trip profile.

In one embodiment, the converter device 3306 may be communicatively coupled with the different subsystems (e.g., propulsion, braking, and the like) of the vehicle 3302 by different communication paths. For example, the converter device 3306 may communicate with traction motors, brakes, and the like, over wired connections, such as different busses, cables, wires, and the like. The control signals mimicked by the converter device 3306 may be analog and/or digital signals. For example, the converter device 3306 may transmit analog signals to some subsystems, such as brakes, and transmit digital signals to other subsystems, such as the traction motors.

The control signals generated by the converter device 3306 may be identical to the control signals generated by the controller device(s) in one embodiment. Alternatively, the control signals sent by the converter device 3306 and/or the controller device(s) may include an identifier that indicates which of the converter device 3306 or controller device sent the control signal. The identifier may be used by the subsystems to distinguish between the source of the control signals. In one embodiment, when control signals are sent to the same subsystem by both the converter device 3306 and one or more controller devices, the subsystems may use the identifiers in the control signals to determine which control signal is to be implemented. For example, the control signals associated with the controller device may be given a higher priority such that duplicative or conflicting control signals from the converter device 3306 are ignored.

The system 3300 may be used to provide for closed-loop control of the vehicle 3302. As described above, the trip planner device 3304 can generate a trip plan that is associated with designated operational parameters (e.g., settings and/or conditions) of the vehicle 3302. The actual operational parameters (e.g., actual settings and/or conditions) of the vehicle 3302 can be communicated back to the trip planner device 3304 and/or the converter device 3306. Based on differences between the actual and designated operational parameters, the trip planner device 3304 may change (e.g., re-plan) the trip plan and/or the converter device 3306 may generate corrective control signals for the subsystems. These corrective control signals may direct the subsystems to change the actual operational parameters to more closely match the designated operational parameters.

Figure 34:
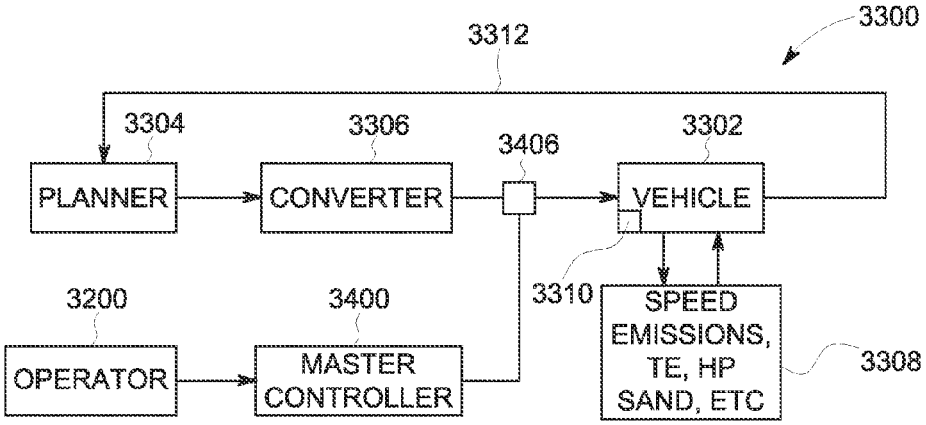
FIG. 34 depicts one embodiment of the closed loop system integrated with a master control unit.

FIG. 34 depicts the closed loop system 3300 shown in FIG. 33 integrated with a master control unit 3400. As illustrated in further detail below, the converter device 3306 may interface with one or more of a plurality of devices, such as, but not limited to, a master controller 3400, a remote control powered unit controller, a distributed power drive controller (e.g., a controller that controls one or more powered units in a distributed power configuration of a vehicle such as a rail vehicle), a vehicle line modem (e.g., a train line modem), an analog input, and the like. The converter device 3306, for example, may disconnect from the output of the master controller device 3400. The master controller device 3400 may be used by the operator to command operations of the powered unit in a vehicle, such as but not limited to controlling power, horsepower, tractive effort, sanding, braking (including at least one of dynamic braking, air brakes, hand brakes, etc.), propulsion, and the like, levels to the powered unit. The master controller device 3400 may be used to control hard switches and/or software based switches used in controlling the powered unit.

The master controller device 3400 generates control signals to command operation of the subsystems (e.g., propulsion, braking, and the like) of the vehicle 3302. The converter device 3306 can be communicatively coupled with the subsystems in such a way that the converter device 3306 can inject control signals into the communication pathway(s) between the master controller device 3400 and the subsystems that receive control signals. For example, the converter device 3306 may mimic the control signals generated by the master controller device 3400 with control signals from the converter device that are based on a trip plan or trip profile, as described above. The disconnection of the master controller device 3400 may be electrical wires or software switches or configurable input selection process, and the like. A switching device 3406 is illustrated to perform this function.

The switching device 3406 may be actuated to connect or disconnect the subsystems of the vehicle 3302 from communication with one or more of the master controller device 3400 and/or the converter device 3306. For example, during a time period when the vehicle 3302 is being manually controlled by an operator or an automated system other than the trip planner device 3304, the switching device 3406 may disconnect the trip planner device 3304 from communication with the subsystems and/or connect the master controller device 3400 with the subsystems. Alternatively, during a time period when the vehicle 3302 is being automatically controlled by a trip plan generated by the trip planner device 3304, the switching device 3406 may connect the trip planner device 3304 with the subsystems and/or disconnect the master controller device 3400 from communication with the subsystems. The switching device 3406 may be manually controlled and/or automatically controlled. For example, an operator may manually change which of the master controller device 3400 and the converter device 3306 communicates control signals with the subsystems. Alternatively, the switching device 3406 may automatically change which of the master controller device 3400 and the converter device 3306 communicates control signals with the subsystems responsive to an event. The event can include manual actuation of one or more controls (e.g., the operator changing a throttle setting and/or applying brakes during a time period when the converter device 3306 is controlling operations of the subsystems) or another type of event, such as the vehicle 3302 entering into or leaving a region or area (e.g., crossing a geofence) associated with where the trip plan generated by the trip planner device 3304 can or cannot be used, the operator failing to actuate one or more actuators on the vehicle after a predetermined period of time, and the like.

As discussed above, the same technique may be used for other devices, such as but not limited to a control locomotive controller, a distributed power drive controller, a train line modem, analog input, and the like. The master controller device similarly could use these devices and their associated connections to the locomotive and use the input signals. The communication system or network 3312 for these other devices may be wireless and/or wired.

Figure 35:
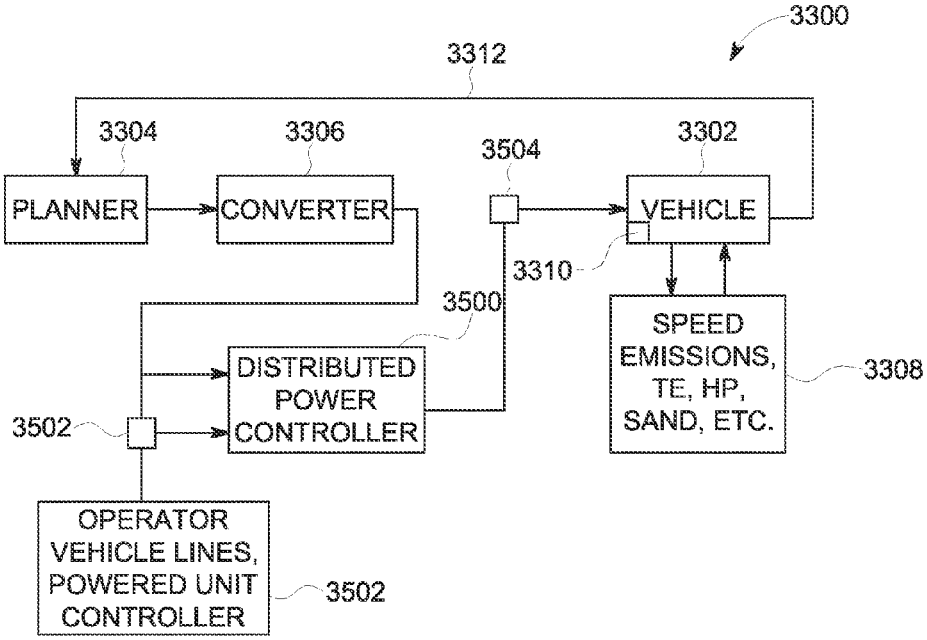
FIG. 35 depicts an example embodiment of a closed-loop system for operating a vehicle (e.g., a rail vehicle) integrated with another input operational subsystem of the vehicle.

FIG. 35 depicts another example embodiment of a closed-loop system 3300 for operating a vehicle 3302. The system 3300 shown in FIG. 35 controls operations of the vehicle 3302 that is integrated with another input operational subsystem. For example, a distributed power (DP) controller device 3500 may receive inputs from various sources 3502, such as but not limited to, the operator of the vehicle, vehicle lines (e.g., train lines) and/or powered unit controller devices, and transmit the information to powered units in remote positions of the vehicle 3302. In one embodiment, the system 3300 is used with the vehicle 3302 that is in a distributed power configuration, such as a configuration where multiple powered units are included in the vehicle 3302 and the tractive output and/or braking output of the powered units are coordinated with each other.

In operation, the converter device 3306 may provide control signals based on the trip plan generated by the trip planner device 3304 to the DP controller 3500. The converter device 3306 may directly communicate the control signals to an input of the DP controller device 3500 (as an additional input) or break one of the input connections with the DP controller device 3500 and transmit the control signals to the DP controller device 3500.

A first switching device 3502 is provided to direct how the converter device 3306 provides information to the DP controller device 3500 as discussed above. For example, the first switching device 3502 may disconnect the sources 3502 from the DP controller device 3500 so that the converter device 3306 provides the control signals to the DP controller device 3500. The DP controller device 3500 may then coordinate operations of the powered units in the vehicle 3302 based on the control signals from the converter device 3306. Alternatively, the first switching device 3502 may connect the sources 3502 with the DP controller device 3500 such that the DP controller device 3500 coordinates operations of the powered units based on the information and/or control signals received from the sources 3502 instead of the converter device 3306. A second switching device 3504 can be provided to connect or disconnect the DP controller device 3500 from the powered units of the vehicle 3302. The switching devices 3502, 3504 may be a software-based switch and/or a wired switch. Additionally, the switching device 3502 and/or 3504 may not necessarily be two-way switches. The switching devices 3502, 3504 may have a plurality of switching directions based on the number of signals that the switching devices 3502, 3504 are controlling.

Figure 36:
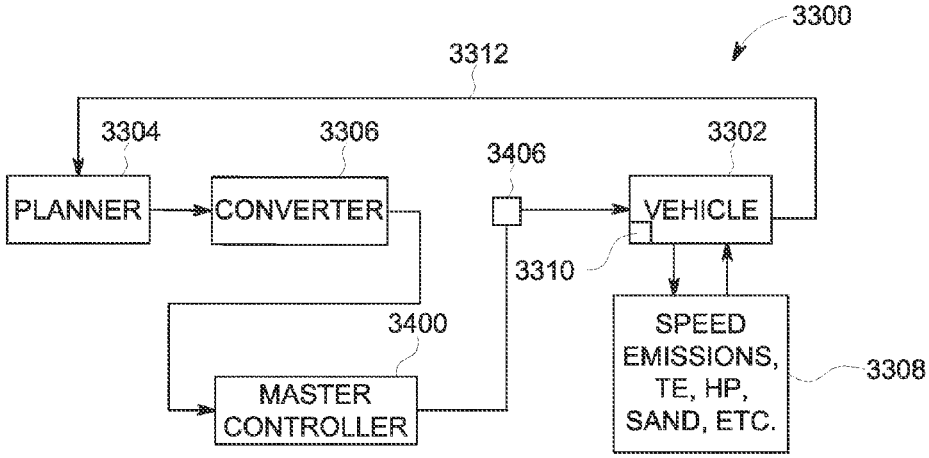
FIG. 36 depicts another example embodiment of a master control unit as part of the closed loop system.

FIG. 36 is another example embodiment of the closed-loop control system 3300. In the illustrated embodiment, the converter device 3306 is shown as interfacing with the master controller device 3400 to control operations of the master controller device 3400. For example, the master controller device 3400 may include input devices, such as levers, handles, buttons, switches, and the like, that are actuated to generate the control signals to the subsystems for controlling operations of the subsystems. The converter device 3306 may mechanically interface with the input devices of the master controller device 3400 so as to actuate (e.g., move) the input devices of the master controller device 3400. For example, the converter device 3306 may include an arm, solenoid, piston, or other automatically moveable component, that actuates one or more of the input devices of the master controller device 3400. The converter device 3306 may automatically actuate the input devices in order to cause the master controller device 3400 to generate the control signals used to implement the trip plan, similar to as described above in connection with the converter device 3306 generating the control signals. As shown in FIG. 36, the converter device 3306 may not be connected with the subsystems of the vehicle 3302 (other than through the master controller device 3400) so that the subsystems may only receive the control signals from the master controller device 3400 as opposed to both the master controller device 3400 and the converter device 3306.

Figure 37:
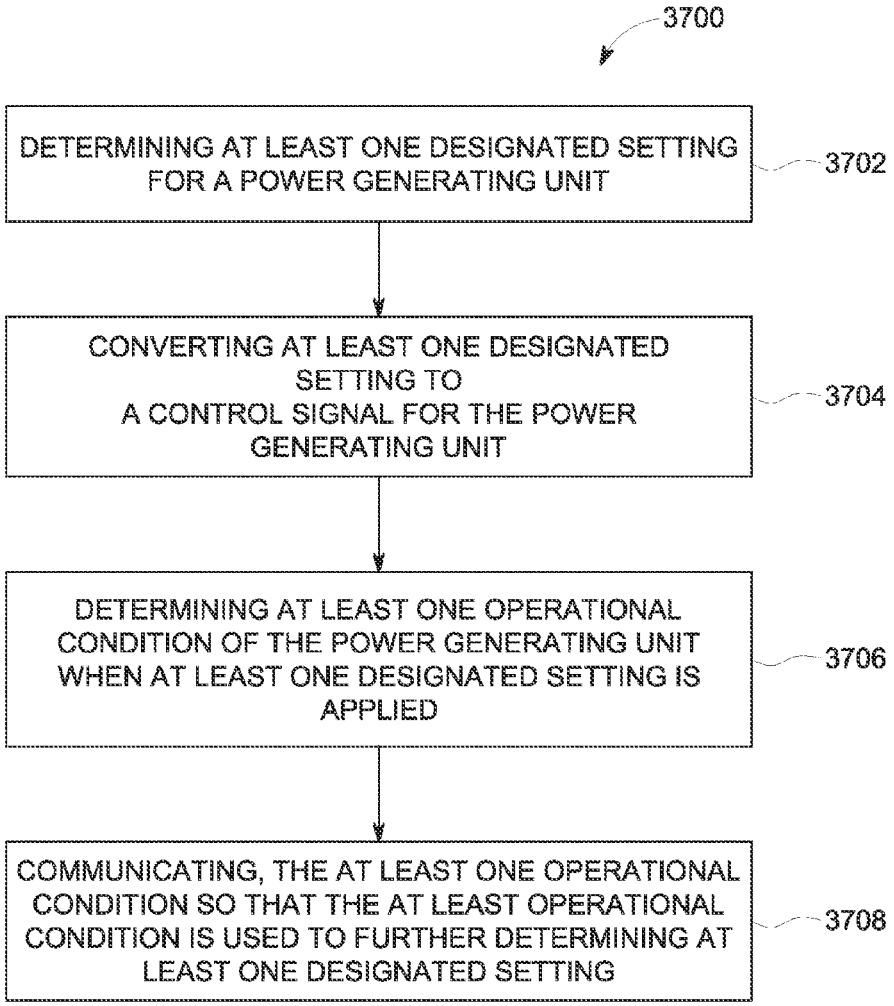
FIG. 37 depicts an example flowchart of a method for operating a vehicle (e.g., a rail vehicle) in a closed-loop process.

FIG. 37 illustrates an example flowchart of a method 3700 for operating a vehicle in a closed-loop process. The method 3700 may be used in conjunction with one or more of the systems and components described and/or shown in FIGS. 1-36 to control operations of a vehicle and/or powered units of a vehicle. The method 3700 includes, at 3702, determining a designated operational setting for a vehicle, powered unit, and/or consist of one or more powered units. The designated operational setting may include a setting for any setup variable such as, but not limited to, at least one of power level, torque, emissions, number axles cut in, other powered unit configurations, brake setting, throttle setting, speed, and the like. At 3704, the designated operational setting is converted to a recognizable control signal for one or more subsystems of the vehicle, powered unit, and/or consist. At 3706, at least one operational condition of the vehicle, powered unit, and/or consist (e.g., an actual operational setting or condition) is determined. For example, when the control signal is applied, the resultant actual operational parameter (e.g., an actual setting or condition representative of speed, throttle setting, brake setting, and the like) can be determined. At 3708, the at least one operational condition that is determined is communicated in the closed loop system so that the at least one operational condition can be used to further determine at least one designated operational setting. For example, the actual setting of the vehicle, powered unit, and/or consist can be compared to a designated setting and, if the actual setting differs from the designated setting, corrective control signals can be determined and/or a trip plan having the designated operational settings can be adjusted, as described above.

As disclosed above, the operations illustrated and described in connection with the method 3700 may be performed using a computer software code, such as one or more sets of instructions stored on a tangible and/or non-transitory computer readable storage medium. Therefore, for vehicles that may not initially have the ability to perform the operations disclosed herein, electronic media containing the computer software modules may be accessed by a computer on the vehicle so that at least of the software modules may be loaded onto the vehicle for implementation. Electronic media is not to be limiting since any of the computer software modules may also be loaded through an electronic media transfer system, including a wireless and/or wired transfer system, such as but not limited to using the Internet and/or another network to accomplish the installation.

In another embodiment, a control system for operating a vehicle is provided. The system includes a trip planner device and a sensor. The trip planner device is configured to determine plural speed settings for the vehicle as a function of at least one of time or distance of the vehicle along a route. The trip planner device also is configured to determine the settings at an initial point of the vehicle prior to traveling along the route and based on information of the vehicle and information of the route. The trip planner device is also configured to output first signals relating to the speed settings for controlling the vehicle to travel along the route. The sensor is configured to collect vehicle speed data of the vehicle as the vehicle travels along the route, the sensor configured to provide the vehicle speed data to the trip planner device. The trip planner device is configured to determine a difference between a vehicle speed of the vehicle at a location along the route and a speed setting of the plural speed settings for the vehicle and associated with the location along the route, and to adjust the first signals based on the difference that is determined to control the vehicle speed towards the speed setting.

In another aspect, the trip planner device is further configured to re-determine the plural speed settings as the vehicle travels along the route based on at least one of the vehicle speed data that is collected or other vehicle operational data collected as the vehicle travels along the route.

In another embodiment, a control system for operating a vehicle is provided. The system includes a trip planner device and a sensor. The trip planner device is configured to determine at least one of speed, power, or throttle settings as a function of at least one of time or distance of the vehicle along a route. The at least one of speed, power, or throttle settings are based on information of the vehicle and information of the route. The trip planner device also is configured to output signals relating to the at least one of speed, power, or throttle settings for control of the vehicle along the route. The sensor is configured to collect operational data of the vehicle that includes data of a vehicle speed as the vehicle travels along the route. The sensor also is configured to provide the operational data to the trip planner device. The trip planner device is configured to adjust the at least one of the speed, power, or throttle settings based at least in part on the operational data.

In another aspect, the trip planner device is configured to re-determine, at a point along the route, the at least one of speed, power, or throttle settings based on the information of the vehicle, the information of the route, and the operational data.

In another aspect, the system also includes a converter device configured to be coupled to the trip planner device and to convert the output signals from the trip planner device to control signals for controlling operations of the vehicle.

In another aspect, the system also includes a master controller device configured to be coupled to the converter device and the vehicle for controlling the operations of the vehicle. The master controller device includes at least one switching device operable by an operator of the vehicle.

In another aspect, the at least one of speed, power, or throttle settings are determined based at least in part on fuel consumption.

In another aspect, the at least one of speed, power, or throttle settings are determined based at least in part on time considerations.

In another aspect, the at least one of speed, power, or throttle settings are determined based at least in part on emissions output.

In another aspect, the trip planner device is configured to generate a trip plan that includes plural control settings of the vehicle. The control settings include a plurality of the speed, power, or throttle settings, and the trip planner device is configured to generate the trip plan prior to the vehicle departing on a trip that uses the trip plan to control operations of the vehicle.

In another aspect, the trip planner device is configured to adjust the at least one of the speed, power, or throttle settings based at least in part on the operational data while the vehicle is moving along the route according to the at least one of speed, power, or throttle settings.

In another aspect, the sensor is a speed sensor that monitors actual speed of the vehicle as the vehicle travels along the route.

In another aspect, the trip planner device is configured to determine the speed settings of the vehicle for different locations of the vehicle along the route and to compare the actual speed of the vehicle at one or more of the locations with the speed setting associated with the one or more of the locations to determine whether to change one or more of the speed settings of the vehicle.

In another aspect, the trip planner device is configured to compare the actual speed of the vehicle with one or more of the speed settings to identify a difference and to change control of the vehicle such that the actual speed of the vehicle moves closer to the one or more of the speed settings such that the difference is reduced.

In another embodiment, a method for controlling a vehicle is provided. The method includes detecting data related to an operational condition of the vehicle that is representative of a vehicle speed as the vehicle travels along a route. The method also includes determining information related to the route of the vehicle, determining one or more speed, power, or throttle settings based on the operational condition of the vehicle and the information related to the route of the vehicle, and adjusting at least one of the one or more speed, power, or throttle settings based at least in part on the operational condition of the vehicle.

In another aspect, the method also includes re-determining the one or more speed, power, or throttle settings based on the information related to the route of the vehicle and the operational condition data at a point along the route.

In another embodiment, another control system for operating a vehicle is provided. The system includes a trip planner device, a converter device, and a sensor. The trip planner device is configured to determine one or more speed, power, or throttle settings as a function of at least one of time or distance of the vehicle along a route, the one or more speed, power, or throttle settings based on information of the vehicle and information of the route. The trip planner device also is configured to output first signals relating to the one or more speed, power, or throttle settings. The converter device is configured to be coupled with a propulsion system of the vehicle, to receive the first signals from the trip planner device, and to output control signals based on the input signals for controlling operations of the propulsion subsystem along the route. The sensor is configured to collect operational data of the vehicle that includes data of a vehicle speed as the vehicle travels along the route. The sensor also is configured to provide the operational data to the trip planner device. The trip planner device is configured to adjust the first signals based at least in part on the operational data.

In another aspect, the trip planner device is further configured to determine a speed difference between a vehicle speed of the vehicle at a location along the route and a speed setting determined by the trip planner device for the location. The trip planner device also is configured to adjust the first signals based on the speed difference that is determined to control the vehicle speed towards the speed setting.

In another embodiment, another control system for operating a vehicle is provided. The system includes a trip planner device and a sensor. The trip planner device is configured to determine first plural speed, power, or throttle settings as a function of at least one of time or distance along a route based on information of the vehicle and information of the route. The trip planner device also is configured to output first signals based on the first plural speed, power, or throttle settings, the first signals relating to control of a propulsion subsystem of the vehicle along the route. The trip planner device is further configured to determine the first plural speed, power, or throttle settings at an initial point of the route prior to the vehicle traveling along the route. The sensor is configured to collect operational data of the vehicle that is representative of vehicle speeds as the vehicle travels along the route. The sensor also is configured to provide the operational data to the trip planner device. The trip planner device is configured to adjust the first signals based on the operational data.

In another aspect, the trip planner device is configured to determine, at a second point along the route, second plural speed, power, or throttle settings as a function of at least one of time or distance along a portion of the route past the second point, based on the information of the vehicle, the information of the route, and the operational data. The trip planner device also is configured to output the first signals based on the second plural speed, power, or throttle settings along the portion of the route.

In another aspect, the trip planner device is further configured to determine a speed difference between a vehicle speed of the vehicle at a location along the route and a speed setting for the vehicle at the location as determined by the trip planner device at the initial point of the route prior to the vehicle traveling along the route. The trip planner device also is configured to adjust the first signals based on the speed difference that is determined to control the vehicle speed towards the speed setting.

In another embodiment, a system (e.g., for controlling a vehicle) includes a trip planner device and a converter device. The trip planner device is configured to obtain a trip plan that designates operational settings for a vehicle during a trip along one or more routes. The trip plan designates the operational settings to reduce at least one of fuel consumed or emissions generated by the vehicle during the trip relative to the vehicle traveling over the trip according to at least one other plan. The converter device is configured to generate one or more first control signals for directing operations of the vehicle according to the operational settings designated by the trip plan. The converter device also is configured to obtain actual operational parameters of the vehicle for comparison to the operational settings designated by the trip plan. The converter device is further configured to generate one or more corrective signals for directing operations of the vehicle in order to reduce one or more differences between the actual operational parameters and the operational settings designated by the trip plan.

In another aspect, the operational settings designated by the trip plan include one or more throttle settings, power notch settings, brake settings, or speeds of the vehicle.

In another aspect, the actual operational parameters include one or more actual throttle settings, actual power notch settings, actual brake settings, or actual speeds of the vehicle.

In another aspect, the trip plan designates the operational settings as a function of at least one of time or distance along the one or more routes in the trip.

In another aspect, the converter device is configured to generate at least one of the first control signals or the corrective control signals for communication to a propulsion subsystem of the vehicle so that the at least one of the first control signals or the corrective control signals mimic second control signals communicated to the propulsion subsystem by a controller device that is manually operated to control the operations of the vehicle.

In another aspect, the at least one of the first control signals or the corrective control signals mimic the second control signals by including at least some common control information that is used to control the operations of the propulsion subsystem.

In another aspect, the system also includes a switching device configured to be communicatively coupled with at least one of the converter device or the controller device to control which of the converter device or the controller device controls the operations of the vehicle.

In another aspect, the converter device is configured to communicate at least one of the first control signals or the corrective control signals to a distributed power (DP) controller device of the vehicle so that the DP controller device can coordinate operations of plural powered units of the vehicle.

In another aspect, the converter device is configured to mechanically actuate an input device of a controller device onboard the vehicle to cause the controller device to generate the at least one of the first control signals or the corrective control signals for directing the operations of the vehicle.

In another aspect, the converter device is configured to communicate the at least one of the first control signals or the corrective control signals to a display for presentation of instructions representative of the at least one of the first control signals or the corrective control signals to an operator of the vehicle.

In another aspect, the trip planner device is configured to re-plan the trip plan when one or more of the differences between the actual operational parameters and the operational settings designated by the trip plan exceed one or more designated thresholds as the vehicle travels along the route.

In another aspect, the trip planner device is configured to generate a plurality of the trip plans for the vehicle. At least two of the trip plans are associated with different arrival times for the vehicle and presented to an operator of the vehicle for selection of at least one of the trip plans to be implemented by the converter device.

In another aspect, the trip planner device is configured to be disposed onboard the vehicle.

While the inventive subject matter has been described in what is presently considered to be a preferred embodiment, many variations and modifications will become apparent to those of ordinary skill in the art. Accordingly, it is intended that the inventive subject matter not be limited to the specific illustrative embodiment but be interpreted within the full spirit and scope of the appended claims.

When introducing elements of the present inventive subject matter or the embodiment(s) thereof, the articles "a," "an," "the," and "said" are intended to mean that there are one or more of the elements. The terms "comprising," "including," and "having" are intended to be inclusive and mean that there may be additional elements other than the listed elements.

While various embodiments of the presently described inventive subject matter have been illustrated and described, it will be appreciated to those of ordinary skill in the art that many changes and modifications may be made thereunto without departing from the spirit and scope of the inventive subject matter. Accordingly, it is intended that the inventive subject matter not be limited to the specific illustrative embodiment but be interpreted within the full spirit and scope of the appended claims. As various changes could be made in the above constructions without departing from the scope of the inventive subject matter, it is intended that all matter contained in the above description or shown in the accompanying drawings shall be interpreted as illustrative and not in a limiting sense.

What is claimed is:

1. A system comprising:

a first device configured to obtain an operational setting for a vehicle as a function of at least one of time or distance of the vehicle along at least part of a route, wherein the first device is configured to determine the operational setting based on information of the vehicle and information of at least part of the route, and wherein the first device is also configured to output a first signal relating to the operational setting for controlling the vehicle to travel along the route; and a second device configured to obtain operational data of the vehicle as the vehicle travels along the route, the second device configured to provide the operational data to the first device;

wherein the first device is configured to obtain a difference between the operational data of the vehicle at one or more of a location or a time along the route and the operational setting for the vehicle and associated with the one or more of a location or a time along the route, and to adjust the first signal based on the difference that is obtained.

2. The system of claim 1, wherein the first device is configured to adjust the first signal for at least partially adjusting the operational data of the vehicle toward the operational setting.

3. The system of claim 1, wherein the second device is a sensor that senses information representative of the operational data.

4. The system of claim 1, wherein the operational setting is a designated speed of the vehicle and the operational data is an actual speed of the vehicle.

5. The system of claim 1 wherein the first device is further configured to re-obtain the operational setting as the vehicle travels along the route based on at least one of the operational data that is determined as the vehicle travels along the route.

6. A system comprising:

a first device configured to obtain one or more of speed, power, or throttle settings of a vehicle as a function of at least one of time or distance along at least part of a route, the one or more of speed, power, or throttle settings based on information of the vehicle and information of at least part of the route, the first device also configured to communicate an output signal relating to the one or more of speed, power, or throttle settings for at least partially managing movement of the vehicle along the route; and a second device configured to obtain data of the vehicle, the data at least partially representative of a vehicle speed as the vehicle travels along the route, wherein the first device is configured to at least partially adjust the one or more of the speed, power, or throttle settings based at least in part on the data of the vehicle.

7. The system of claim 6, wherein the second device is configured to obtain the data of the vehicle based on actual movement of the vehicle.

8. The system of claim 6, wherein the first device is configured to re-obtain the one or more of the speed, power, or throttle settings based at least in part on the data of the vehicle.

9. The system of claim 6, further comprising a third device configured to convert the output signal from the first device to a control signal for at least partially adjusting operation of the vehicle.

10. The system of claim 6, wherein the first device is configured to obtain the one or more of the speed, power, or throttle settings based at least in part on fuel consumption.

11. The system of claim 6, wherein the first device is configured to obtain the one or more of the speed, power, or throttle settings based at least in part on emissions output.

12. The system of claim 6, wherein the first device is configured to at least partially adjust the one or more of the speed, power, or throttle settings based at least in part on the data of the vehicle while the vehicle is moving along the route.

13. The system of claim 6, wherein the second device is a speed sensor that monitors actual speed of the vehicle as the vehicle travels along the route.

14. The system of claim 13, wherein the first device is configured to obtain the speed settings of the vehicle and to compare the actual speed of the vehicle with the speed settings to obtain whether to at least partially change one or more of the speed settings of the vehicle.

15. A method comprising:

obtaining data related to an operational condition of a vehicle;

obtaining information related to at least part of a route;

obtaining one or more speed, power, or throttle settings based on the operational condition of the vehicle and the information related to at least part of the route; and at least partially adjusting at least one of the one or more speed, power, or throttle settings based at least in part on the operational condition of the vehicle.

16. The method of claim 15, further comprising at least partially revising the one or more speed, power, or throttle settings based on the operational condition.

17. The method of claim 15, wherein the operational condition is at least partially representative of a vehicle speed.

* * * * *